US008573578B1

(12) United States Patent
Warth

(10) Patent No.: US 8,573,578 B1
(45) Date of Patent: Nov. 5, 2013

(54) WORKHOLDING APPARATUS

(75) Inventor: Jeffrey M. Warth, Mars, PA (US)

(73) Assignee: Chick Workholding Solutions, Inc., Warrendale, PA (US)

( * ) Notice: Subject to any disclaimer, the term of this patent is extended or adjusted under 35 U.S.C. 154(b) by 0 days.

(21) Appl. No.: 13/366,950

(22) Filed: Feb. 6, 2012

Related U.S. Application Data

(63) Continuation-in-part of application No. 12/199,026, filed on Aug. 27, 2008, which is a continuation-in-part of application No. 11/897,157, filed on Aug. 29, 2007, now Pat. No. 8,109,494.

(60) Provisional application No. 60/841,824, filed on Sep. 1, 2006.

(51) Int. Cl.
*B25B 1/10* (2006.01)
*B25B 1/24* (2006.01)

(52) U.S. Cl.
USPC ..... 269/244; 269/43; 269/228

(58) Field of Classification Search
USPC ..... 269/244, 43, 45, 71, 228, 138, 136
See application file for complete search history.

(56) References Cited

U.S. PATENT DOCUMENTS

| | | | |
|---|---|---|---|
| 287,271 | A | 10/1883 | Gladwin |
| 307,439 | A | 11/1884 | Corbett |
| 463,332 | A | 11/1891 | Giles |
| 600,370 | A | 3/1898 | Kohler |
| 731,871 | A | 6/1903 | Echols |
| 1,262,621 | A | 4/1918 | Beacham |
| 1,329,602 | A | 2/1920 | Hultberg |
| 1,365,784 | A | 1/1921 | Husson |
| 1,385,088 | A | 7/1921 | Mellor |
| 1,393,083 | A | 10/1921 | Campbell |
| 1,495,772 | A | 5/1924 | Brown |
| 1,550,751 | A | 8/1925 | Sinkler |
| 1,811,299 | A | 6/1931 | Brockhaus, Jr. |
| 1,850,178 | A | 3/1932 | McChesney |
| 2,061,718 | A | 11/1936 | Stahl |
| 2,227,443 | A | 1/1941 | Denner |
| 2,251,016 | A | 7/1941 | Gallimore |
| 2,274,428 | A | 2/1942 | Odin |

(Continued)

FOREIGN PATENT DOCUMENTS

| | | |
|---|---|---|
| CH | 480 912 | 12/1969 |
| DE | 1904673 | 11/1964 |

(Continued)

*Primary Examiner* — Lee D Wilson
*Assistant Examiner* — Alvin Grant
(74) *Attorney, Agent, or Firm* — K&L Gates LLP

(57) ABSTRACT

A device for holding a workpiece, the device comprising a base, a first jaw member, a movable jaw member, and features which allow the movable jaw member to be moved in large increments relative to the first jaw member in addition to features which allow the movable jaw member to be moved in smaller increments. The device can include a drive member operably engaged with the base and the movable jaw member such that the operation of the drive member can move the movable jaw member in small increments. The movable jaw member can include a connection member which can operatively engage the movable jaw member with the drive member. The connection member can be moved between first and second positions to disengage the movable jaw member from the drive member such that the movable jaw member can be slid relative to the first jaw member in large increments.

19 Claims, 43 Drawing Sheets

(56) References Cited

U.S. PATENT DOCUMENTS 2,339,986 A 1/1944 Engert
2,369,425 A 2/1945 Becker
2,406,043 A 8/1946 Sorensen
2,487,742 A 11/1949 Sutter
2,499,124 A 2/1950 Zipp et al.
2,535,450 A 12/1950 O'Malley et al.
2,560,413 A 7/1951 Carlson
2,564,138 A 8/1951 Walker
2,570,857 A 10/1951 Purpura
2,630,702 A 3/1953 Pizzani
2,661,783 A 12/1953 Caston
2,699,708 A 1/1955 Fotsch
2,707,419 A 5/1955 Schron
2,711,904 A 5/1955 Gartner et al.
2,764,047 A 9/1956 Allbritton
2,770,990 A 11/1956 Rix
2,845,038 A 7/1958 Crawford
2,868,339 A 1/1959 Lazarowicz
2,880,638 A 4/1959 Mugglile et al.
2,885,910 A 5/1959 Waller
2,889,396 A 6/1959 Bode
2,952,169 A 9/1960 Johnson
2,976,844 A 3/1961 Goldring
3,020,998 A 2/1962 Webb
3,162,064 A 12/1964 Musy
3,186,260 A 6/1965 Dugas
3,203,082 A 8/1965 Robbins
3,204,490 A 9/1965 Jones et al.
3,397,880 A 8/1968 Kuban
3,403,901 A 10/1968 Serivadio
3,496,832 A 2/1970 Celinder et al.
3,514,092 A 5/1970 Lassy
3,565,417 A 2/1971 Degle
3,612,384 A 10/1971 Lloyd et al.
3,814,448 A 6/1974 Buck
3,835,649 A 9/1974 Le Testu
3,841,619 A * 10/1974 Hickman ..... 269/244
3,861,664 A 1/1975 Durkee
3,967,816 A 7/1976 Ramsperger et al.
3,968,415 A 7/1976 Hafla et al.
4,017,267 A 4/1977 Hawley
4,019,726 A 4/1977 Turner
4,043,547 A 8/1977 Glomb et al.
4,068,834 A 1/1978 Mortoly
4,089,613 A 5/1978 Babbitt, Jr.
4,098,500 A 7/1978 Lenz
4,121,817 A 10/1978 Pavlovsky
4,125,251 A 11/1978 Jamieson, Jr.
4,165,869 A 8/1979 Williams
4,184,691 A 1/1980 Esser et al.
4,205,833 A 6/1980 Lenz
4,221,369 A 9/1980 Takasugi
4,240,621 A 12/1980 Daddato
4,252,304 A 2/1981 Pettican
4,295,641 A 10/1981 Boucher
4,319,516 A 3/1982 Rohm
4,324,161 A 4/1982 Klancnik et al.
4,353,271 A 10/1982 Pieczulewski
4,413,818 A 11/1983 Lenz
4,496,165 A 1/1985 Schrekeis et al.
4,504,046 A 3/1985 Yonezawa et al.
4,524,655 A 6/1985 Waldron et al.
4,529,183 A 7/1985 Krason
4,545,470 A 10/1985 Grimm
4,569,509 A 2/1986 Good
4,571,131 A 2/1986 Date
4,585,217 A 4/1986 Erickson
4,619,446 A 10/1986 Yang
4,643,411 A 2/1987 Izumi
4,644,825 A 2/1987 Yamazaki
4,664,394 A 5/1987 Theissig et al.
4,669,161 A 6/1987 Sekelsky, Jr.
4,684,115 A 8/1987 Krause
4,685,663 A 8/1987 Jorgensen
4,711,437 A 12/1987 Longenecker et al.
4,738,438 A 4/1988 Horie et al.
4,773,636 A 9/1988 Takahashi
4,779,857 A 10/1988 Mound
4,799,657 A 1/1989 Miller
4,807,863 A 2/1989 Yang
4,813,310 A 3/1989 Moynihan
4,834,358 A 5/1989 Okolischan et al.
4,850,099 A 7/1989 Scollard
4,881,727 A 11/1989 Nemirovsky
4,884,474 A 12/1989 Kawata
4,898,371 A 2/1990 Mills et al.
4,921,378 A 5/1990 Kytola
4,928,937 A 5/1990 Bernstein
4,934,674 A 6/1990 Bernstein
4,936,559 A 6/1990 Diaz Torga
4,946,178 A 8/1990 Korson et al.
4,966,350 A 10/1990 Chick
4,968,012 A 11/1990 Haddad et al.
4,971,301 A 11/1990 Yang
4,974,308 A 12/1990 Nimberger
4,986,704 A 1/1991 Narushima et al.
4,991,463 A 2/1991 Kawata
5,005,890 A 4/1991 Schwenger
5,013,017 A 5/1991 Swann
5,015,003 A 5/1991 Ramunas
5,022,636 A 6/1991 Swann
5,024,427 A 6/1991 Swann
5,033,724 A 7/1991 James
5,064,321 A 11/1991 Barnes
5,090,529 A 2/1992 Fahy et al.
5,094,436 A 3/1992 Stephan, III
5,098,073 A 3/1992 Lenz
5,114,126 A 5/1992 Yasue
5,129,637 A 7/1992 Ito et al.
5,136,896 A 8/1992 Burka
5,159,580 A 10/1992 Andersen et al.
5,160,124 A 11/1992 Yamada et al.
5,160,335 A 11/1992 Wagenknecht
5,161,788 A 11/1992 Guzzoni
5,163,662 A 11/1992 Bernstein
5,193,792 A 3/1993 DiMarco
5,242,159 A 9/1993 Bernstein
5,251,887 A 10/1993 Arnold
5,306,136 A 4/1994 Oomori et al.
5,314,283 A 5/1994 Zoltner
5,322,305 A 6/1994 Cross et al.
5,339,504 A 8/1994 Thumm et al.
5,351,943 A 10/1994 Milz
5,374,040 A 12/1994 Lin
5,374,145 A 12/1994 Mairesse et al.
5,441,284 A 8/1995 Mueller et al.
5,442,844 A 8/1995 Swann
5,458,321 A 10/1995 Durfee, Jr.
5,501,123 A 3/1996 Swann et al.
5,526,715 A 6/1996 Swann et al.
5,531,428 A 7/1996 Dembicks et al.
5,535,995 A 7/1996 Swann et al.
5,549,427 A 8/1996 Hiestand
5,562,277 A 10/1996 Swann et al.
5,623,754 A 4/1997 Swann et al.
5,623,757 A 4/1997 Durfee, Jr.
5,629,816 A 5/1997 Busengdal et al.
5,634,253 A 6/1997 Swann et al.
5,649,694 A 7/1997 Buck
5,713,118 A 2/1998 Swann et al.
5,720,476 A 2/1998 Swann et al.
5,735,514 A 4/1998 Moore et al.
5,746,423 A 5/1998 Arov
5,762,326 A 6/1998 Swann
5,806,841 A 9/1998 Hebener
5,873,499 A 2/1999 Leschinsky et al.
5,921,534 A 7/1999 Swann et al.
6,000,304 A 12/1999 Hegemier
6,012,712 A 1/2000 Bernstein
6,032,940 A 3/2000 Wolfe
6,152,435 A 11/2000 Snell
6,164,635 A * 12/2000 Chase et al. ..... 269/244
6,170,814 B1 1/2001 Swann et al.
6,206,354 B1 3/2001 Lin

(56) References Cited

U.S. PATENT DOCUMENTS

| | | | | |
|---|---|---|---|---|
| 6,240,807 | B1 | 6/2001 | Hebener | |
| 6,244,580 | B1 | 6/2001 | Durfee, Jr. | |
| 6,250,620 | B1 | 6/2001 | Durfee | |
| 6,361,034 | B1 | 3/2002 | Wolfe | |
| 6,585,247 | B2 * | 7/2003 | Mattox et al. | 269/244 |
| 6,598,867 | B2 | 7/2003 | Martinez | |
| 6,619,644 | B1 * | 9/2003 | Liou | 269/185 |
| 6,669,254 | B2 | 12/2003 | Thom et al. | |
| 6,761,349 | B2 | 7/2004 | McCraw | |
| 6,773,003 | B2 | 8/2004 | Dermody, Jr. | |
| 6,929,253 | B2 | 8/2005 | Marks | |
| 6,976,670 | B1 | 12/2005 | Woolley et al. | |
| 7,258,333 | B2 | 8/2007 | Hobday | |
| 7,290,761 | B2 | 11/2007 | Siegel | |
| 7,293,765 | B2 | 11/2007 | Hooper | |
| 7,618,028 | B2 | 11/2009 | Huisken et al. | |
| 7,981,539 | B2 | 7/2011 | Avalani | |
| 8,066,270 | B2 | 11/2011 | Siegel | |
| 8,109,494 | B1 | 2/2012 | Warth | |
| 2003/0005798 | A1 | 1/2003 | Kuchar | |
| 2003/0177627 | A1 | 9/2003 | Richardson | |
| 2005/0280196 | A1 | 12/2005 | Avalani et al. | |
| 2006/0055098 | A1 | 3/2006 | Siegel | |
| 2006/0091596 | A1 | 5/2006 | Marusiak | |
| 2008/0197607 | A1 | 8/2008 | Merino | |
| 2009/0088774 | A1 | 4/2009 | Swarup et al. | |
| 2010/0299890 | A1 | 12/2010 | Doyle | |
| 2011/0101587 | A1 | 5/2011 | Quintania et al. | |

FOREIGN PATENT DOCUMENTS

| | | | |
|---|---|---|---|
| DE | 1918387 | | 4/1969 |
| DE | 1652956 | | 6/1969 |
| DE | 1750374 | | 1/1971 |
| DE | 2 407 554 | | 9/1974 |
| DE | 27 53 507 | | 6/1979 |
| DE | 39 29512 | A1 | 3/1991 |
| DE | 4339439 | | 3/1995 |
| EP | 233537 | A2 | 8/1987 |
| EP | 0 343 329 | A | 11/1989 |
| EP | 0 440 585 | | 8/1991 |
| EP | 0 450 538 | A2 | 9/1991 |
| EP | 0526432 | A1 | 7/1992 |
| FR | 2 307 602 | | 3/1976 |
| FR | 2 578 180 | | 9/1986 |
| GB | 562447 | | 3/1944 |
| GB | 1266942 | | 3/1972 |
| GB | 2073063 | A | 10/1981 |
| GB | 2075874 | A | 11/1981 |
| GB | 2 103 522 | | 7/1982 |
| GB | 2123722 | | 2/1984 |
| GB | 2177647 | A | 1/1987 |
| JP | 61-24446 | | 10/1986 |
| SU | 1397-250 | | 5/1988 |
| WO | WO 89/08518 | | 9/1989 |
| WO | WO 89/11950 | | 12/1989 |
| WO | WO 97/08594 | | 3/1997 |
| WO | WO 97/47429 | | 12/1997 |

* cited by examiner

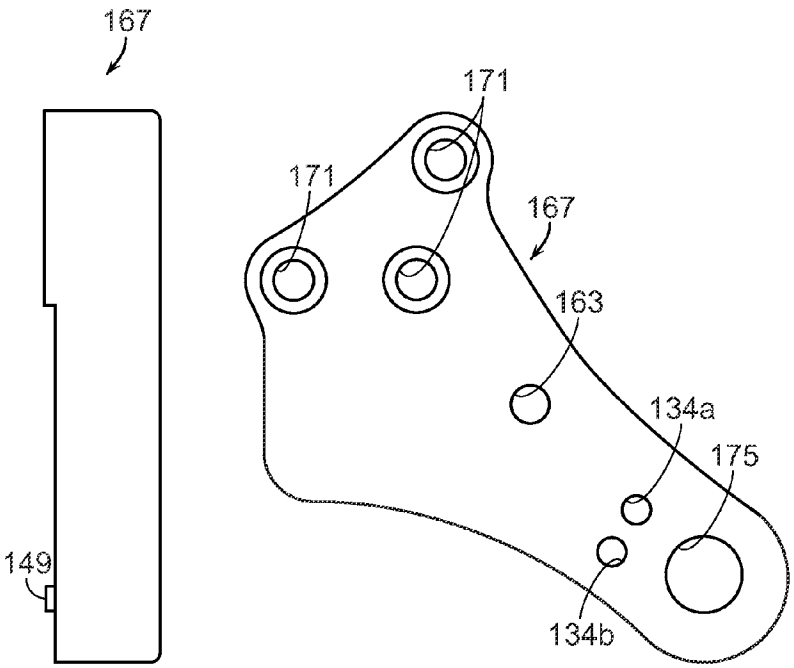
FIG. 43
FIG. 42
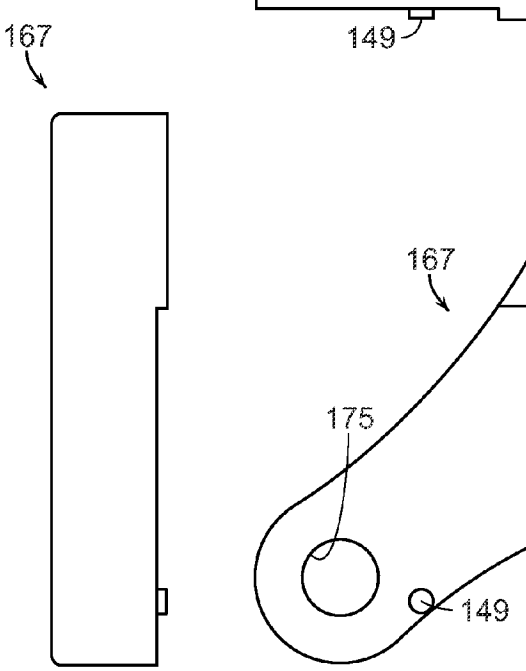
FIG. 44
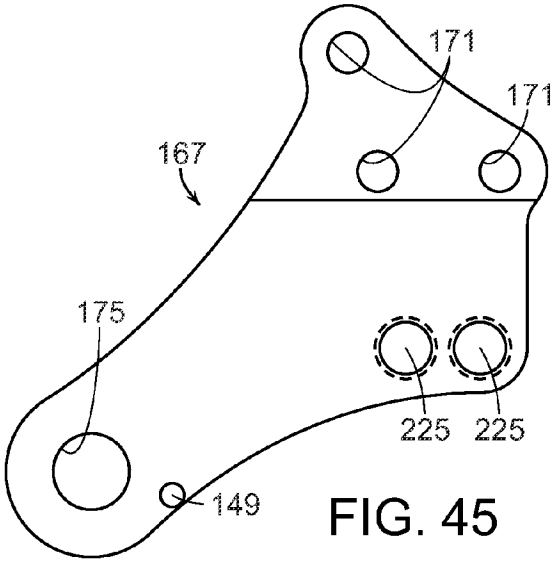
FIG. 45
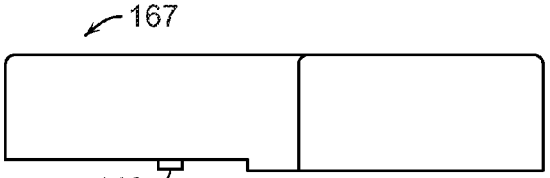
FIG. 46
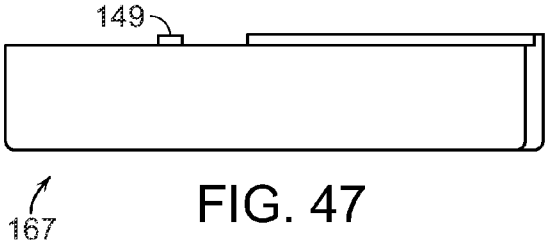
FIG. 47

WORKHOLDING APPARATUS

CROSS-REFERENCE TO RELATED APPLICATIONS

This application is a continuation-in-part application under 35 U.S.C. §120 of U.S. patent application Ser. No. 12/199,026, entitled WORKHOLDING APPARATUS HAVING A MOVABLE JAW MEMBER, filed on Aug. 27, 2008, which is a continuation-in-part application under 35 U.S.C. §120 of U.S. patent application Ser. No. 11/897,157, entitled WORKHOLDING APPARATUS HAVING A MOVABLE JAW MEMBER, filed on Aug. 29, 2007, which claims the benefit under 35 U.S.C. §119(e) of U.S. Provisional Patent Application Ser. No. 60/841,824, entitled WORKHOLDING APPARATUS, filed on Sep. 1, 2006, the entire disclosures of which are hereby incorporated by reference herein.

BACKGROUND

1. Field of the Invention

The present invention generally relates to devices for holding workpieces and, more particularly, to devices used in connection with high precision machining (CNC, etc.) operations.

2. Description of the Related Art

High precision machining operations often utilize workholding devices, such as vises, for example, for holding a workpiece in position while the workpiece is cut, milled, and/or polished. As is well known in the art, financially successful machining operations utilize vises which are quickly and easily adaptable to hold a workpiece in different positions and orientations during the machining operation. These vises typically include a rigid base, a fixed jaw member mounted to the base, and a movable jaw member. In use, the workpiece is often positioned between the fixed jaw member and the movable jaw member, wherein the movable jaw member is then positioned against the workpiece. In various embodiments, the movable jaw member can be moved via the interaction of a threaded rod with the base and the movable jaw. Often, the threaded rod must be rotated a significant amount of times before the movable jaw member is positioned against the workpiece. What is needed is an improvement over the foregoing.

SUMMARY

The present invention includes a device for holding a workpiece, the device comprising, in one form, a base, a first jaw member, a movable jaw member, and features which allow the movable jaw member to be moved in large increments relative to the first jaw member in addition to features which allow the movable jaw member to be moved in smaller increments. In various embodiments, the device can include a drive member operably engaged with the base and the movable jaw member such that the operation of the drive member can move the movable jaw member in small increments. In at least one embodiment, the movable jaw member can include at least one connection member, or claw, which can operatively engage the movable jaw member with the drive member. In such embodiments, the connection member can be moved between first and second positions to disengage the movable jaw member from the drive member such that the movable jaw member can be slid relative to the drive member, and the first jaw member, in large increments. In various embodiments, the connection member, or claw, can be rotated or pivoted between its first and second positions. As a result of the above, the movable jaw member can be accurately and precisely positioned relative to the workpiece and/or the first jaw member.

BRIEF DESCRIPTION OF THE DRAWINGS

The above-mentioned and other features of this invention, and the manner of attaining them, will become more apparent and the invention itself will be better understood by reference to the following description of an embodiment of the invention taken in conjunction with the accompanying drawings, wherein:

FIG. 42 is a front elevational view of a side plate of the connection member of FIG. 34;

FIG. 43 is a left side view of the side plate of FIG. 42;

FIG. 44 is a right side view of the side plate of FIG. 42;

FIG. 45 is a rear elevational view of the side plate of FIG. 42;

FIG. 46 is a top view of the side plate of FIG. 42;

FIG. 47 is a bottom view of the side plate of FIG. 42;

Corresponding reference characters indicate corresponding parts throughout the several views. The exemplifications set out herein illustrate preferred embodiments of the invention, in one form, and such exemplifications are not to be construed as limiting the scope of the invention in any manner.

DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 1:
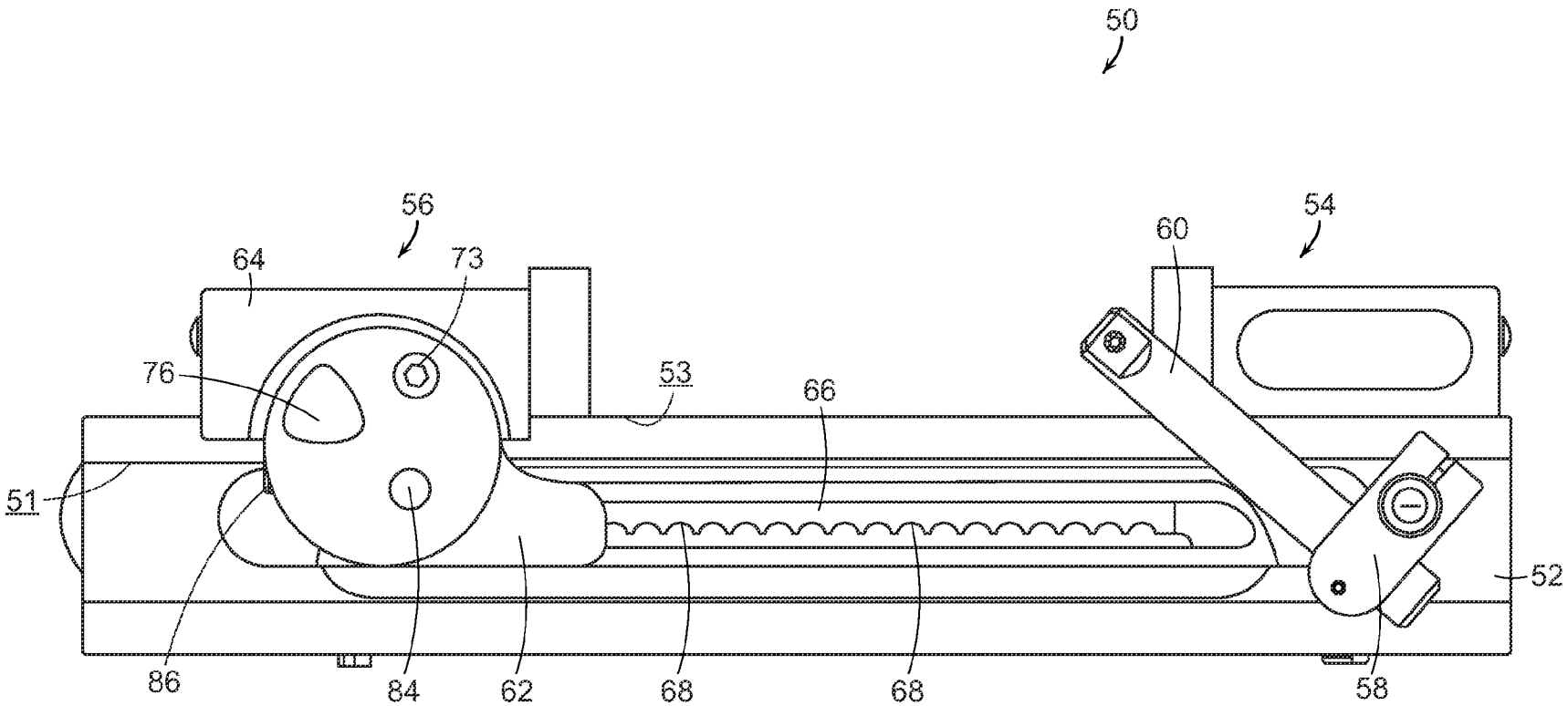
FIG. 1 is an elevational view of an exemplary workholding device in accordance with an embodiment of the present invention.

In various embodiments, referring to FIG. 1, workholding device 50 can include base 52, first jaw member 54, and second jaw member 56. In use, a workpiece can be positioned on surface 53 of base 52 intermediate first jaw member 54 and second jaw member 56 wherein at least one of jaw members 54 and 56 can be positioned or moved against the workpiece to apply a clamping force thereto. In the illustrated embodiment, first jaw member 54 can be fixedly mounted to base 52 and, as described in greater detail below, second jaw member 56 can be movable relative to base 52. In various alternative embodiments, although not illustrated, a workholding device can include two or move movable jaw members. A workholding device having two movable jaw members and a fixed jaw member is described and illustrated in U.S. Pat. No. 5,022,636, entitled WORKHOLDING APPARATUS, which issued on Jun. 11, 1991, the content of which is hereby incorporated by reference herein. In either event, in at least one embodiment, device 50 can further include work stop 58 which can be configured to control at least the transverse position of the workpiece within device 50. More particularly, in at least one embodiment, work stop 58 can include a post which is adjustably threaded into base 52 and, in addition, a friction clamp configured to allow extension rod 60 to be rotated into any suitable orientation or extended into any suitable position. In various embodiments, work stop 58 can further include a threaded rod or set screw extending from extension rod 60 which can be adjusted to abut the workpiece and hold the workpiece in position.

As outlined above, second jaw member 56 can be moved relative to base 52. In various embodiments, workholding device 50 can include features which can allow second jaw member 56 to be moved in large increments relative to base 52 and first jaw member 54 and, in addition, features which can allow jaw member 56 to be moved in small increments. In at least one embodiment, referring to FIGS. 5 and 6, second jaw member 56 can include body portion 64 and at least one connection member, or claw, 62 movably mounted to body portion 64. In such embodiments, a connection member 62 can be selectively engaged with base 52, for example, to retain jaw member 56 to base 52. More particularly, connection member 62 can be positioned in a first position in which connection member 62 is engaged with base 52 and, as a result, second jaw member 56 can be fixed, or substantially fixed, relative to base 52. In at least one embodiment, connection member 62 can be selectively moved into a second position in which it is not engaged with base 52 wherein, as a result, second jaw member 56 can be moved relative to base 52. Stated another way, once connection member 62 is moved into a position in which it is not engaged with racks 66, as described below, second jaw member 56 can be slid relative to base 52 along displacement axis 55 (FIG. 3), for example, in large increments and placed against a workpiece positioned intermediate jaw members 54 and 56 as outlined above. In various alternative embodiments, although not illustrated, second jaw member 56 can be moved along a curved and/or curvilinear path.

Figure 7:
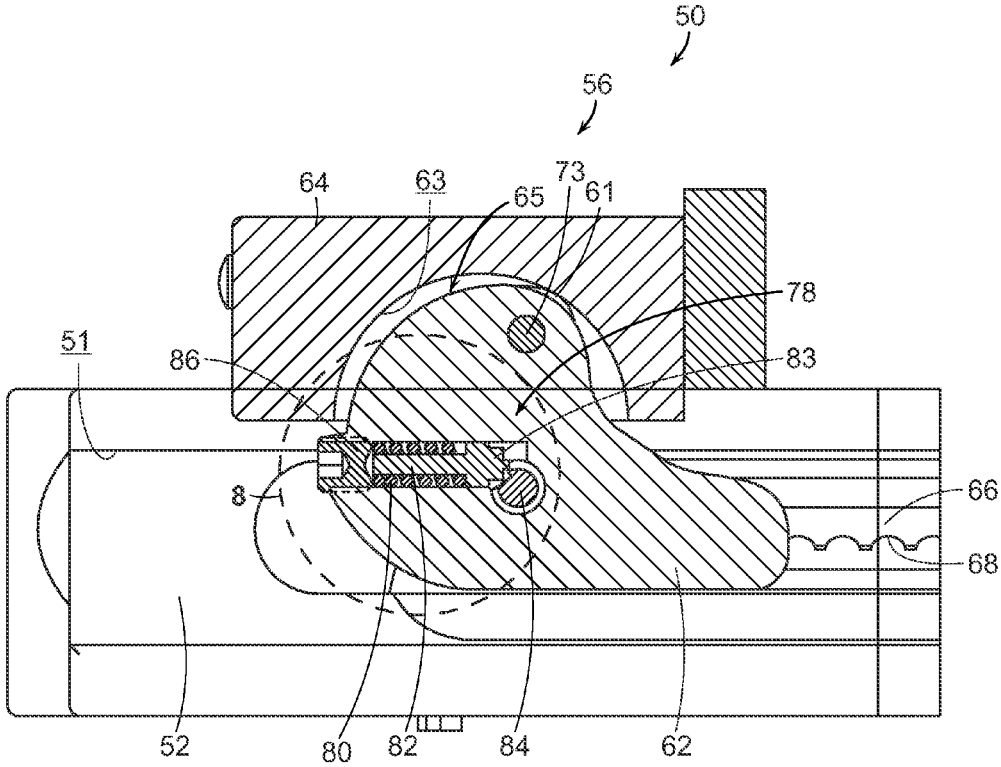
FIG. 7 is a cross-sectional view of the workholding device of FIG. 1 taken along line 7-7 in FIG. 3.
Figure 8:
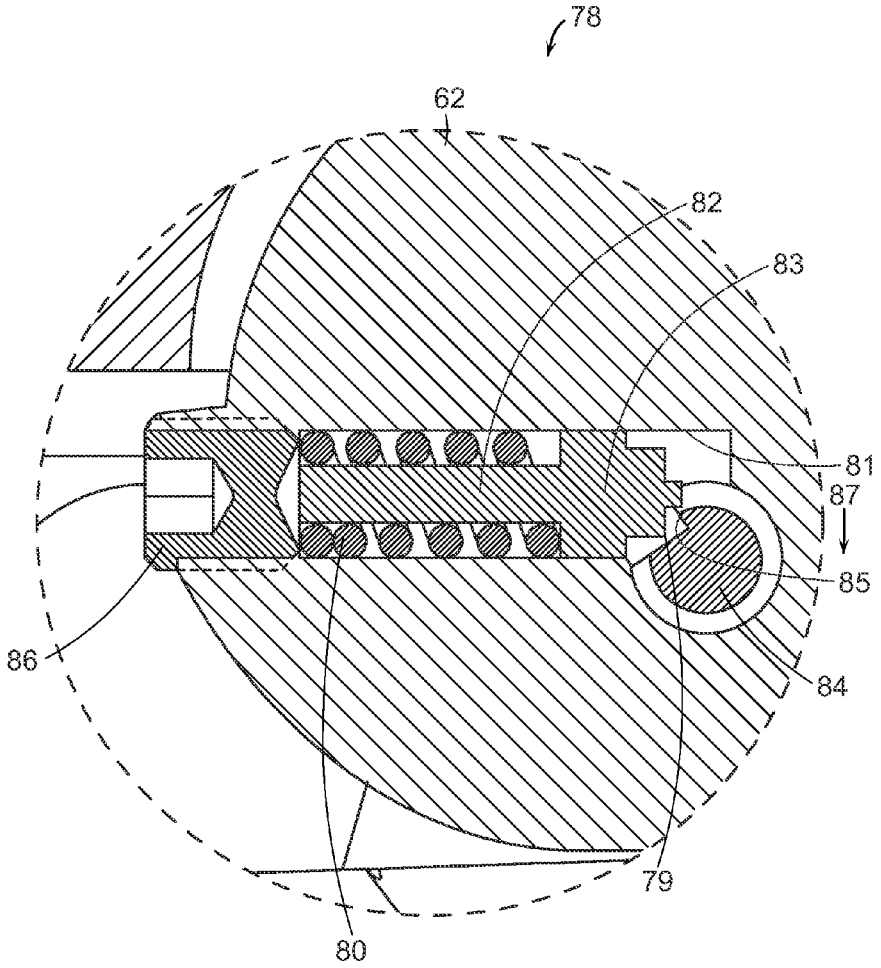
FIG. 8 is a detail view of a portion of the movable jaw member of FIG. 7 illustrating a spring assembly configured to bias the connection member into an engaged position.
Figure 9:
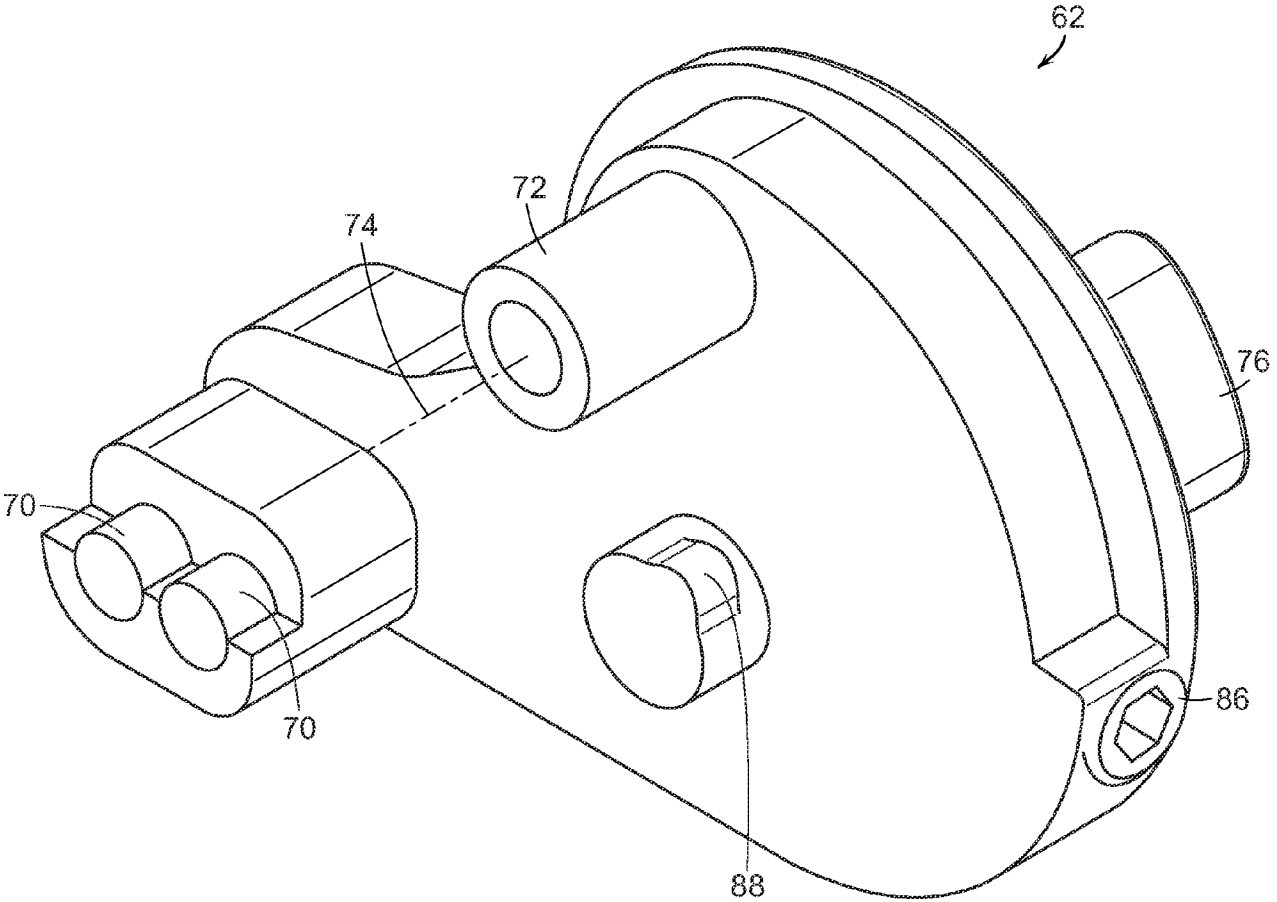
FIG. 9 is a perspective view of the connection member of FIG. 5.

In various embodiments, base 52 can include at least one rack 66, wherein each rack 66 can include notches, or recesses, 68. Recesses 68 can be configured to receive at least a portion of connection members 62 and secure second jaw member 56 relative to base 52 as outlined above. In at least one embodiment, referring to FIGS. 5, 6 and 9, each connection member 62 can include at least one projection 70 extending therefrom which can be configured to be received within recesses 68. In various embodiments, referring to FIG. 7, each recess, or notch, 68 can include an arcuate or circular profile which can be configured to receive a projection 70 having a corresponding arcuate or circular profile, for example. In at least one embodiment, although not illustrated, recesses 68 can include a linear groove, or a groove having any other suitable profile, which can be configured to receive a projection having a corresponding or other suitable profile, similar to the above. In various embodiments, such recesses can be oriented in a vertical direction, for example, or any other suitable direction. In at least one embodiment, the recesses can be oriented at an approximately 20 degree angle from the vertical direction.

Figure 10:
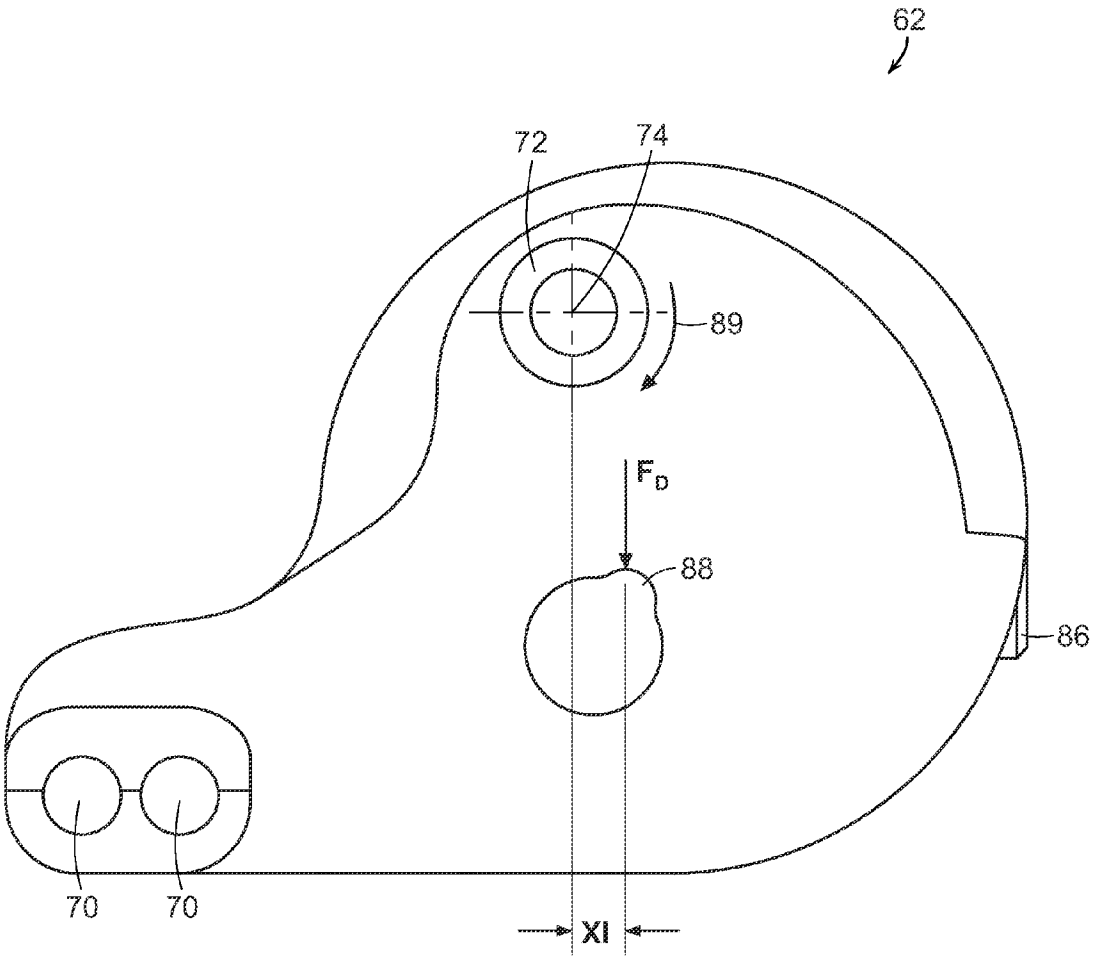
FIG. 10 is an elevational view of the connection member of FIG. 5.

In order to remove projections 70 from recesses 68, and thereby disengage second jaw member 56 from base 52, connection members 62 can be moved such that projections 70 are displaced away from recesses 68. In at least one embodiment, connection members 62 can be rotatably mounted to body portion 64. More particularly, referring to FIGS. 7, 9 and 10, each connection member 62 can include a pivot 72 which can be pivotably mounted to body portion 64 by a pivot pin 73, for example, wherein the cooperation of pivot 72 and pin 73 can define pivot axis 74 about which connection member 62 can be rotated. In various embodiments, axis 74 and axis 55 can extend in any suitable direction relative to each other. In the illustrated embodiment, axis 74 can be perpendicular, or at least substantially perpendicular, to axis 55 such that connection members 62 can be pivoted upwardly and/or downwardly relative to base 52 as described in greater detail below. In other various embodiments, although not illustrated, axes 74 and 55 can be transverse, skew, or parallel to each other. In such embodiments, connection members 62 can be pivoted outwardly away from racks 66, for example. In at least one embodiment, at least one of axes 74 can be oriented at an approximately 20 degree angle with respect to the horizontal plane. In such embodiments, a connection member 62 can be configured to rotate in a plane which is neither parallel nor perpendicular to the horizontal or vertical planes.

Figure 2:
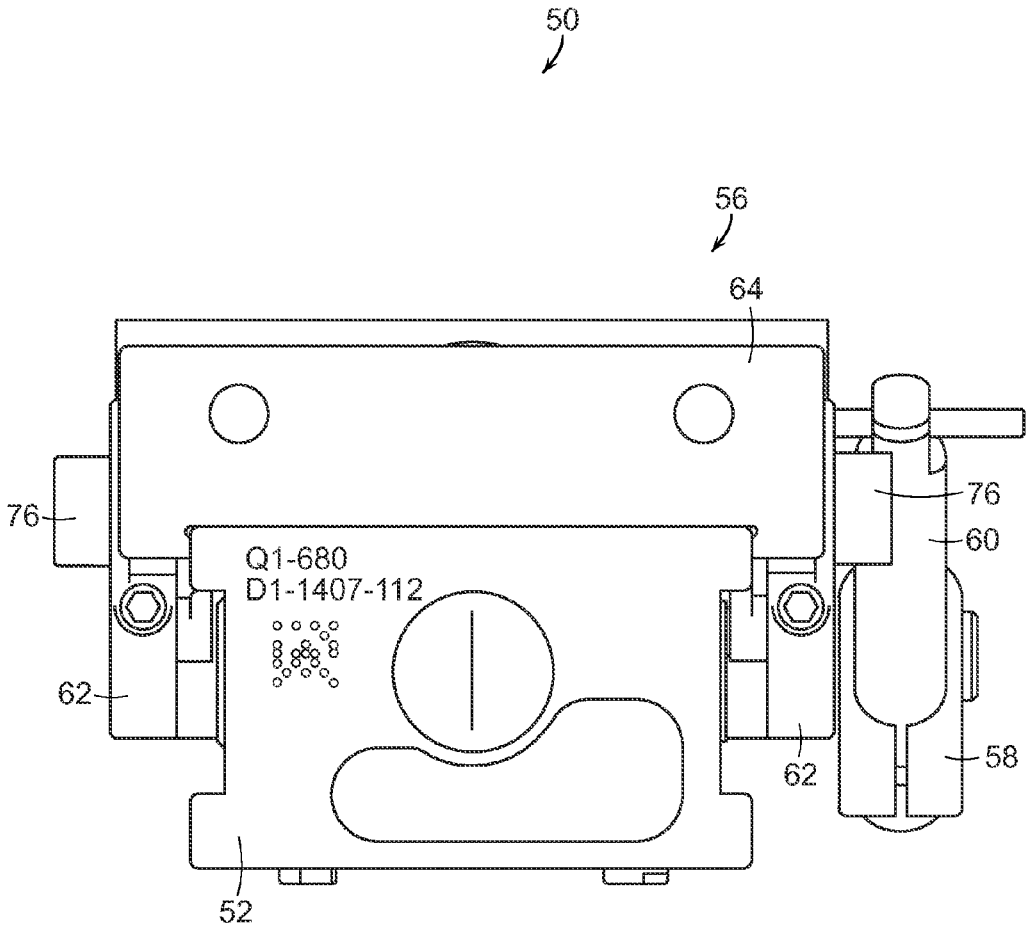
FIG. 2 is an end view of the workholding device of FIG. 1.
Figure 3:
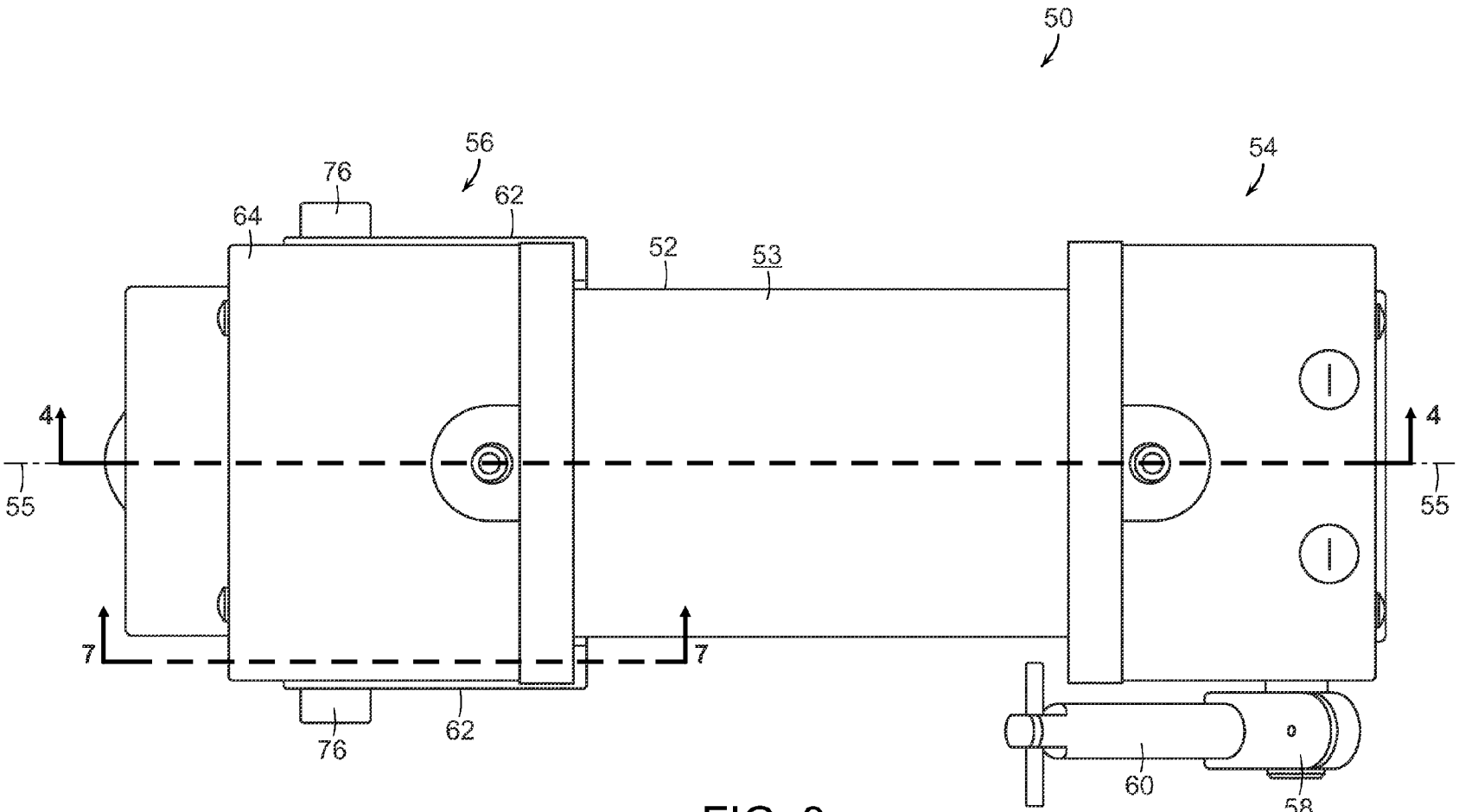
FIG. 3 is a top view of the workholding device of FIG. 1.
Figures 5, 6:
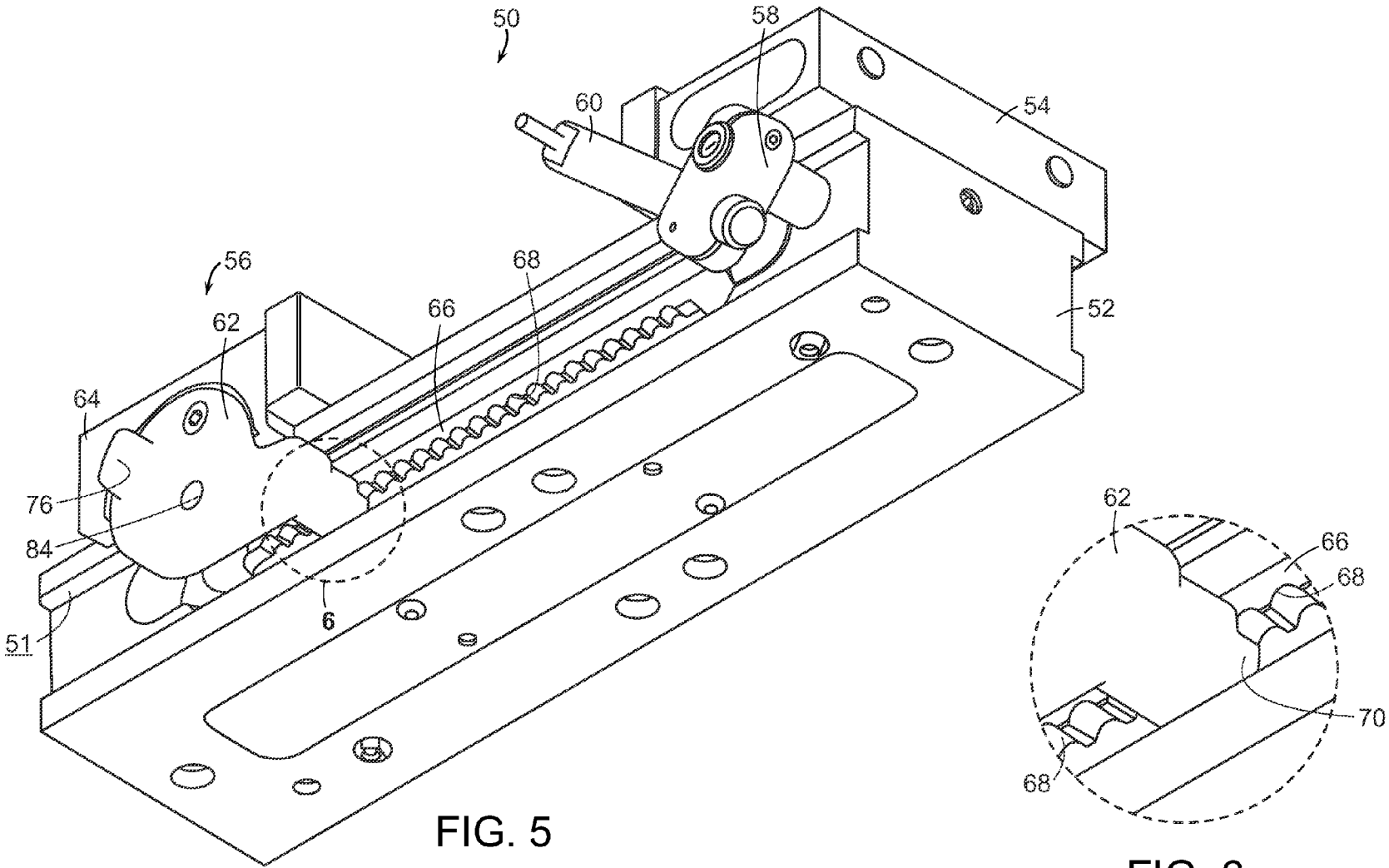
FIG. 5 is a perspective view of the workholding device of FIG. 1 illustrating a movable jaw member including a connection member engaged with an adjustment rack assembly.
FIG. 6 is a detail view of the movable jaw member of the workholding device of FIG. 1 illustrating a portion of the connection member engaged with the rack assembly.

In various embodiments, referring to FIGS. 2, 3, and 5, connection members 62 can further include projections, or handles, 76 extending therefrom. In at least one embodiment, handles 76 can be configured such that they can be grasped by an operator to rotate connection members 62 between a first position in which connection members 62 are engaged with racks 66 and a second position in which connection members 62 are disengaged from racks 66. In various embodiments, workholding device 50 can further include a biasing member such as a spring, for example, which can bias a connection member 62 into engagement with a rack 66. In at least one such embodiment, referring to FIGS. 7-10, connection member 62 can include spring assembly 78 comprising spring 80, drive pin 82, and cam pin 84. In various embodiments, spring 80 can be positioned within cavity 81 intermediate fastener 86 and head 83 of drive pin 82 wherein fastener 86 can be threaded into, or otherwise suitably retained in, cavity 81. In various embodiments, spring 80 can be configured to bias drive pin 82 against cam pin 84 and apply a biasing force to cam pin 84. As described in greater detail below, this biasing force can rotate connection member 62 about axis 74, for example, such that projections 70 are biased into engagement with recesses 68.

Figure 11:
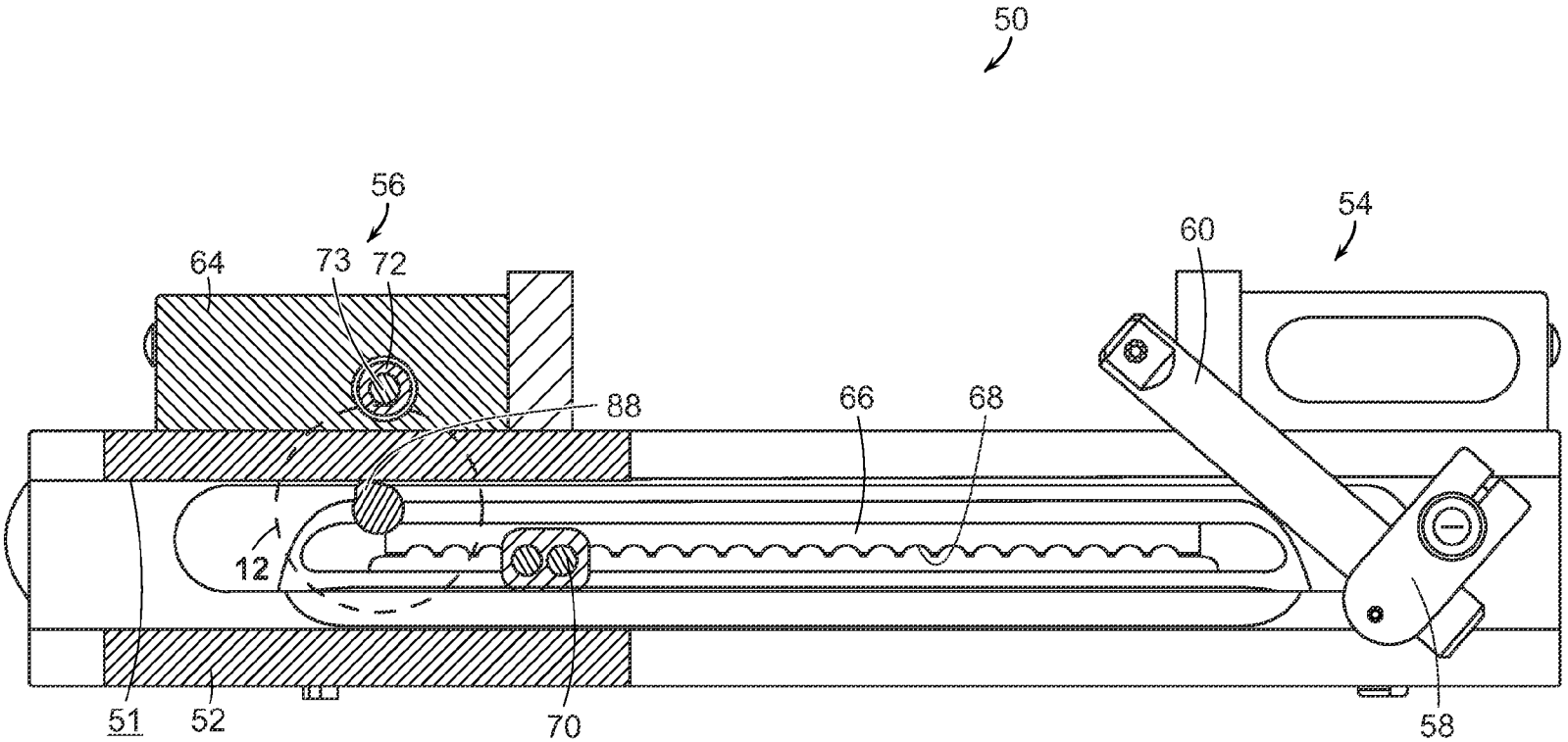
FIG. 11 is a cross-sectional view of the workholding device of FIG. 1 taken along a line to illustrate a cam extending from the spring assembly of FIG. 8 configured to cooperate with a base of the workholding device and bias the connection member into the engaged position.
Figure 12:
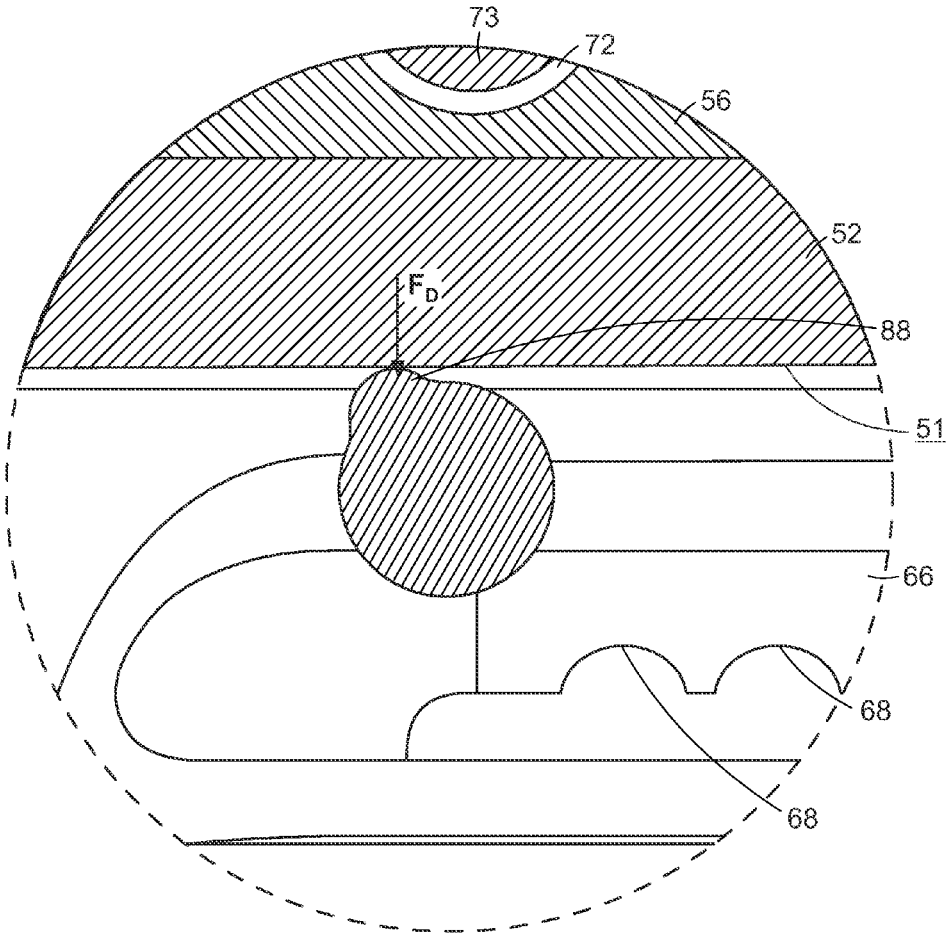
FIG. 12 is a detail view of the cam of FIG. 11.
Figure 13:
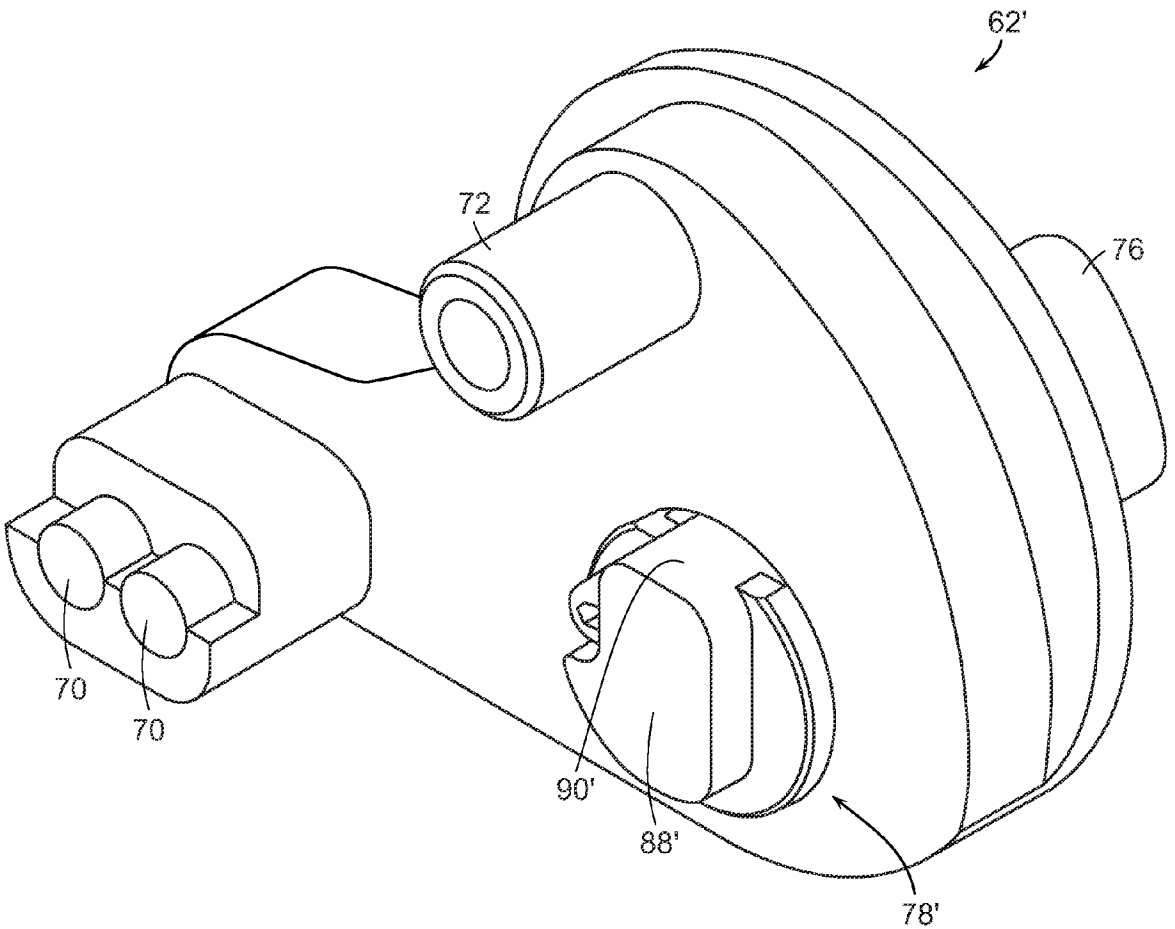
FIG. 13 is a perspective view of a connection member of a movable jaw member in accordance with an alternative embodiment of the present invention.
Figure 14:
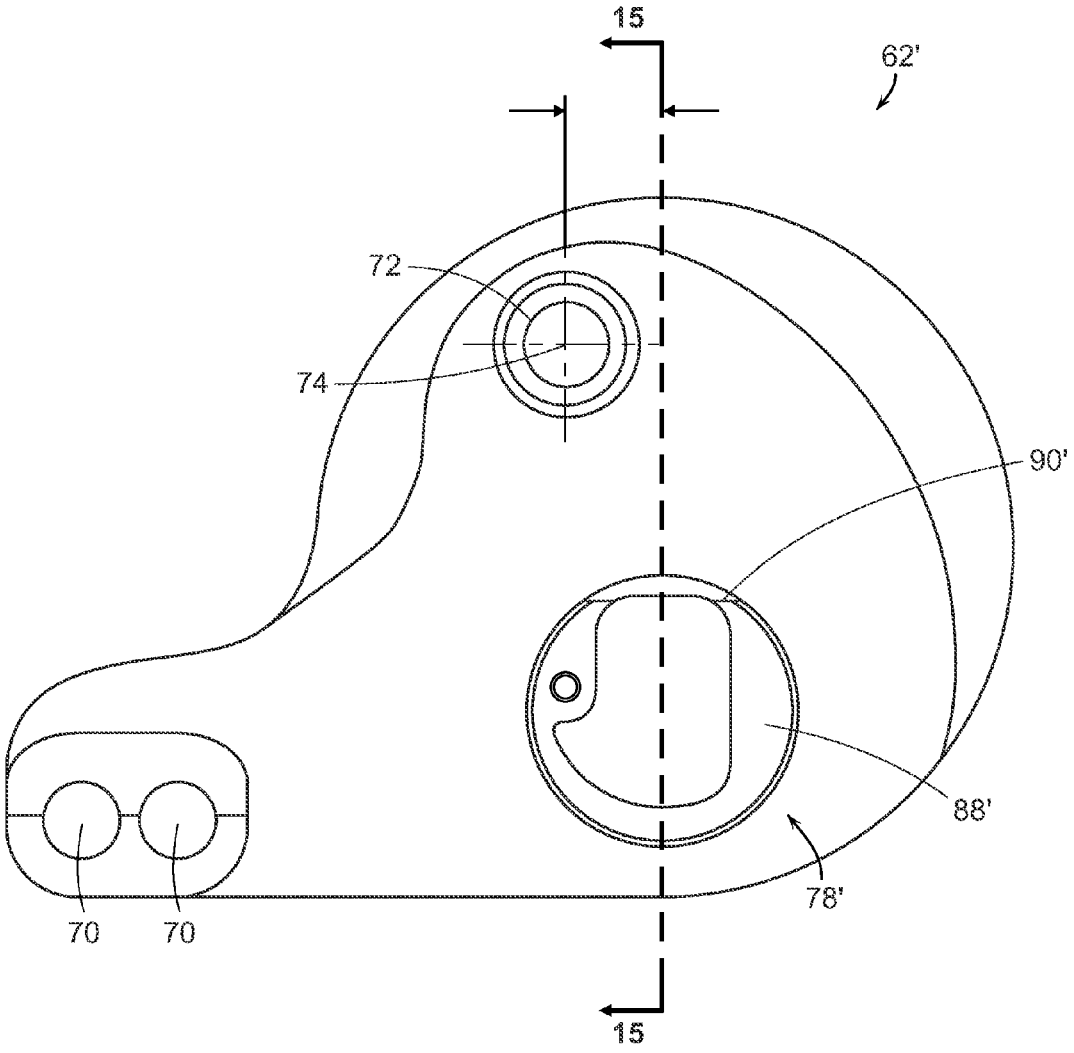
FIG. 14 is an elevational view of the connection member of FIG. 13.
Figure 15:
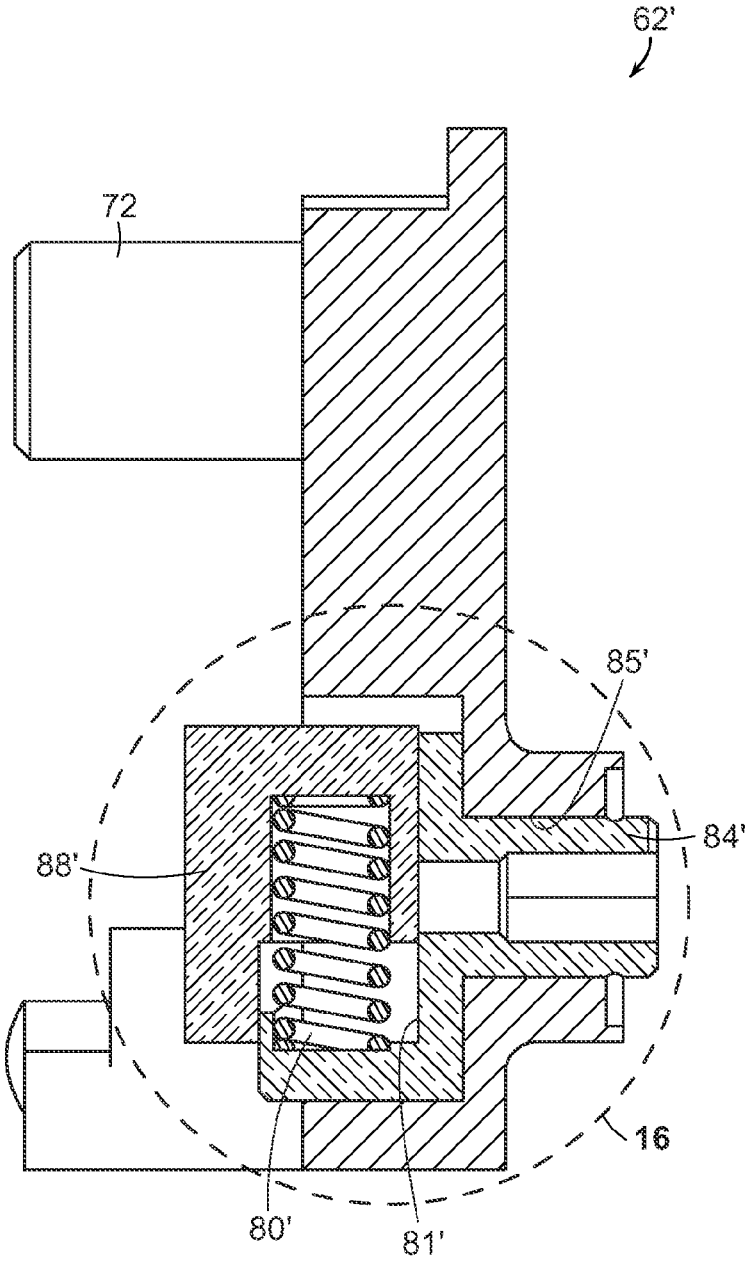
FIG. 15 is a cross-sectional view of the connection member of FIG. 13 taken along line 15-15 in FIG. 14.
Figure 16:
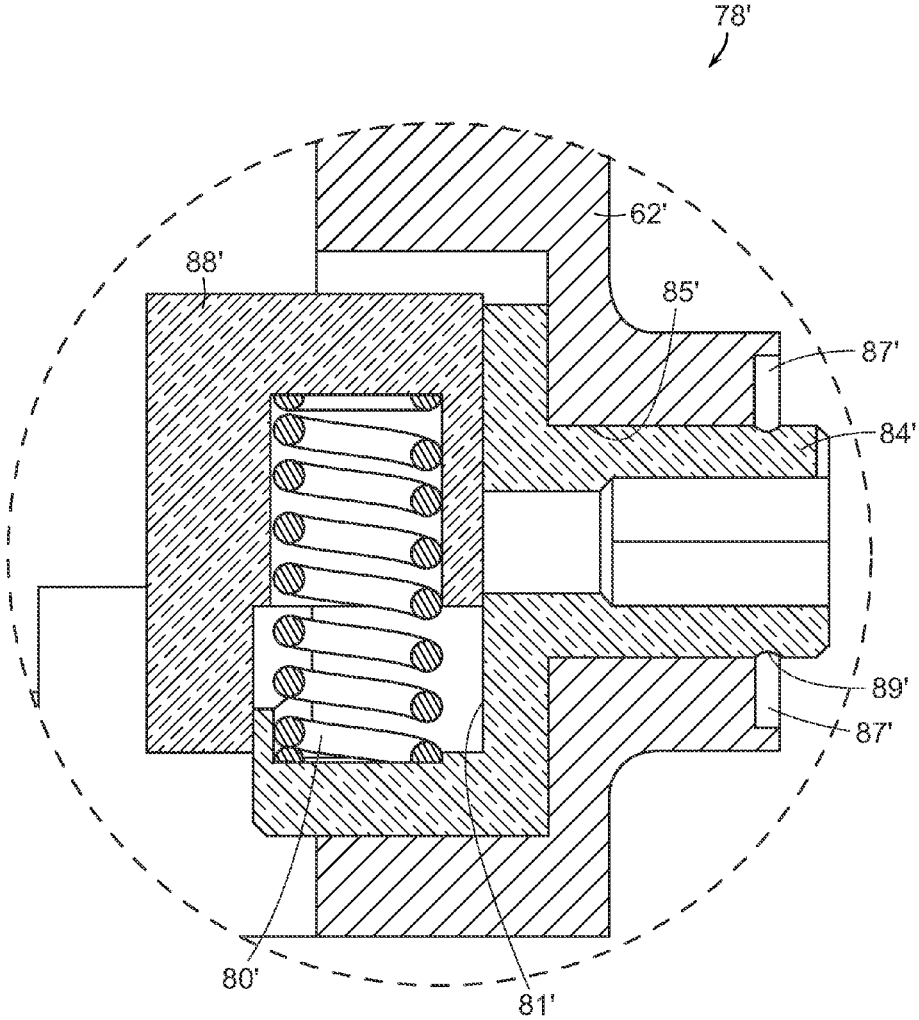
FIG. 16 is a detail view of a spring assembly of the connection member of FIG. 15 configured to bias the connection member into an engaged position.
Figure 17:
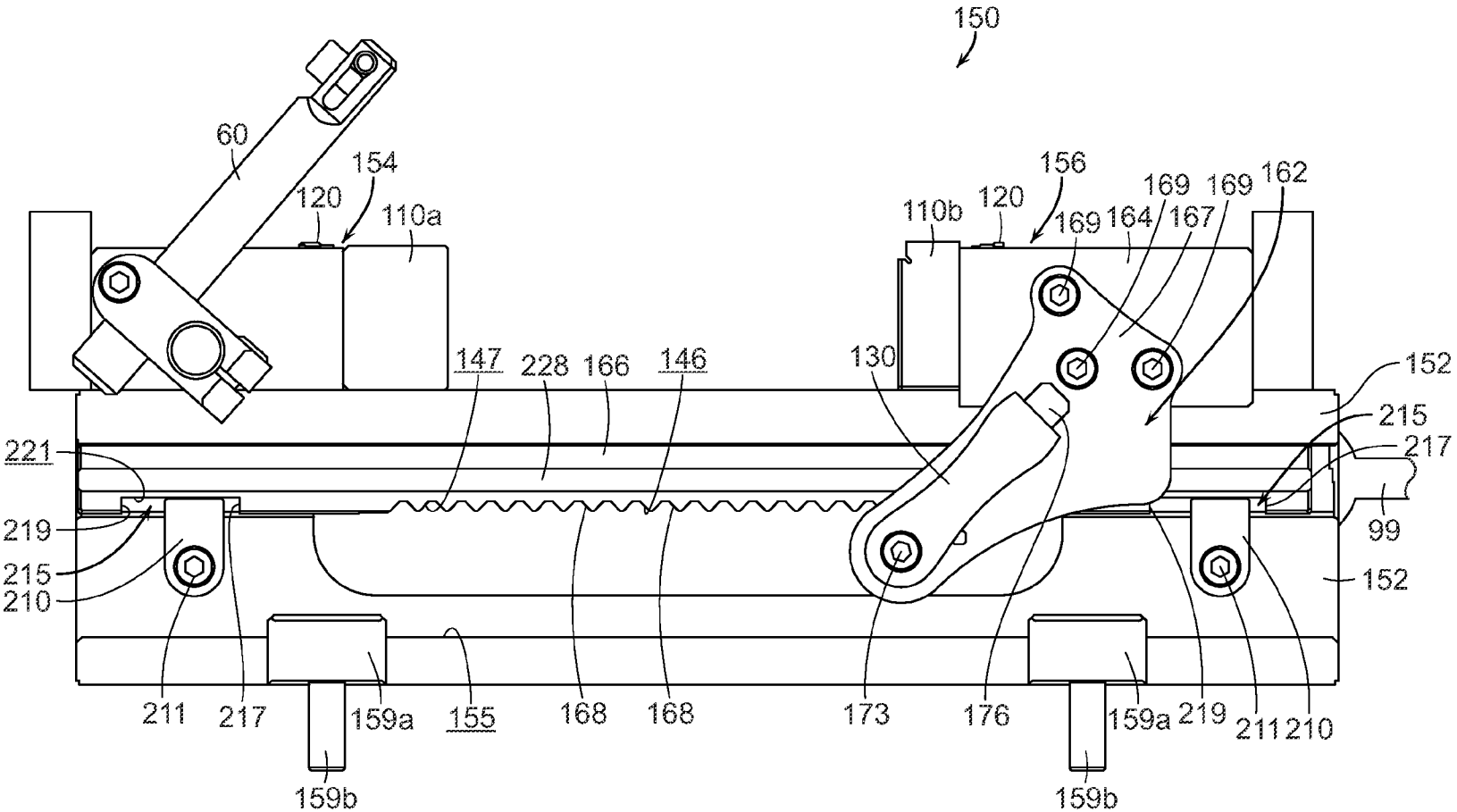
FIG. 17 is a front elevational view of an exemplary workholding device in accordance with an embodiment of the present invention.

Further to the above, referring to FIGS. 11 and 12, cam pin 84 can include an eccentric, or lobe, 88 extending therefrom which can be configured to abut surface 51 of base 52. In various embodiments, the biasing force applied to cam pin 84 by spring 80 as described above can bias lobe 88 into engagement with surface 51. More particularly, end 79 (FIG. 8) of drive pin 82 can fit within notch 85 of cam pin 84 such that spring 80 can cause cam pin 84 to rotate, or at least bias cam pin 84 to rotate, in a direction indicated by arrow 87. As a result of the above, lobe 88 can be rotated, or biased to rotate, upwardly such that, owing to contact between lobe 88 and surface 51, a downwardly-acting reaction force, $F_D$ (FIG. 10), can be transferred through cam pin 84 into connection member 62 causing connection member 62 to rotate in a direction indicated by arrow 89 and position projections 70 within recesses 68. Stated another way, referring to FIG. 10, lobe 88 can be offset from axis 74 by a distance "X1" such that the biasing force applied through lobe 88 can apply a moment, or torque, to connection member 62 thereby causing connection member 62 to rotate in a direction indicated by arrow 89 and move projections 70 upwardly into recesses 68. In various embodiments, this moment, or torque, can cause projections 70 to abut recesses 68.

In use, handles 76 can be lifted upwardly, i.e., in a direction opposite arrow 89, to rotate projections 70 downwardly and out of engagement with recesses 68. Such rotation of connection members 62 can move cam pin 84 upwardly toward surface 51 wherein lobe 88, as a result, can rotate downwardly in order to accommodate the upward movement of cam pin 84. Such rotation of lobe 88 can rotate cam pin 84 in a direction opposite of arrow 87 and, owing the interaction of end 79 of drive pin 82 and notch 85 of cam pin 84 as outlined above, cam pin 84 can displace drive pin 82 toward fastener 86 and compress spring 80. In various embodiments, spring 80 can be configured to store potential energy therein when it is compressed. In various alternative embodiments, although not illustrated, spring 80 can be stretched to store potential energy therein. In either event, connection members 62 can thereafter be released and, as a result of the potential energy stored within spring 80, spring 80 can move drive pin 82 toward cam pin 84, rotate cam pin 84 in a direction indicated by arrow 87, and rotate lobe 88 upwardly. Ultimately, as a result, the rotation of lobe 88 can rotate connection member 62 in a direction indicated by arrow 89 and projections 70 can be repositioned within recesses 68.

In various embodiments, cam lobe 88 can be configured to abut surface 51 regardless of the orientation of workholding device 50. More particularly, cam lobe 88 can be configured to remain in contact with surface 51 when axis 55 is positioned in either a horizontal direction or a vertical direction, for example. In either event, referring to FIG. 7, body portion 64 can include recess 65 which can be configured to receive at least a portion of connection member 62 therein and permit connection member 62 to rotate about pin 73 as described above. In at least one embodiment, recess 65 can include guide surface 63 against which a guide member of connection member 62, such as projection 61, for example, can abut, or slide thereagainst. In such embodiments, guide surface 63 can define a path for connection member 62 and/or support connection member 62 when a force is applied thereto. In various embodiments, although not illustrated, a workholding device can include a torsion spring having a first end engaged with body portion 64 and a second end engaged with connection member 62. In at least one such embodiment, when connection member 62 is rotated between first and second positions as described above, the torsion spring can be configured to resist the rotational movement of connection member 62 and store potential energy therein such that the torsion spring can bias connection member 62 back into its first, or engaged, position, for example.

In various alternative embodiments, a workholding device can include the biasing assembly depicted in FIGS. 13-16. In at least one embodiment, biasing assembly 78' can include spring 80', pin 84', and plunger 88'. When an operator lifts upwardly on handle 76 to disengage projections 70 from recesses 68 as outlined above, plunger 88' can be lifted upwardly toward surface 51. In at least one embodiment, plunger 88' can contact surface 51 and compress spring 80' within cavity 81'. Similar to the above, spring 80' can be configured to store potential energy therein which can, after handles 76 have been released by the operator, release the potential energy to move connection member 62' from its second, operably disengaged, position into its first, operably engaged, position. In various embodiments, plunger 88' can include a flat, or at least substantially flat, surface 90' which can be positioned flush against a flat, or at least substantially flat, portion of surface 51, for example. In such embodiments, pin 84' can be rotatably mounted within aperture 85' (FIG. 15) in connection member 62' such that, when connection member 62' is rotated as described above, pin 84' can rotate relative to connection member 62' and surface 90' can remain positioned flush against surface 51. In at least one embodiment, referring to FIG. 16, assembly 78' can further include retaining ring 87' which can be received within recess 89' in pin 84' such that translational movement between pin 84' and connection member 62' can be prevented, or at least inhibited.

Figure 4:
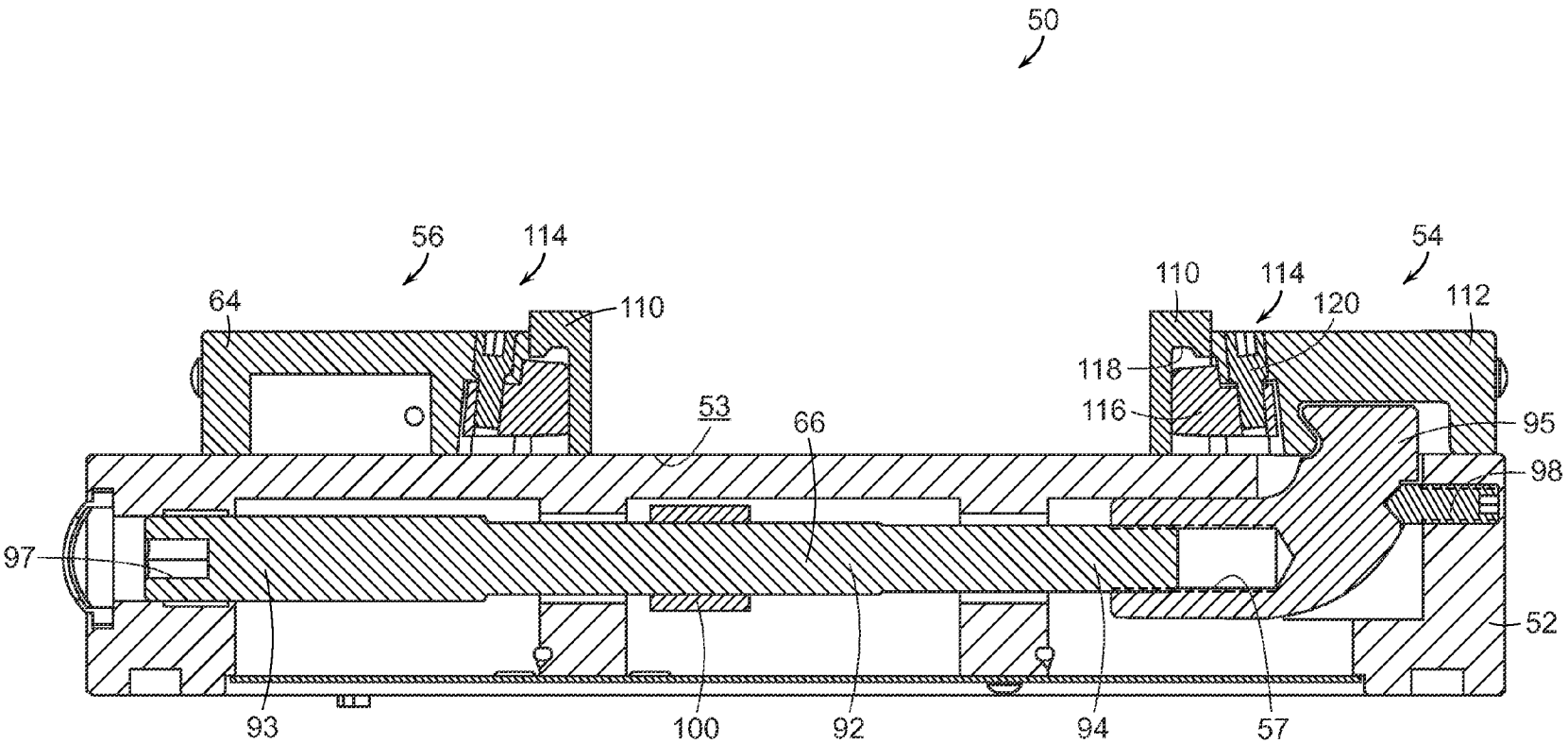
FIG. 4 is a cross-sectional view of the workholding device of FIG. 1 taken along line 4-4 in FIG. 3.

In order to move second jaw member 56 in small increments relative to base 52 and/or first jaw member 54 as outlined above, workholding device 50 can include a drive system configured to displace second jaw member 56 when jaw member 56 is engaged with at least one of racks 66. In at least one embodiment, referring to FIG. 4, the drive system can include drive member 92, wherein drive member 92 can include first end 93 and second end 94, and wherein second end 94 can be threadably engaged with at least one of base 52 and first jaw member 54, for example. In at least one such embodiment, base 52 and/or first jaw member 54 can include a threaded aperture 57 configured to threadably receive second end 94 such that, when drive member 92 is rotated about an axis, drive member 92 can be translated relative to base 52 and first jaw member 54. In various embodiments, the drive system can further include bushing, or crossbar, 100 mounted to drive member 92 wherein, when drive member 92 is rotated about its axis, crossbar 100 can be advanced toward and/or retracted away from first jaw member 54 along axis 55, depending on the direction, i.e., clockwise or counter-clockwise, in which drive member 92 is rotated. In at least one embodiment, racks 66 can be operably engaged with crossbar 100 such that, when crossbar 100 is translated relative to first jaw member 54 by drive member 92, racks 66 can be translated relative to first jaw member 54 by crossbar 100. In at least one such embodiment, although not illustrated, crossbar 100 can include projections extending therefrom which can be configured to fit within slots in racks 66 such that the drive force created by drive member 92 can be transferred into racks 66.

Figure 18:
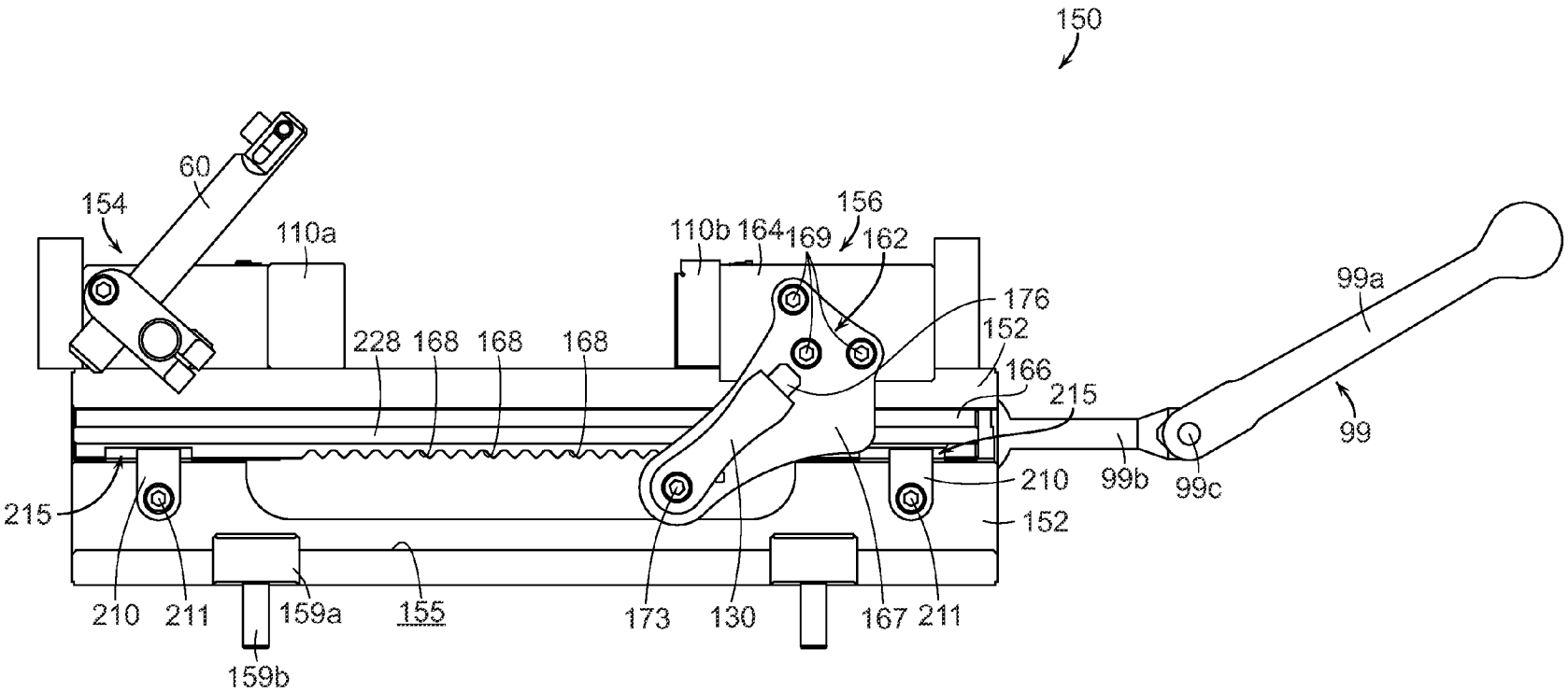
FIG. 18 is another elevational view of the workholding device of FIG. 17 illustrating a handle operably mounted thereto.
Figure 19:
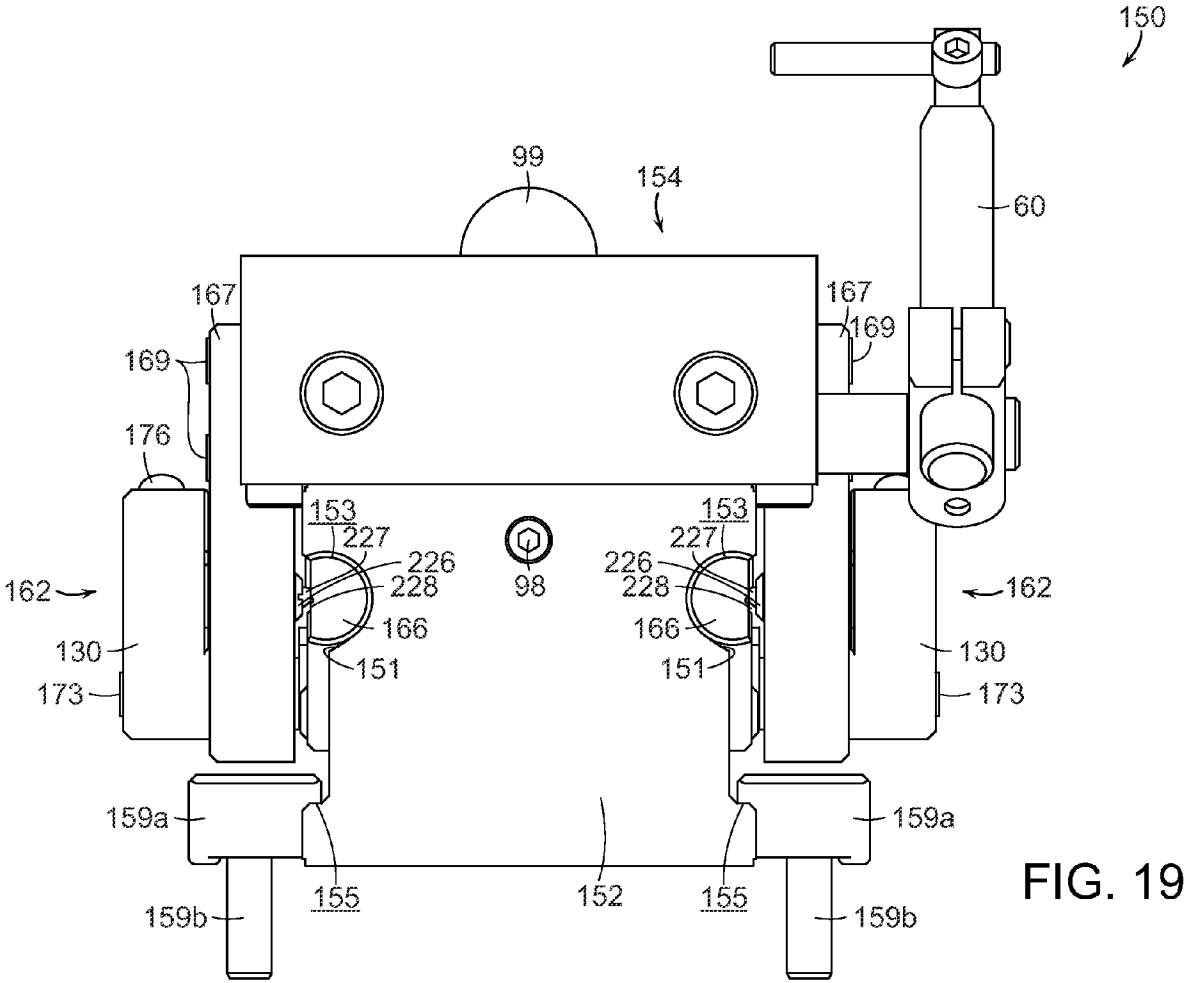
FIG. 19 is an end view of the workholding device of FIG. 17.
Figure 20:
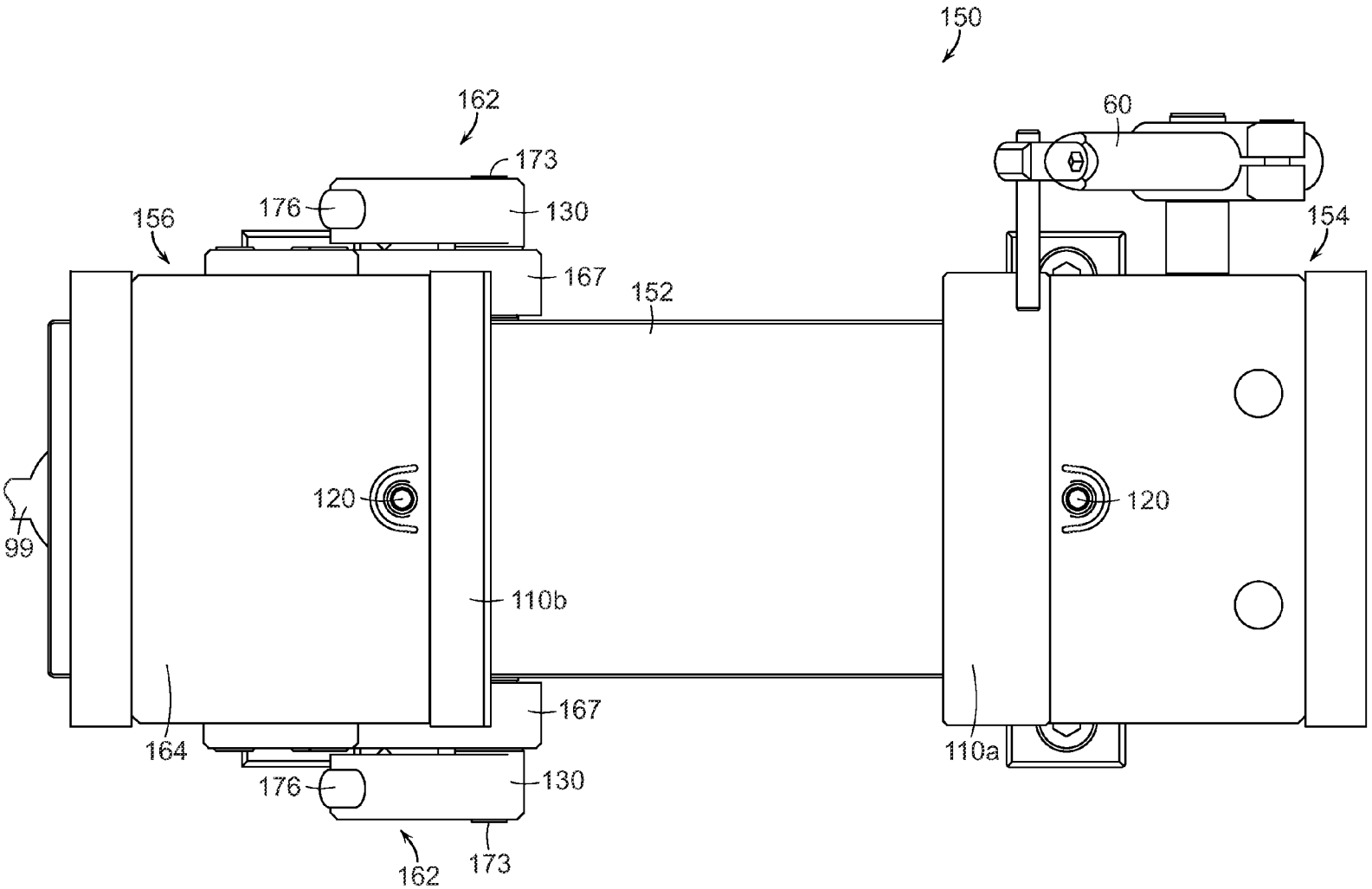
FIG. 20 is a top view of the workholding device of FIG. 17.
Figure 21:
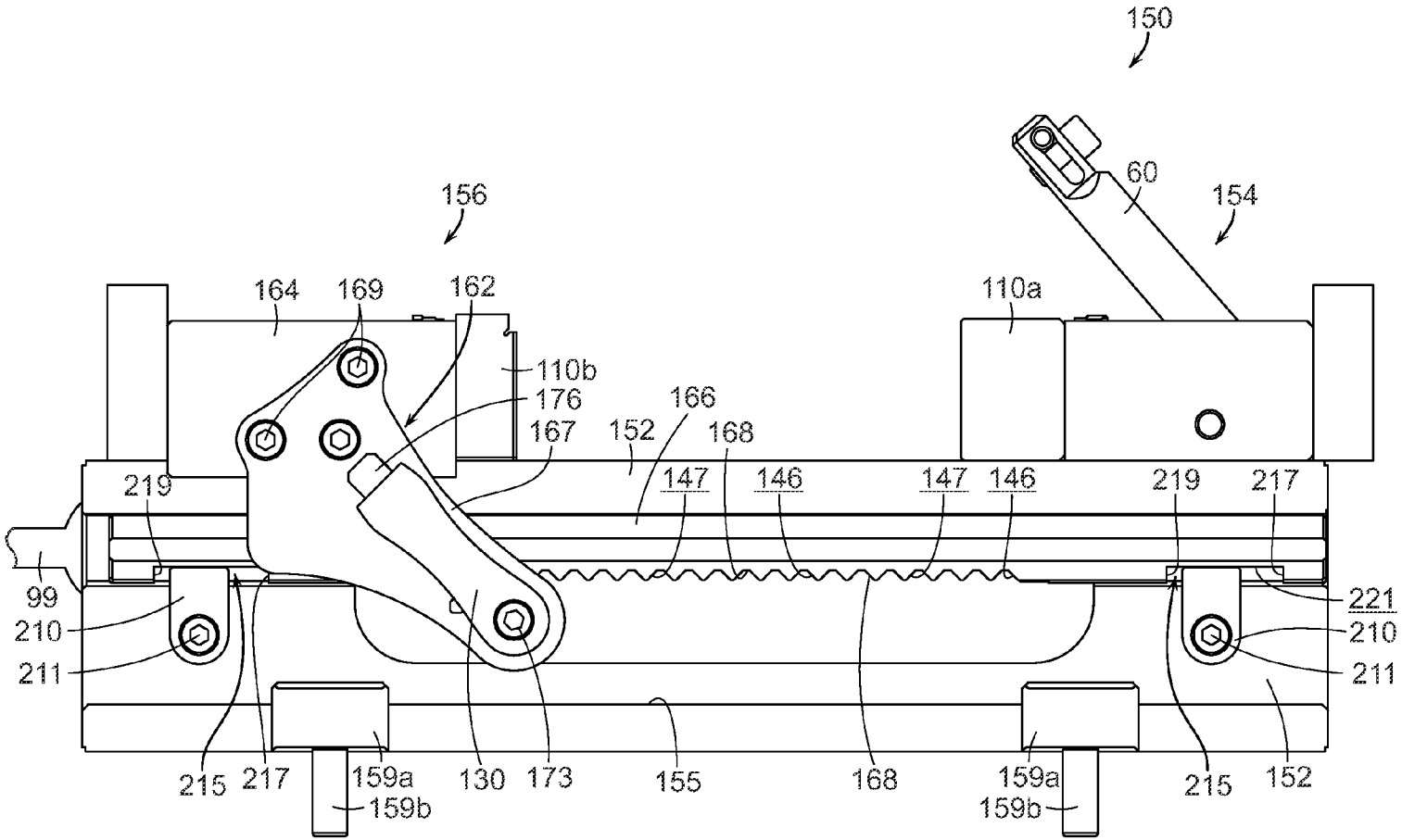
FIG. 21 is a rear elevational view of the workholding device of FIG. 17.
Figure 22:
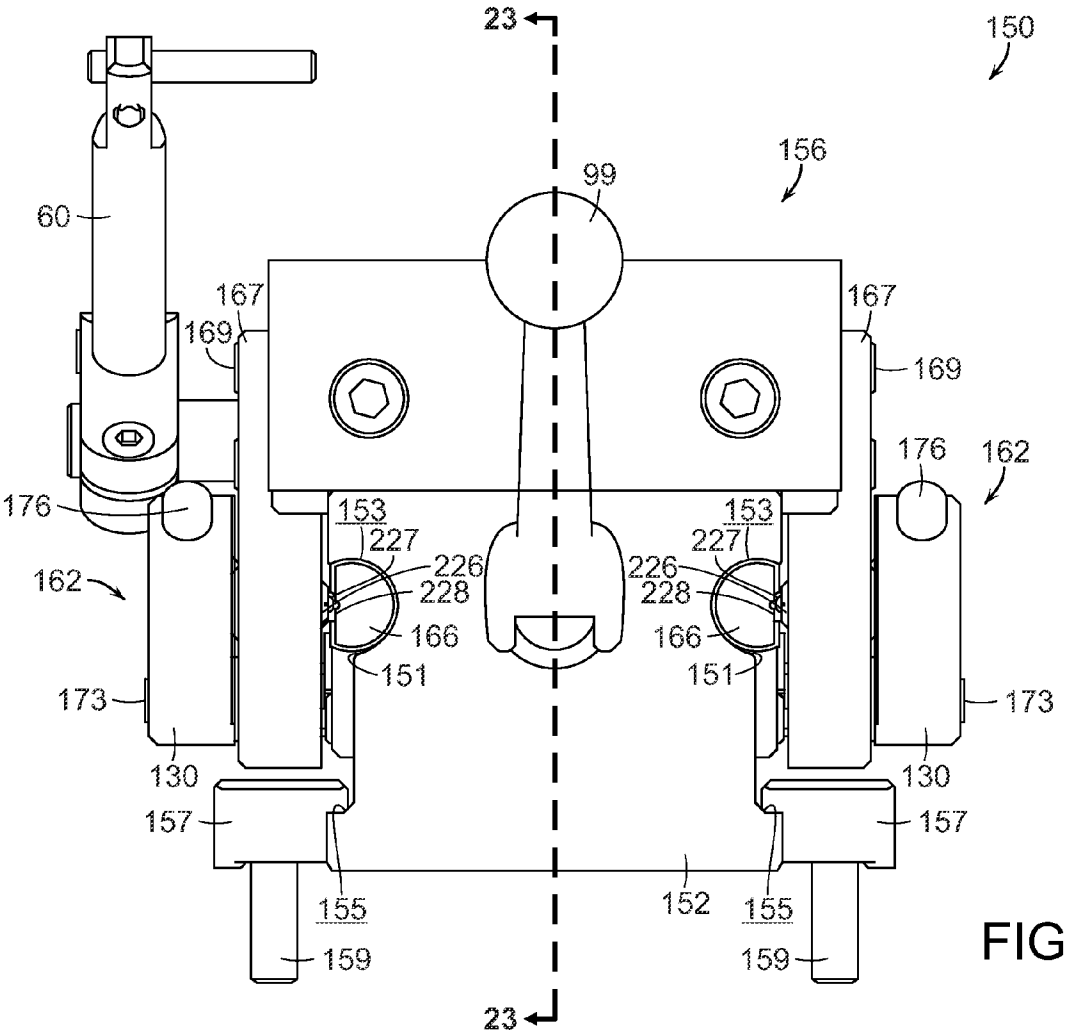
FIG. 22 is another end view of the workholding device of FIG. 17.

Further to the above, when second jaw member 56 is engaged with at least one of racks 66, second jaw member 56 can be translated relative to base 52, and first jaw member 54, when racks 66 are translated by drive member 92 as described above. In such embodiments, a workpiece can be positioned between jaw member 54 and 56 wherein, when large adjustments to the position of second jaw member 56 are necessary, second jaw member 56 can be released from racks 66 and brought into close opposition to, or contact with, the workpiece. Thereafter, second jaw member 56 can be re-engaged with racks 66 such that second jaw member 56 can be moved in small increments by drive member 92 until jaw member 56 is positioned firmly against the workpiece and a clamping force can be applied thereto. In various embodiments, first end 93 can be operatively engaged with a handle, such as handle 99 in FIG. 18, for example, such that drive member 92 can be easily turned as described above. In various embodiments, referring to FIG. 50, handle 99 can include a first portion 99*a* and a second portion 99*b* pivotably coupled together by pin 99*c*. In at least one such embodiment, referring to FIG. 4, first end 93 can include socket 97 which can be configured to receive the handle therein.

In various embodiments, as outlined above, drive member 92 can be operably connected to first jaw member 54 and second jaw member 56. In at least one such embodiment, the clamping force generated by drive member 92 can be directly transferred to a workpiece through jaw members 54 and 56 without having to flow through the base of the workholding device. More particularly, owing to the fact that first jaw member 54 can be threadably engaged with drive member 92 and second jaw member 56 can be releasably engaged with racks 66, the rotation of drive member 92 can generate a clamping force which is directly applied to the workpiece through jaw members 54 and 56. In various embodiments, referring to FIG. 4, the drive system can further include connection member 95 which can operably engage drive member 92 and first jaw member 54. In order to fix the position of first jaw member 54, jaw member 54 and base 52 can each include apertures therein configured to receive fasteners (not illustrated) which can secure jaw member 54 to base 52. In addition, device 50 can further include at least one set screw 98 which can be threadably retained in base 52 wherein set screw 98 can abut, or be positioned against, connection member 95, for example, to hold connection member 95 in position. In such embodiments, set screw 98 can prevent, or at least inhibit, unwanted movement or 'backlash' in connection member 95.

In various embodiments, the incremental travel of racks 66 and/or drive member 92 may be physically limited by shoulders and/or stops in base 52. In a further embodiment, although not illustrated, a detent mechanism, such as ball plunger, for example, may be used to provide an audio and/or tactile feedback to an operator indicating that racks 66 have reached the end of their desired or permitted stroke. In the event where the maximum stroke of racks 66 has been reached and further adjustment is still desired, connection members 62 may be released from racks 66 and then reengaged with an adjacent set of notches 68 such that the drive mechanism can be readjusted.

Figure 24:
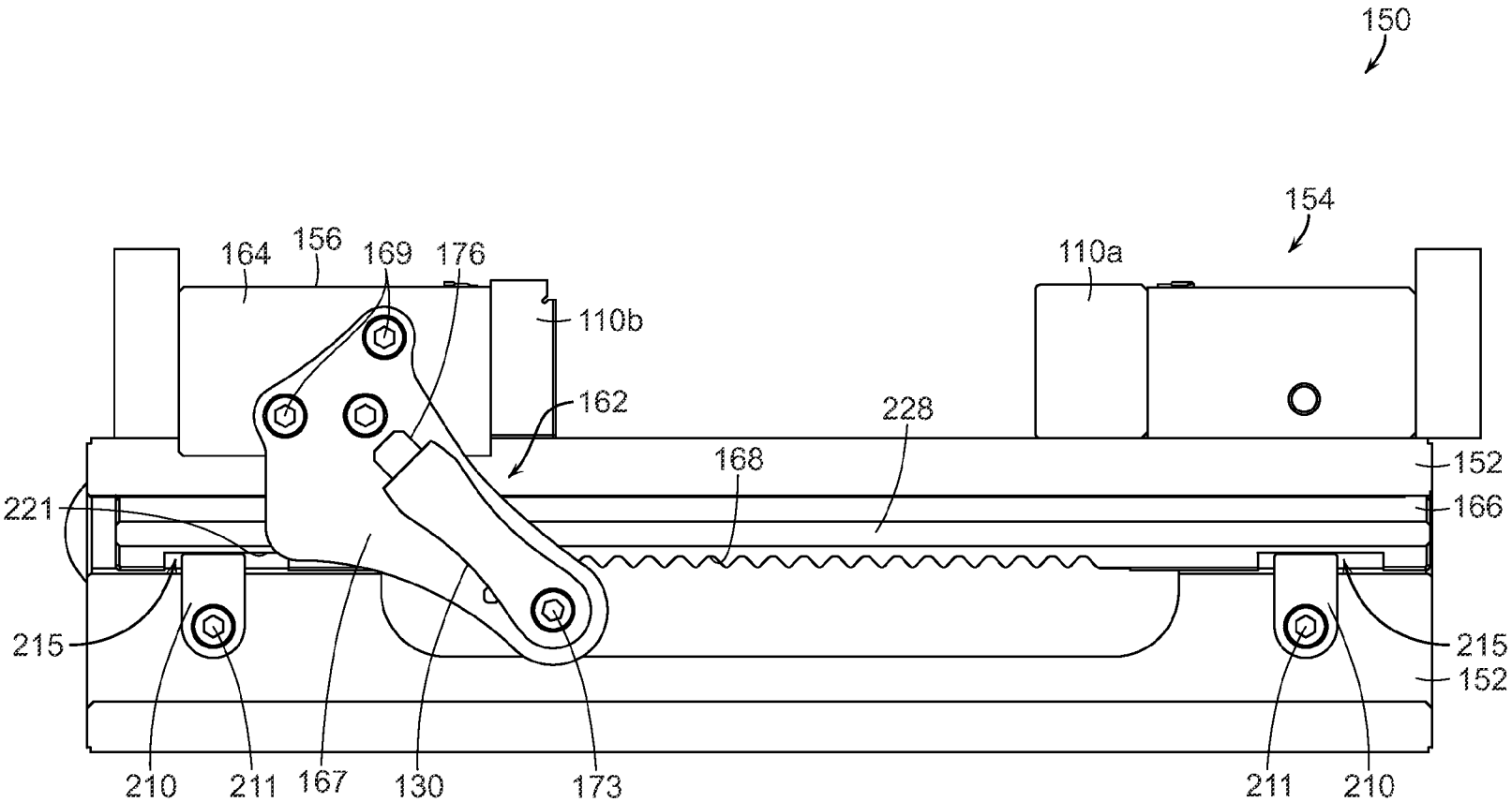
FIG. 24 is an elevational view of the workholding device of FIG. 17 illustrating a movable jaw member including a connection member engaged with an adjustment rack assembly.
Figure 25:
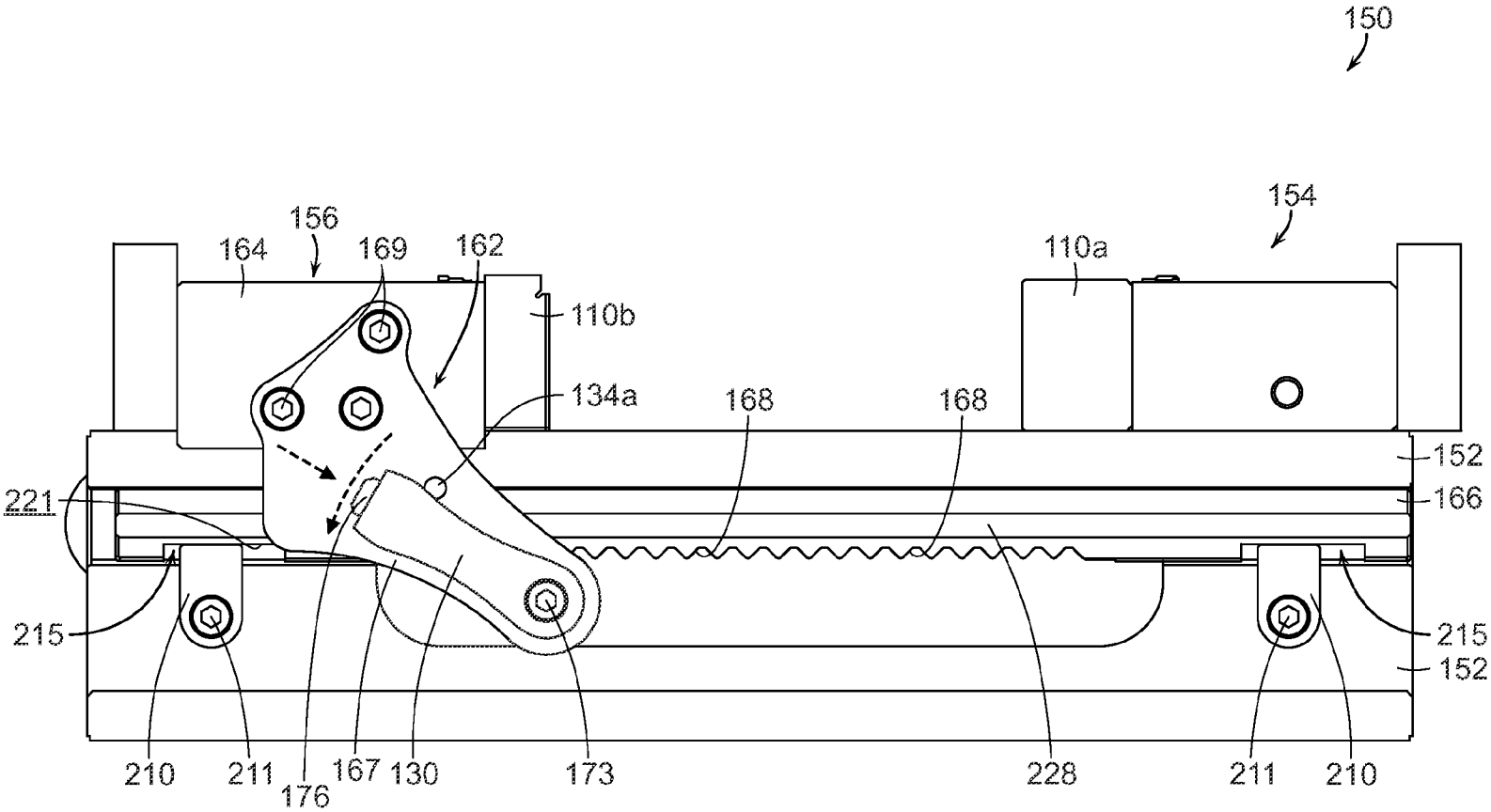
FIG. 25 is an elevational view of the workholding device of FIG. 17 illustrating an actuator button of a toggle of the connection member of FIG. 24 in an actuated state and illustrating the toggle being rotated downwardly.
Figure 26:
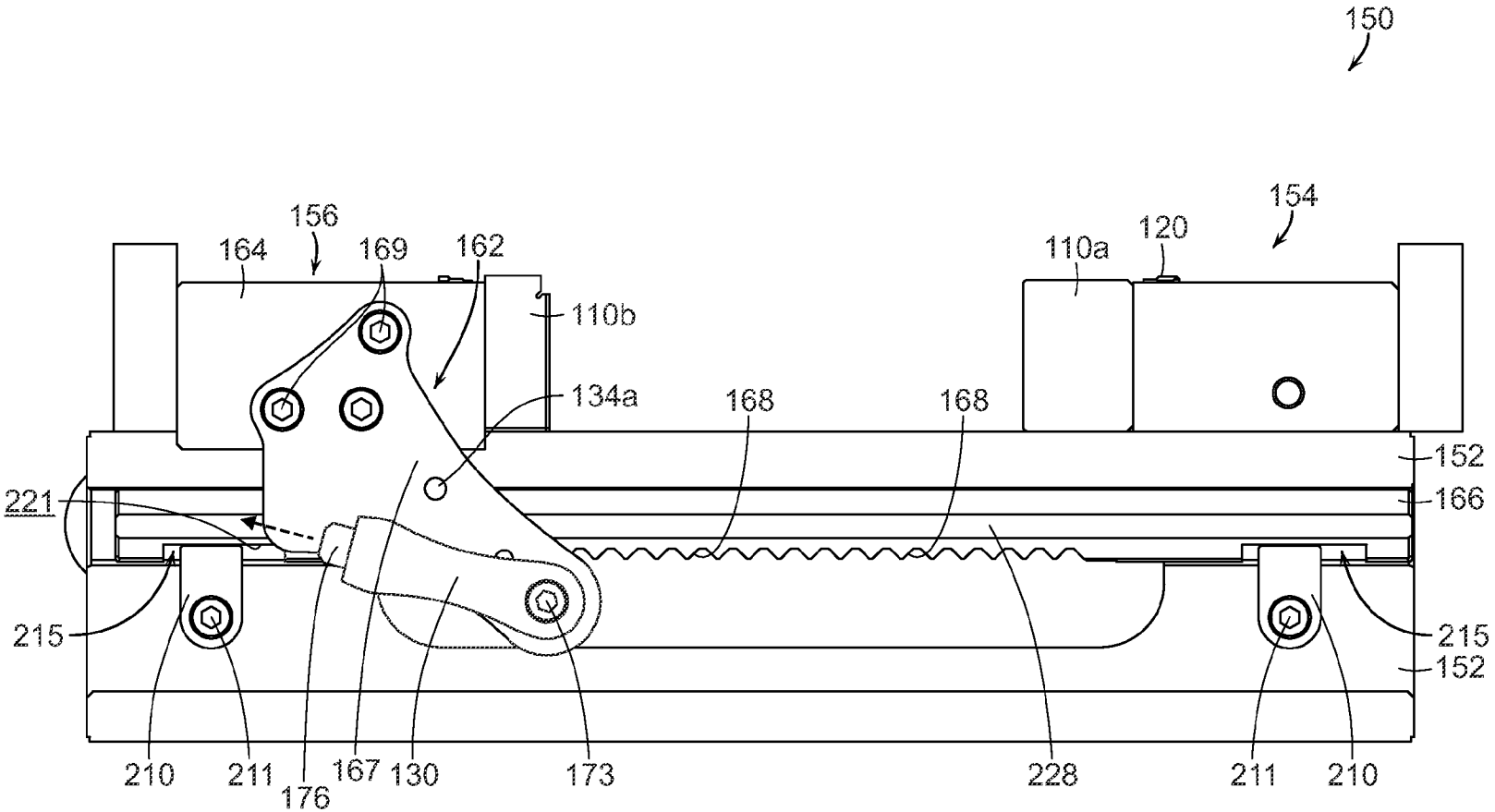
FIG. 26 is an elevational view of the workholding device of FIG. 17 illustrating the toggle rotated downwardly and the actuator button in an unactuated state.

In at least one embodiment, referring now to FIGS. 17-54, workholding device 150 can include first jaw member 154 mounted to base 152 and, in addition, second jaw member 156 which is movable relative to base 152 and first jaw member 154. Similar to the above, each jaw member can include one or more jaw plates, such as jaw plates 110*a* and 110*b*, for example, mounted thereto. In certain embodiments, referring to FIGS. 17-22, second jaw member 156 can include body portion 164 and, in addition, at least one connection member 162 mounted to body portion 164. In various embodiments, connection member 162 can comprise a toggle which can be moved between a first position, or orientation, to hold movable jaw member 156 in position and a second position, or orientation, to allow second jaw member 156 to be moved relative to first jaw member 154, for example. In at least one such embodiment, each connection member 162 can comprise a side plate 167 and, in addition, a toggle 130 movably mounted to side plate 167. Side plate 167 can be mounted to body portion 164 of second jaw member 156 by one or more fasteners, such as bolts 169, for example, inserted through one or more apertures 171 (FIGS. 34-47) in side plate 167. In use, toggle 130 can be rotated or pivoted between a first position, or orientation, as illustrated in FIG. 24 and a second position, or orientation, as illustrated in FIG. 26. In its first position, referring now to FIGS. 30-35, a projection 170 extending from toggle 130 can be positioned within a notch, or recess, 168 defined within a rack 166 such that, owing to the co-operative configuration of the projection 170 and the recess 168, second jaw member 156 can be locked or secured to rack 166 by toggle 130. When toggle 130 is rotated downwardly into its second position, for example, projection 170 can be rotated out of, or at least substantially out of, recess 168 such that second jaw member 156 can be slid toward and/or away from first jaw member 154, for example.

In various embodiments, further to the above, toggle 130 can be rotated or pivoted relative to side plate 167 about an axis defined by a pivot pin, such as pivot pin 172, for example. In at least one embodiment, referring to FIGS. 31 and 33, pivot pin 172 can be configured to extend though an aperture, such as aperture 175 (FIGS. 42 and 45), for example, in side plate 167, wherein pivot pin 172 can be mounted to toggle 130 by a fastener 173. In certain embodiments, end 179 of pivot pin 172 can include a non-circular configuration, such as a hexagonal shape having six flat or at least substantially flat surfaces, for example, which can be configured to transmit the rotational movement of toggle 130 to pivot pin 172 and, correspondingly, projection 170. In certain embodiments, end 179 can be positioned within and/or press-fit within an aperture, such as aperture 129 (FIG. 48), for example, in toggle 130 such that there is no, or at least little, relative movement therebetween. In at least one embodiment, referring to FIG. 48, aperture 129 can include one or more flat, or at least substantially flat, surfaces which can be configured to closely receive and co-operate with the flats of end 179.

Figure 31:
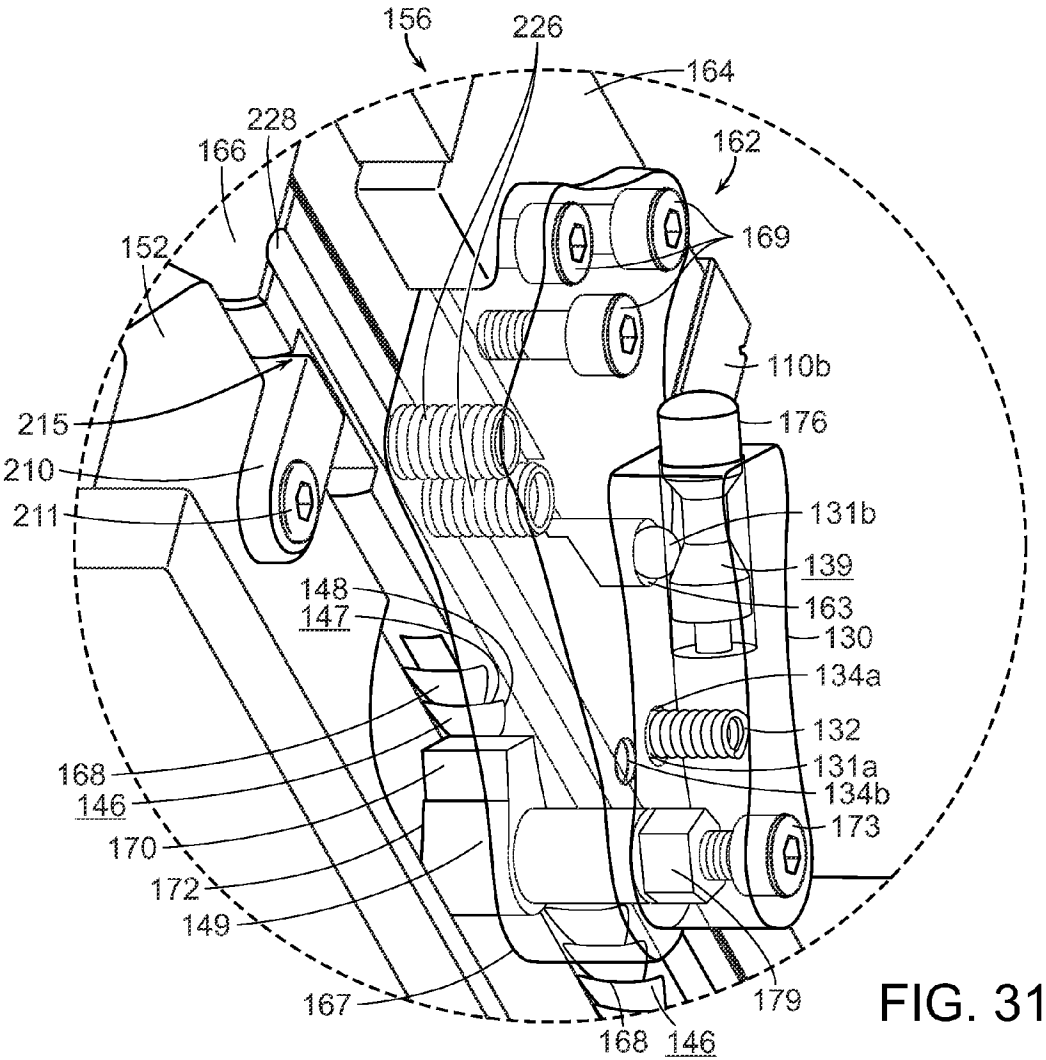
FIG. 31 is a detail view of the connection member of the workholding device of FIG. 17.
Figure 30:
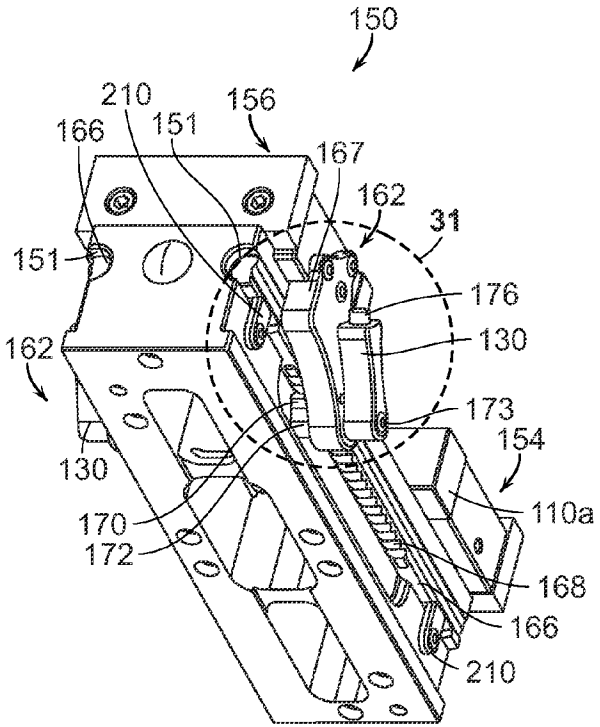
FIG. 30 is a perspective view of the workholding device of FIG. 17.
Figure 32:
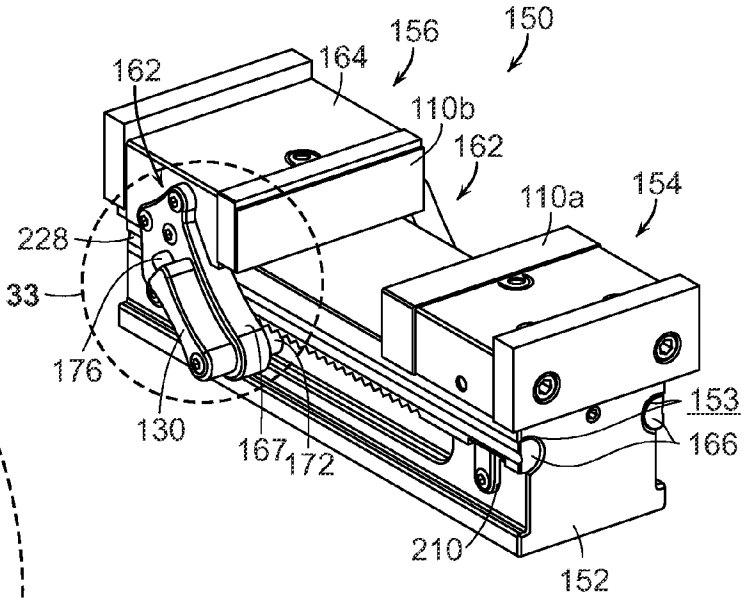
FIG. 32 is another perspective view of the workholding device of FIG. 17.
Figure 48:
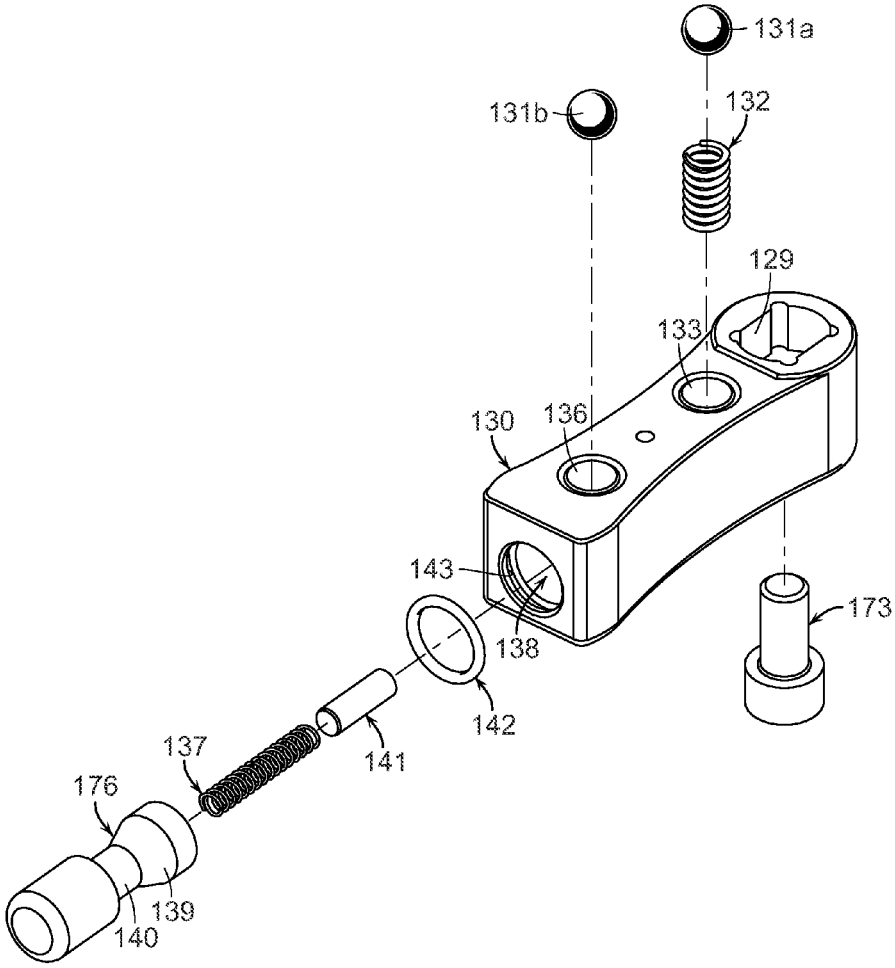
FIG. 48 is an exploded view of the toggle of the connection member of FIG. 34.

As described above, toggle 130 can be manipulated in order to selectively release and/or lock second jaw member 156 in position. In various embodiments, toggle 130 can be configured such that it can be releasably held or retained in at least one of its first and second positions, for example. More particularly, referring primarily to FIGS. 31 and 33, toggle 130 can include one or more detent mechanisms, for example, which can be configured to retain toggle 130 in its first, or unactuated, position, and/or its second, or actuated, position. In at least one such embodiment, referring to FIGS. 31, 33, and 48, toggle 130 can comprise at least one ball detent 131*a* which can be biased into engagement with side plate 167 by detent spring 132 wherein, owing to the engagement between ball detent 131*a* and side plate 167, toggle 130 may be prohibited from moving relative to side plate 167. Referring to FIG. 48, in at least one embodiment, toggle 130 can further include an aperture 133 configured to at least partially receive detent spring 132 and ball detent 131*a*, wherein aperture 133 can be configured to allow ball detent 131*a* to slide therein and compress spring 132 against a bottom surface of aperture 133. In use, as illustrated in FIG. 31, ball detent 131*a* can be biased into detent aperture 134*a* in side plate 167 by spring 132 such that toggle 130 can be held in its first position, for example, owing to the interaction between ball detent 131*a* and the sidewalls of detent aperture 134*a*. In various embodiments, detent spring 132 can have a sufficient spring rate, or stiffness, such that toggle 130 cannot be rotated out of its first position unless a sufficient force is supplied thereto. In certain embodiments, detent ball 131*a* can comprise a spherical, or at least substantially spherical, shape; however, any other suitable shape can be utilized for a detent member in lieu of actuator ball 131*a*.

In various embodiments, referring again to FIGS. 31, 33, and 48, toggle 130 can further include an actuator mechanism which can be configured to hold toggle 130 in its first position, for example, in addition to or in lieu of the detent mechanism described above. In at least one embodiment, the actuator mechanism may not be overcome, or overridden, by simply supplying a sufficient force to toggle 130 as may occur with various embodiments of the detent mechanism. In certain embodiments, toggle 130 can further comprise toggle actuator, or actuator button, 176 and an actuator ball, or detent member, 131*b*, wherein toggle actuator 176 can be configured to positively position actuator ball 131*b* against and/or within side plate 167 in order to securely hold toggle 130 in position. In various embodiments, similar to the above, toggle 130 can include an aperture 136 (FIG. 48) configured to at least partially receive actuator ball 131*b* such that ball 131*b* can slide therein. While actuator ball 131*b* can comprise a spherical, or at least substantially spherical, shape, any other suitable shape can be utilized for a detent member in lieu of actuator ball 131*b*.

Figure 27:
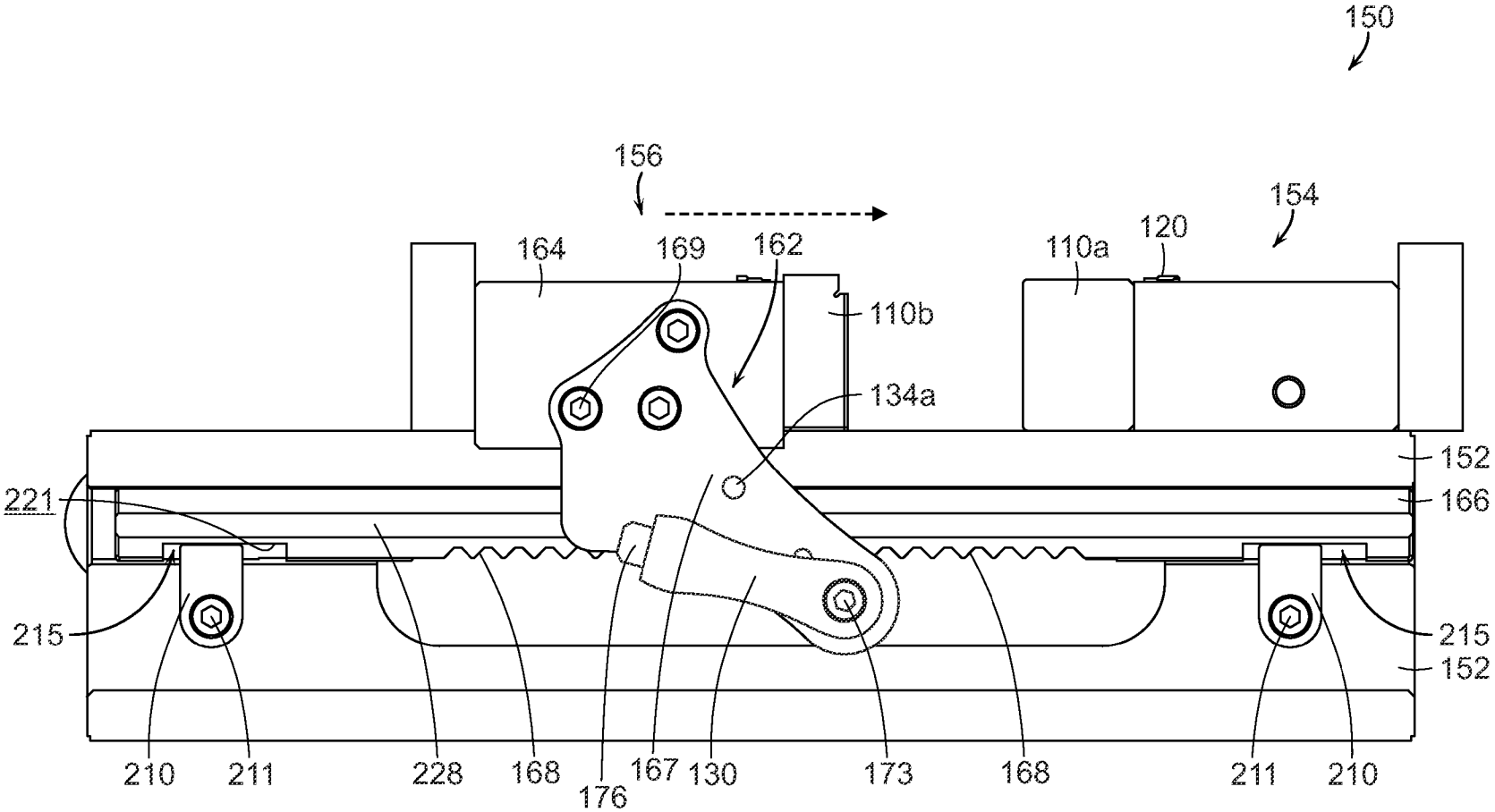
FIG. 27 is an elevational view of the workholding device of FIG. 17 illustrating the movable jaw member being moved toward another jaw member.
Figure 33:
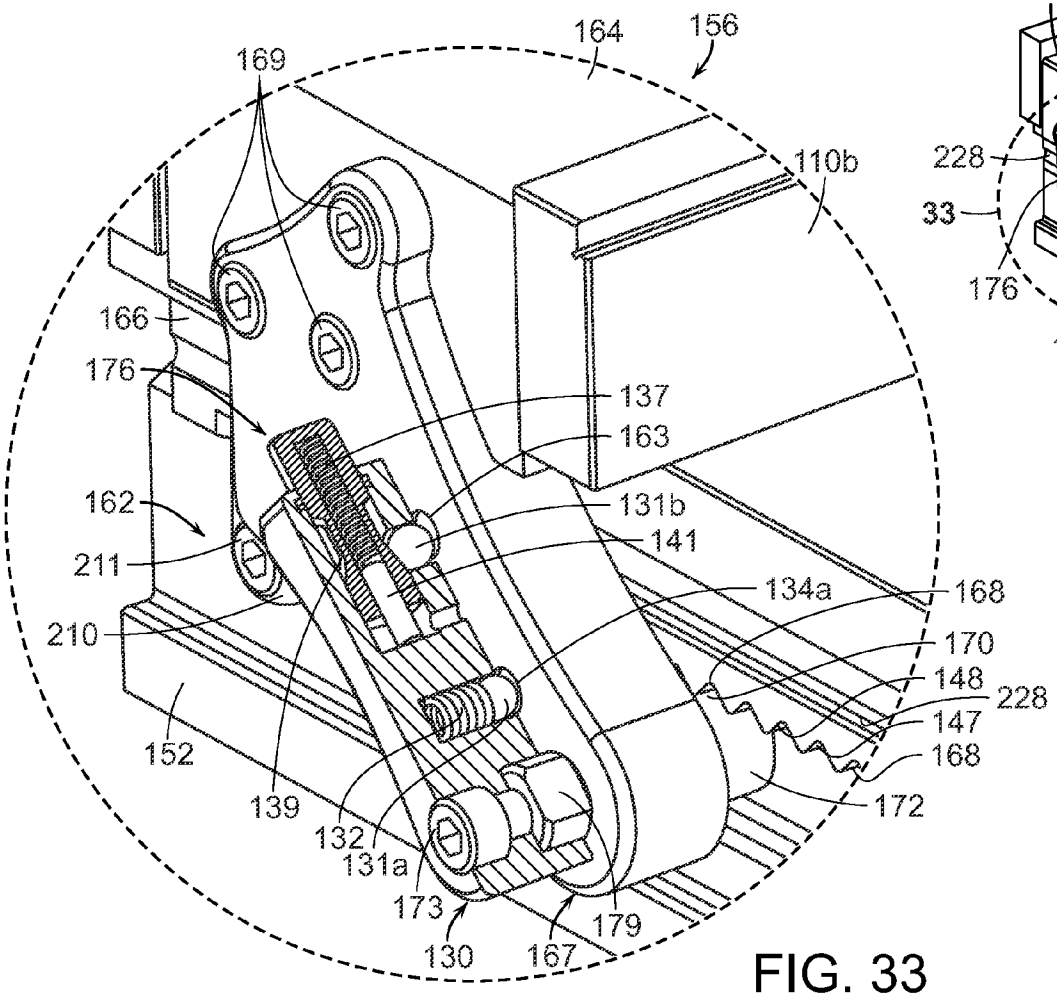
FIG. 33 is another detail view of the connection member of the workholding device of FIG. 17.
Figure 35:
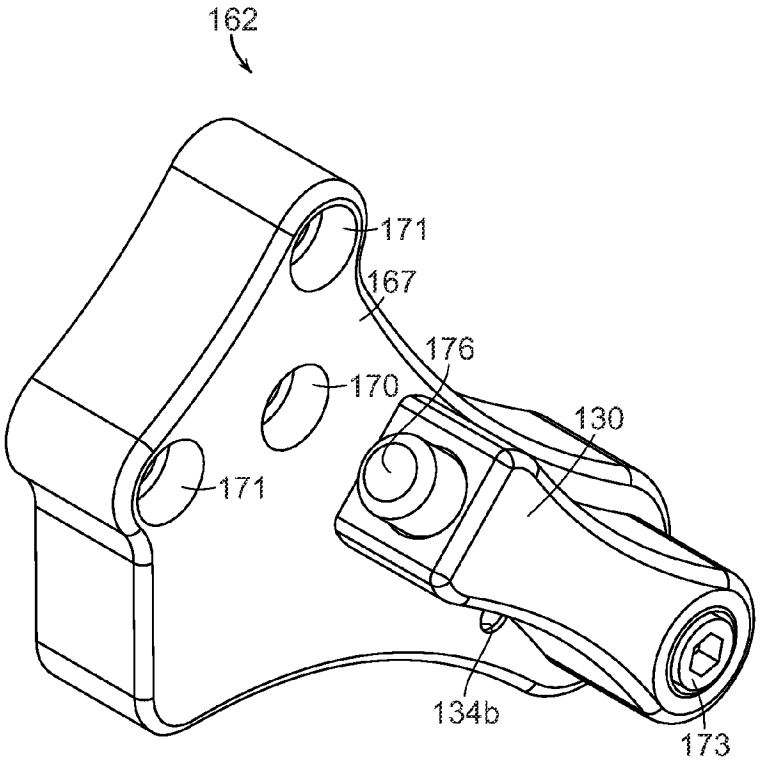
FIG. 35 is another perspective view of the connection member of FIG. 34.
Figure 34:
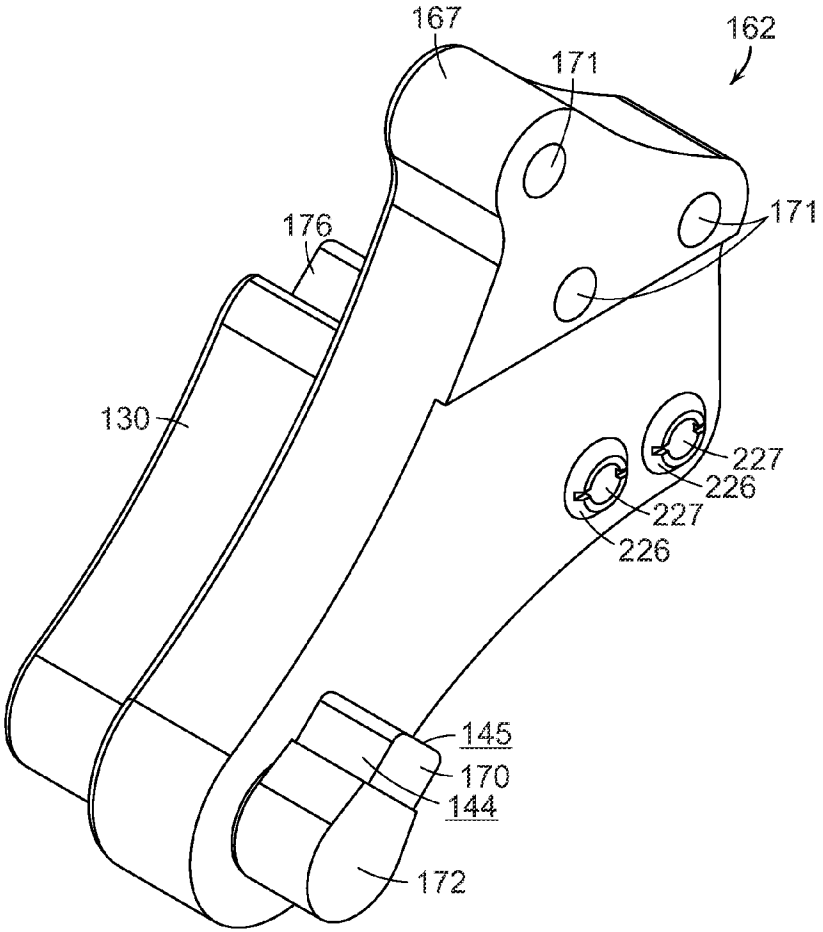
FIG. 34 is a perspective view of the connection member of the workholding device of FIG. 17.
Figure 37:
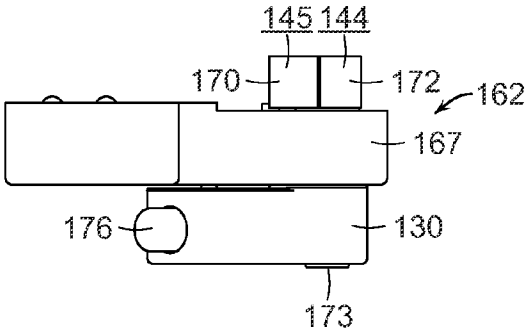
FIG. 37 is a top view of the connection member of FIG. 34.
Figure 36:
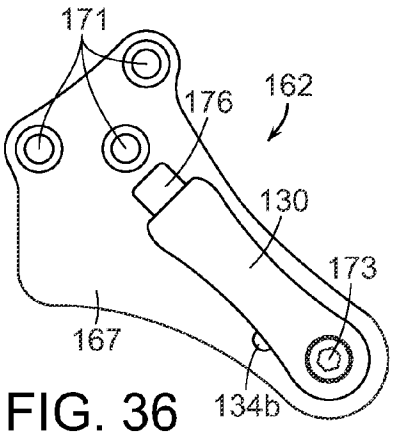
FIG. 36 is a front elevational view of the connection member of FIG. 34.
Figure 40:
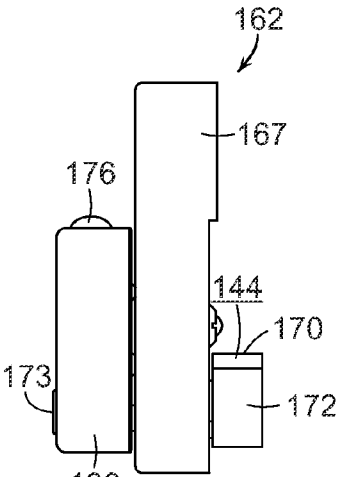
FIG. 40 is a right side view of the connection member of FIG. 34.
Figure 41:
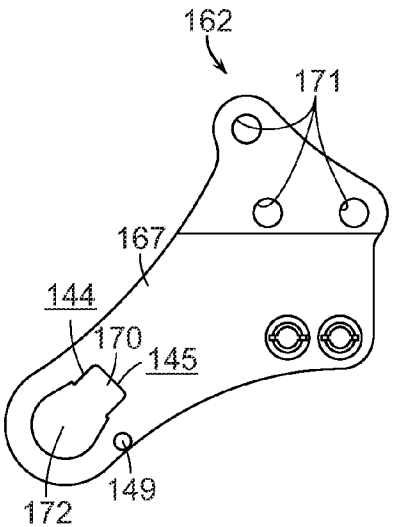
FIG. 41 is a rear elevational view of the connection member of FIG. 34.
Figure 38:
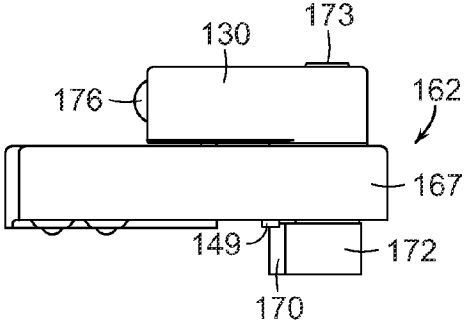
FIG. 38 is a bottom view of the connection member of FIG. 34.
Figure 39:
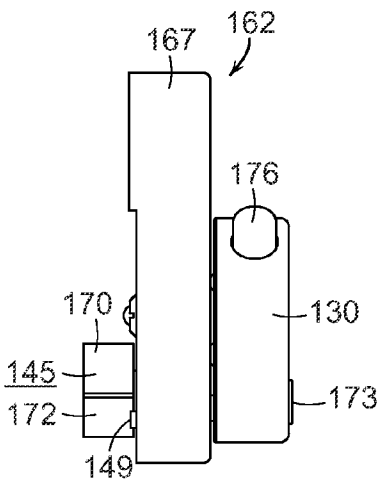
FIG. 39 is a left side view of the connection member of FIG. 34.

In various embodiments, referring to FIG. 48, toggle 130 can further comprise toggle actuator spring 137 which can be configured to bias toggle actuator 176 into an unactuated position. When toggle actuator 176 is positioned in its unactuated position, as illustrated in FIGS. 31 and 33, lock portion 139 can be positioned adjacent to, or in contact with, actuator ball 131*b* such that ball 131*b* can be at least partially positioned within lock aperture 163 (FIG. 42) in side plate 167. Owing to the co-operative configuration of actuator ball 131*b* and the sidewalls of aperture 163, toggle 130 can be secured in its first position, for example. In order to move toggle 130 into its second position, as illustrated in FIG. 26, a force can be applied to toggle actuator 176 such that actuator 176 can be depressed into, or at least further depressed within, actuator aperture 138 (FIG. 48) and positioned in an actuated position. When toggle actuator 176 is in its actuated position, as illustrated in FIG. 25, unlock portion 140 can be positioned adjacent to, or in contact with, actuator ball 131*b* such that ball 131*b* can at least partially slide into toggle 130. In various embodiments, unlock portion 140 can have a smaller diameter or thickness than lock portion 139 such that, when unlock portion 140 is aligned with actuator ball 131*b*, actuator ball 131*b* can be displaced inwardly instead of locking toggle 130 in position. In such circumstances, a sufficient force can be applied to toggle 130 in order to rotate toggle 130 into its second position as illustrated in FIG. 26. As described above, projection 170 extending from toggle 130 can be rotated out of a recess 168 when toggle 130 is rotated into its second position and, as a result, second jaw member 156, for example, can be slid relative to base 152 and/or first jaw member 154 as illustrated in FIG. 27.

In various embodiments, as can be seen in FIGS. 31 and 33, side plate 167 can further include a detent aperture 134*b* which can be configured to at least partially receive detent ball 131*a* when toggle 130 is rotated into its second position. In at least one embodiment, similar to the above, detent spring 132 can bias detent ball 131*a* into detent aperture 134*b*, wherein detent ball 131*a* and the sidewalls of detent aperture 134*b* can be configured to co-operatively hold, or at least releasably hold, toggle 130 in its second position until a sufficient force is applied to toggle 130 in order to dislodge toggle 130 from its second position. Once toggle 130 is in its second position, toggle actuator 176 can be released such that actuator spring 137 can re-expand and reposition toggle actuator 176 into its unactuated position. In such an unactuated position, lock portion 139 of toggle actuator 176 can be realigned with actuator ball 131*b* such that actuator ball 131*b* can be reengaged with side plate 167. In various embodiments, although not illustrated, side plate 167 can further include another actuator ball aperture configured to receive actuator ball 131*b* in order to securely hold toggle 130 in its second position. In other various embodiments, lock portion 139 can bias actuator ball 131*b* against the surface of side plate 167 such that a force to move toggle 130 from this position would have to overcome a friction force between actuator ball 131*b* and side plate 167. In at least some such embodiments, lock portion 139 may be comprised of at least two diameters, or thicknesses, such that toggle actuator 176 can suitably bias actuator ball 131*b* into engagement with side plate 167 whether or not the actuator ball 131*b* is aligned with a corresponding actuator ball aperture in side plate 167. In at least one embodiment, lock portion 139 may comprise an inclined or tapered surface having two or more diameters or thicknesses, wherein a first thickness can displace actuator ball 131*b* a first distance to position actuator ball 131*b* into a ball aperture, and wherein a second thickness can displace actuator ball 131*b* a second, or shorter, distance to position actuator ball 131*b* into engagement with the surface of side plate 167.

Figure 28:
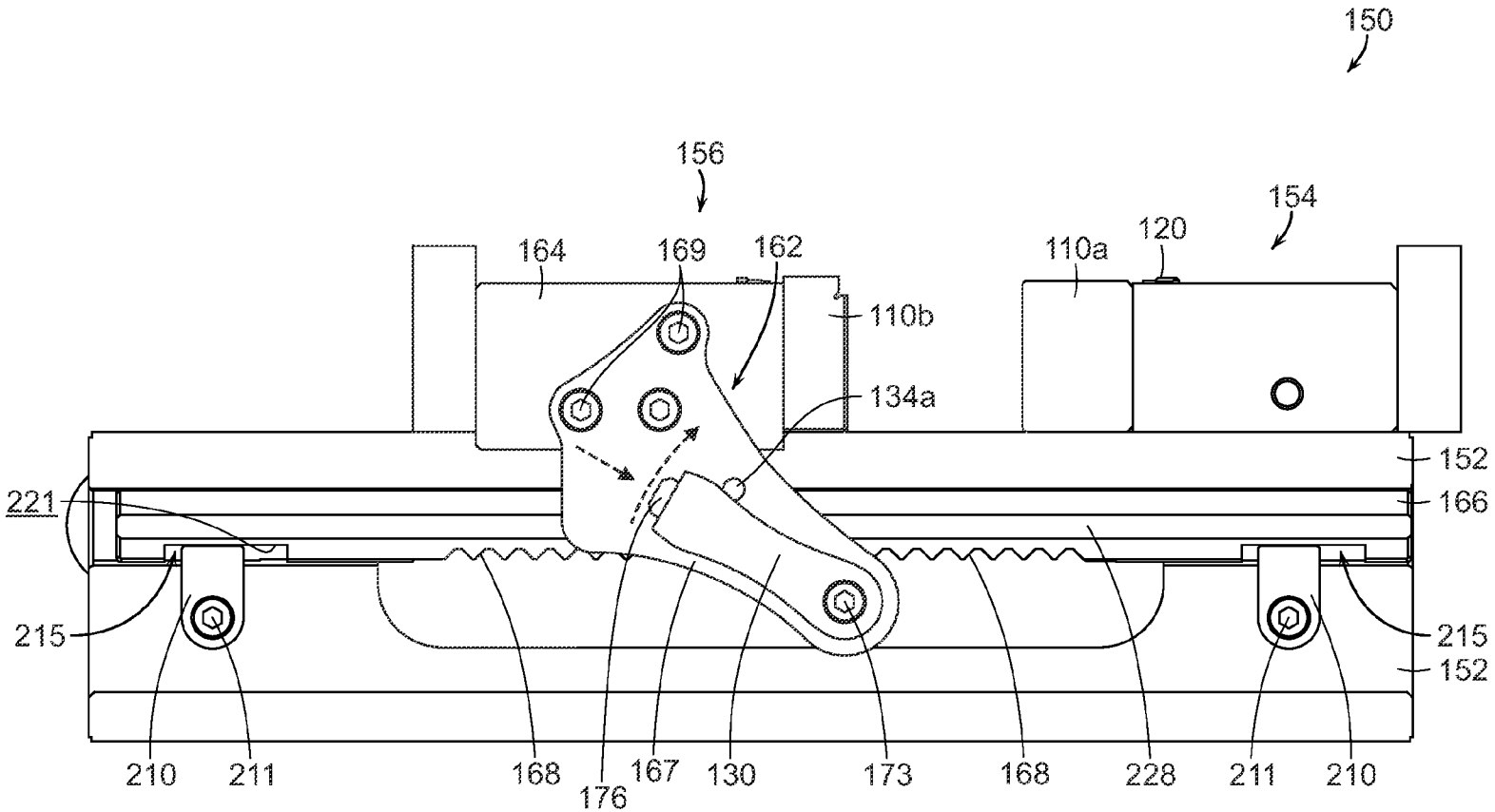
FIG. 28 is an elevational view of the workholding device of FIG. 17 illustrating the actuator button in an actuated state once again and the toggle being rotated upwardly.
Figure 29:
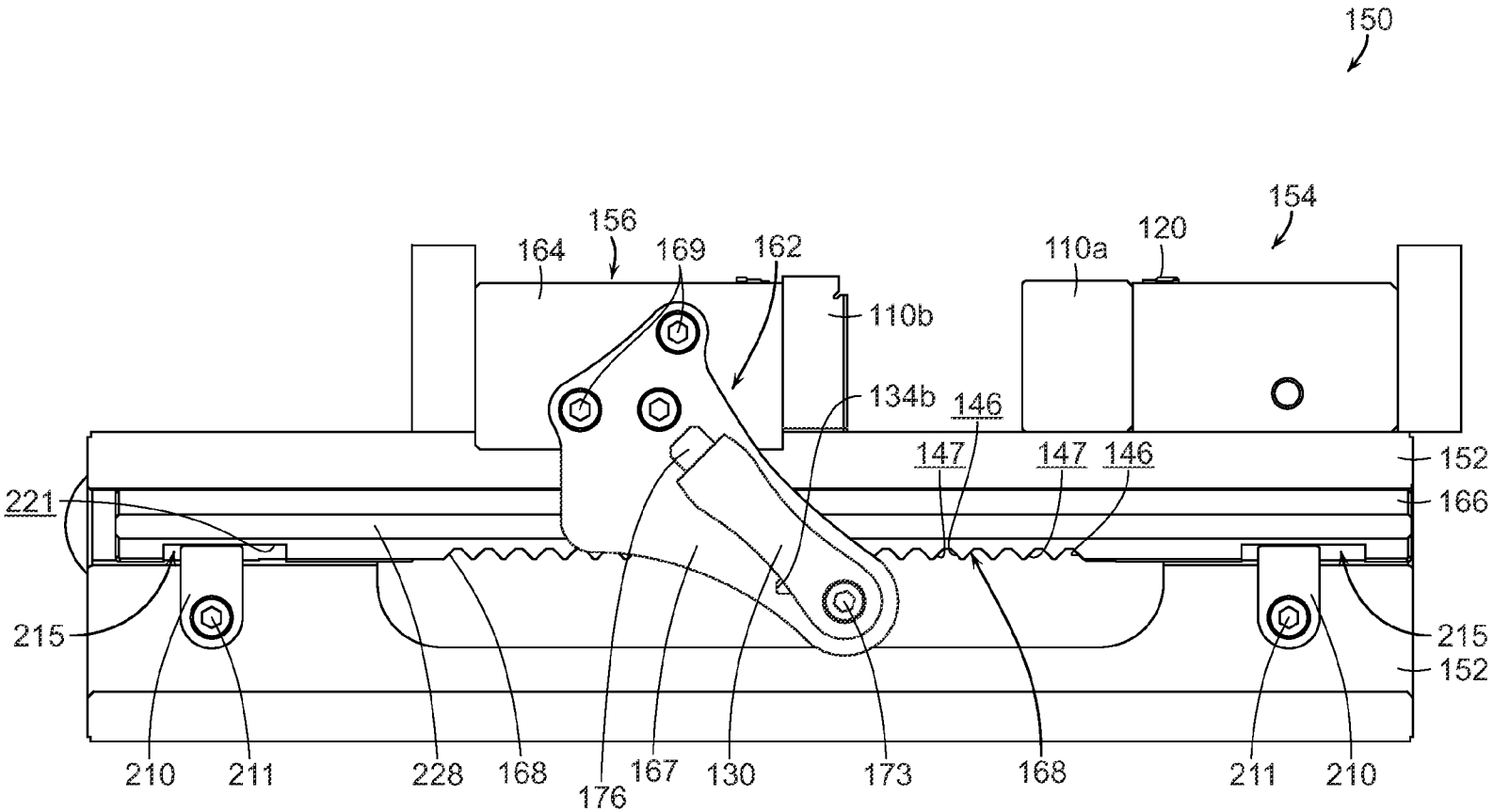
FIG. 29 is an elevational view of the workholding device of FIG. 17 illustrating the toggle rotated upwardly and the actuator button in an unactuated state to lock the movable jaw member to the adjustment rack assembly.

In any event, once second jaw member 156 has been suitably repositioned, toggle actuator 176 can be reactuated, as illustrated in FIG. 28, in order to reposition unlock portion 140 adjacent to actuator ball 131*b* and in order to facilitate the movement of toggle 130 between its second position and its first position as illustrated in FIG. 29. As described above, projection 170 of pivot pin 172 can be repositioned within a recess 168 once again in order to resecure second jaw member 156 and lock second jaw member 156 to racks 166. At such point, in various embodiments, toggle actuator 176 can be released once again such that toggle spring 137 can move toggle actuator 176 back into its unactuated position. In order to facilitate the proper movement of toggle actuator 176 within actuator aperture 138 and the proper compression and expansion of toggle spring 137, referring to FIG. 48, actuator 130 can further comprise a guide rod 141 which can be configured to be inserted within spring 137 and can prevent, or at least reduce, the buckling and/or undesirable movement of spring 137. In at least one embodiment, toggle 130 can further comprise a seal, such as o-ring seal 142, for example, which can be configured to provide a sealing surface between toggle actuator 176 and toggle 130 and, in addition, provide a resilient guide configured to center, or at least suitably position, toggle actuator 176 within actuator aperture 138. In at least one such embodiment, referring again to FIG. 48, actuator aperture 138 can include one or more grooves 143 which can be configured to retain seal 142 in position. In any event, seal 142 can be comprised of any suitable material including rubber and/or any other suitable elastomeric or resilient material, for example.

As described above, toggle 130 can be rotated between first and second positions in order to engage and disengage projection 170 with recesses 168. In various embodiments, projection 170 and recesses 168 can be suitably configured such that second jaw member 156 does not slip, or otherwise unsuitably move, relative to base 152 and/or first jaw member 154 when second jaw member 156 is tightened against a workpiece positioned intermediate first jaw member 154 and second jaw member 156 as described in greater detail below. In at least one embodiment, referring to FIGS. 29-35, each recess 168 can include at least first and second surfaces which can be configured to closely receive at least first and second surfaces on projection 170. More particularly, referring primarily to FIG. 34, projection 170 can comprise a first flat, or at least substantially flat, surface 144 and a second flat, or at least substantially flat, surface 145. In certain embodiments, first surface 144 and second surface 145 can be perpendicular, or at least substantially perpendicular, to one another. Referring now to FIG. 31, each recess 168 can include a first flat, or at least substantially flat, surface 146 and a second flat, or at least substantially flat, surface 147 which can also be perpendicular, or at least substantially perpendicular, to one another. As illustrated in FIGS. 31 and 33, projection 170 can be closely received within a recess 168 such that first surface 144 is position adjacent to, or against, first surface 146 and such that second surface 145 is positioned adjacent to, or against, second surface 147. In certain embodiments, each recess 168 can be symmetrical, or at least substantially symmetrical, such that the top, or apex, 148 of each recess 168 is positioned in the center of the recess.

In various embodiments, as described above, projections 170 can be manually moved between their engaged and disengaged positions by toggles 130. In various circumstances, toggles 130 can be actuated and/or moved independently of one another in order to selectively manipulate the projections 170. In certain embodiments, although not illustrated, a tool can be configured to engage toggles 130 such that the toggles 130 can be actuated and/or moved simultaneously by an operator. In at least one such embodiment, such a tool can comprise a handle and two or more projections extending from the handle, wherein the projections can be configured to engage the toggles 130 such that a sufficient force, or forces, can be applied to the handle to actuate and/or move the toggles. In at least one embodiment, a downward, or at least substantially downward, force can be applied to the handle to depress toggle actuators 176 and a horizontal, or at least substantially horizontal, force can be applied to the handle to rotate toggles 130. In any event, after the toggles 130 have been reengaged with recesses 168, the tool can be detached from toggles 130 and/or it can remain attached to the toggles 130 if desired. In various embodiments, although not illustrated, a workholding device can include a system for actuating and/or moving projections 170 at the same time, or at least substantially the same time, in addition to or in lieu of toggles 130. In at least one embodiment, a suitable mechanism, such as a crossbar, for example, can be operably engaged with projections 170 and can extend over and/or around at least a portion of second jaw member 156 such that the crossbar can be accessed and moved, or rotated, by an operator.

In certain embodiments, projections 170 can be moved into and out of engagement with recesses 168 in any suitable manner by one or more hydraulic systems, pneumatic systems, electrical systems, and/or electro-mechanical systems, for example. In at least one embodiment, one or more hydraulic cylinders, for example, can be mounted to body portion 164 of second jaw member 156, for example, wherein each hydraulic cylinder can include at least one extendable piston rod operably engaged with a projection 170 such that the projection 170 can be rotated about an axis when the piston rod is extended and/or retracted. In certain embodiments, the hydraulic cylinders can be in fluid communication with one or more sources of hydraulic fluid wherein, in at least one embodiment, pressurized hydraulic fluid can be supplied to the cylinders from a common fluid source. In at least one such embodiment, the fluid source, or sources, can be mounted to body portion 164, wherein the operation of one or more actuators can be utilized to adjust the pressure of the fluid supplied to the cylinders. In certain embodiments, such an actuator can comprise a threaded fastener which can be advanced into and out of a fluid chamber when rotated by a tool, such as an Allen wrench, for example, operably engaged with an accessible end of the fastener. In at least one such embodiment, an increase in fluid pressure can move projections 170 out of engagement with recesses 168, for example, and a decrease in pressure fluid can allow projections 170 to be moved into engagement with recesses 168, for example, although other embodiments are envisioned in which an increase in fluid pressure can move projections 170 into engagement with recesses 168, for example. In any event, in certain embodiments, a spring having a sufficient spring stiffness can be configured to bias projections 170 into their engaged positions, for example, such that, after the fluid pressure has been sufficiently decreased, projections 170 can be engaged with recesses 168. Further to the above, various embodiments can include a button and/or switch which can be actuated in order to adjust the fluid pressure and, in some embodiments, a computer controller can be utilized to adjust the pressure by operating a pump and/or motor, for example. While hydraulic fluid may be suitable or preferred in many circumstances, any suitable fluid can be utilized, such as air, nitrogen, and/or carbon dioxide, for example, to operate one or more cylinders engaged with projections 170.

In various embodiments, also not illustrated, one or more electric motors can be mounted to body portion 164 of second jaw member 156, for example, which can be configured to rotate projections 170 into and out of engagement with recesses 168. In at least one embodiment, a first electrical current and/or voltage can be supplied to the motors to rotate projections 170 in a first direction and a second electrical current and/or voltage can be supplied to the motors to rotate projections 170 in a second, or opposite, direction. In at least one such embodiment, one or more switches, relays, and/or computers can be utilized to reverse the direction in which the current is flowing to the motors and/or reverse the polarity of voltage supplied to the motors in order to selectively engage and disengage projections 170 with recesses 168. Further to the above, while projections 170 can be rotated into and out of engagement with recesses 168, embodiments are envisioned in which projections can be translated into engagement with recesses 168. In at least one such embodiment, a cylinder can displace a projection between first and second positions along a predetermined path such that projection is engaged with a recess 168 when it is in its first position and suitably disengaged from the recess 168 when it is in its second position. In at least one embodiment, the projection can be displaced along a linear, or at least substantially linear, path; however, embodiments are envisioned in which the projections can be translated along any suitable path including curved and/or curvi-linear paths, for example. In certain embodiments, second jaw member 156 can include one or more guides configured to guide the projections as they are moved by the cylinders. In various embodiments, one or more motors can be utilized to translate a projection into and out of engagement with recesses 168, for example, wherein the motors can be operably engaged with one or more pinions and/or racks configured to displace the projections along a predetermined path.

In certain embodiments, the range of orientations through which projection 170 can be rotated can be limited by one or more of the surfaces of recess 168 when toggle 130 is rotated into its upward, or engaged, position. When toggle 130 is rotated into its downward, or disengaged, position, the movement of projection 170 can be limited by a stop, such as stop 149 (FIGS. 31 and 41), for example, extending from side plate 167. In various embodiments, although not illustrated, a toggle may not include locking features, such as the detent mechanisms and/or actuator mechanisms described above, for example, and may be readily movable between its engaged and disengaged positions. In at least one embodiment, a toggle may be biased into its engaged and/or disengaged positions by a biasing element, such as a spring, for example. In at least one such embodiment, the biasing element can comprise a torsion spring engaged with side plate 167 and toggle 130, for example, which can be configured to bias toggle 130 into its engaged position. In such embodiments, projection 170 can be biased into engagement with recesses 168 to lock second jaw member 156 in position, thereby requiring a force to be applied to toggle 130 to overcome the biasing force. In certain other embodiments, although not illustrated, a linear spring can be attached to toggle 130 such that the toggle-spring arrangement is dynamically stable only when toggle 130 is in its engaged or disengaged positions. Stated another way, a spring force can be applied to toggle 130 such that toggle 130 will not remain stationary if left in any other position other than its engaged or disengaged positions. In such embodiments, the toggle may be biased into its engaged position if it is nearly engaged and, similarly, the toggle may be biased into its disengaged position if it is nearly disengaged.

In various embodiments, including the illustrated embodiment, a movable jaw member can include two connection members 162, wherein the connection members 162 can be positioned on different, or opposite, sides of base 152. In other embodiments, although not illustrated, a movable jaw member may only include one connection member or, alternatively, more than two connection members. Similarly, various embodiments, including the illustrated embodiment, may comprise two racks 166, but other embodiments are envisioned which comprise only one rack or, alternatively, more than two racks. In any event, as outlined above, toggles 130 can be moved into their disengaged positions to allow second jaw member 156 to be moved toward and/or away from a workpiece in large distances. Once second jaw member 156 is positioned against or adjacent to the workpiece, the toggles 130 can be moved into their engaged positions in order to position projections 170 within recesses 168 and lock second jaw member 156 to racks 166. Thereafter, it may be desirable to move second jaw member 156 toward and/or away from the workpiece in smaller distances. In various embodiments, similar to the above, racks 166 and, correspondingly, second jaw member 156, can be advanced toward the workpiece by a drive member or system as described in greater detail below.

Figure 23:
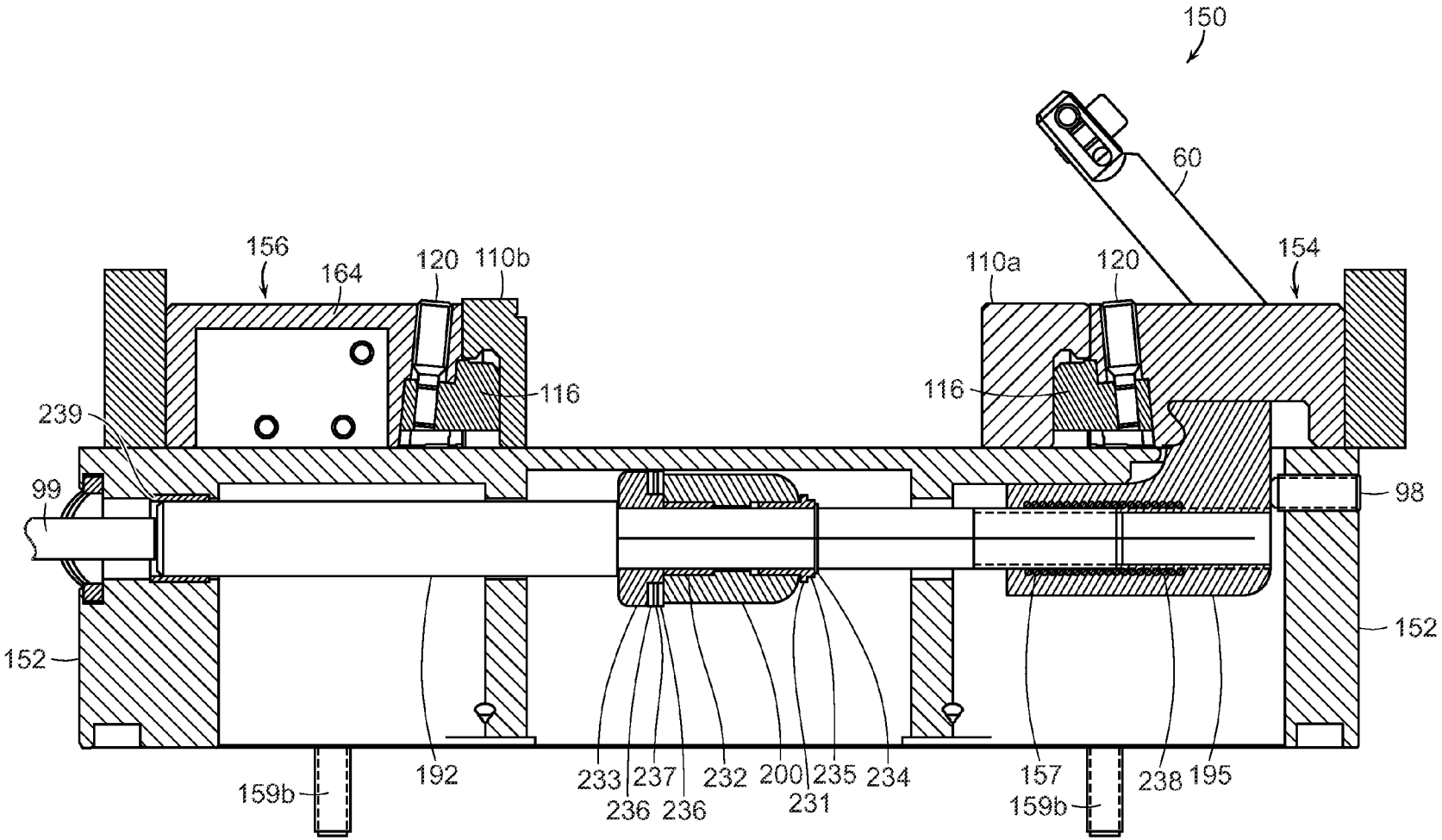
FIG. 23 is a cross-sectional view of the workholding device of FIG. 17 taken along line 23-23 in FIG. 22.
Figure 49:
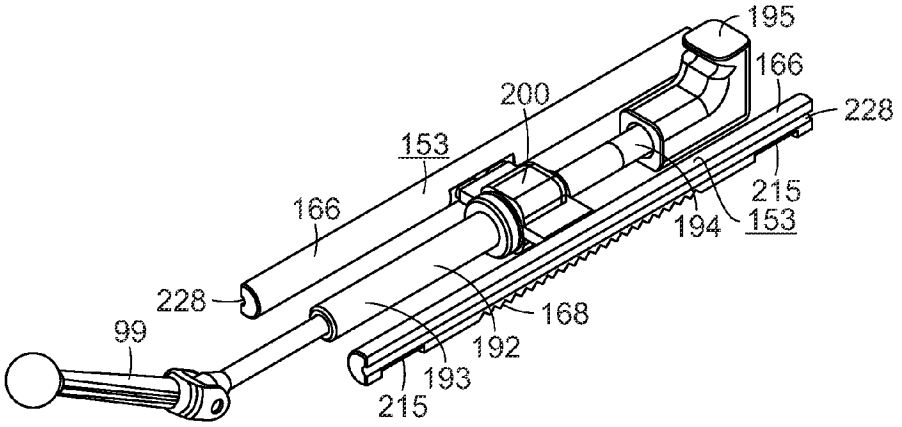
FIG. 49 is a perspective view of the adjustment rack assembly of the workholding device of FIG. 17.
Figure 50:
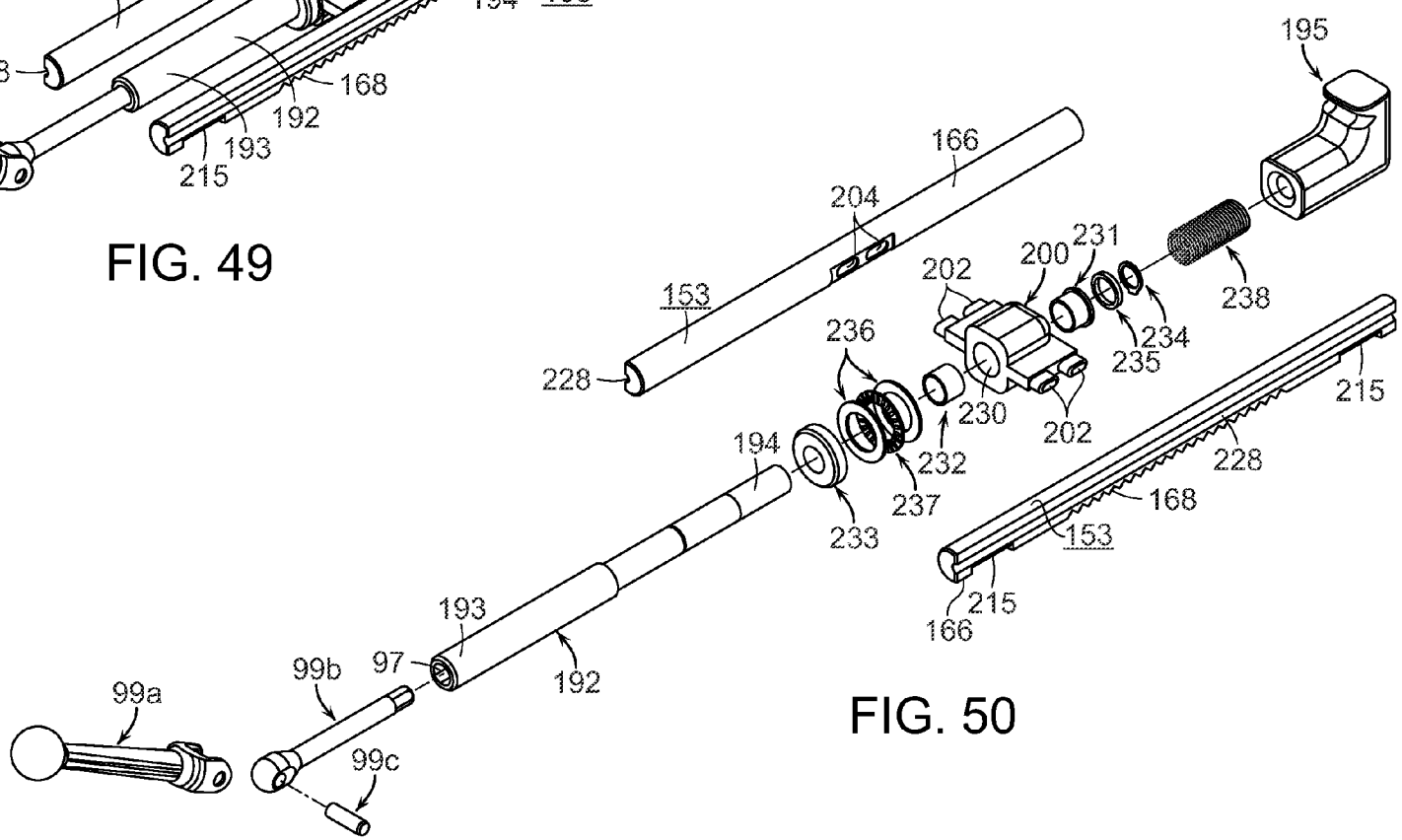
FIG. 50 is an exploded view of the adjustment rack assembly of FIG. 49.

In various embodiments, referring to FIGS. 23, 49, and 50, the drive system can include drive member 192, wherein drive member 192 can include first end 193 and second end 194, and wherein second end 194 can be threadably engaged with connection member 195 of first jaw member 154, for example. In at least one such embodiment, connection member 195 can include a threaded aperture 157 configured to threadably receive second end 194 such that, when drive member 192 is rotated about an axis, drive member 192 can be translated relative to base 152 and first jaw member 154. In certain embodiments, referring to FIGS. 23 and 50, a coiled insert 238 can be positioned within aperture 157 to assist in securing and/or positioning drive member 192 within aperture 157. In various embodiments, the drive system can further include crossbar 200 mounted to drive member 192 wherein, when drive member 192 is rotated about its axis, crossbar 200 can be advanced toward and/or retracted away from first jaw member 154 along the axis of drive member 192 depending on the direction, i.e., clockwise or counterclockwise, in which drive member 192 is rotated. In at least one embodiment, racks 166 can be operably engaged with crossbar 200 such that, when crossbar 200 is translated relative to first jaw member 154 by drive member 192, racks 166 can be translated relative to first jaw member 154 by crossbar 200. In at least one such embodiment, referring to FIG. 50, crossbar 200 can include one or more projections 202 extending therefrom which can be configured to fit within apertures or slots 204 in racks 166 such that the drive force created by drive member 192 can be transferred into racks 166. In at least one embodiment, projections 202 can be closely received within slots 204 such that there is little, if any, relative movement therebetween. In certain embodiments, projections 202 can be press-fit and/or snap-fit into slots 204. In various embodiments, referring to FIG. 19, base 152 can include one or more grooves or recesses 151 which can be configured to slidably receive racks 166. In at least one such embodiment, the back sides 153 of racks 166 can include an arcuate, circular, and/or at least partially circular profile which can be closely received by the corresponding profiles of recesses 151.

In various embodiments, crossbar 200 can be press-fit onto drive member 192 such that there is little, if any, relative movement therebetween. In at least one embodiment, referring to FIGS. 23 and 50, crossbar 200 can be mounted to drive member 192 via one or more bearings, bushings, collars, and/or retaining rings, for example. In certain embodiments, crossbar 200 can include aperture 230 extending therethrough which can be configured to receive bushings 231 and 232 therein, wherein, in at least one embodiment, bushings 231 and 232 can be sized and configured to provide a close fit between crossbar 200 and drive member 192. In at least one such embodiment, bushing 231 and/or bushing 232 can be configured to prevent, or at least reduce, radial, movement of crossbar 200 relative to drive member 192. In various embodiments, referring again to FIGS. 23 and 50, the axial position of crossbar 200 with respect to drive member 192 can be controlled by back-up ring 233 and retaining ring 234. In at least one embodiment, back-up ring 233 and/or retaining ring 234 can be securely affixed to drive member 192 such that crossbar 200 can be captured therebetween. In at least one such embodiment, crossbar 200 can be secured between back-up ring 233 and retaining ring 234 such that there is little, if any, relative axial movement between crossbar 200 and drive member 192. In certain embodiments, a spacer, such as spacer 235, for example, can be utilized to fill one or more gaps between crossbar 200 and rings 233 and 234. In use, the reader will appreciate that crossbar 200 is mounted to drive bar 192 such that crossbar 200 does not rotate, or at least substantially rotate, when drive bar 192 is rotated to advance or retract racks 166 as described above. In certain embodiments, however, back-up ring 233, retaining ring 234, and/or spacer 235, for example, may rotate with drive member 192 and, correspondingly, rotate relative to crossbar 200. In various embodiments, one or more bearings can be utilized to facilitate the relative movement of back-up ring 233, retaining ring 234, and/or spacer 235 relative to crossbar 200. In at least one embodiment, referring again to FIG. 50, a bearing comprising washers 236 and bearing plate 237 can be utilized, wherein at least one rotational degree of freedom can be obtained via the relative movement of bearing plate 237 with respect to washers 236. Further to the above, in at least one embodiment, the first end 193 of drive member 192 can be rotatably supported by a bearing or bushing 239 (FIG. 23) in base 152, for example.

Figure 51:
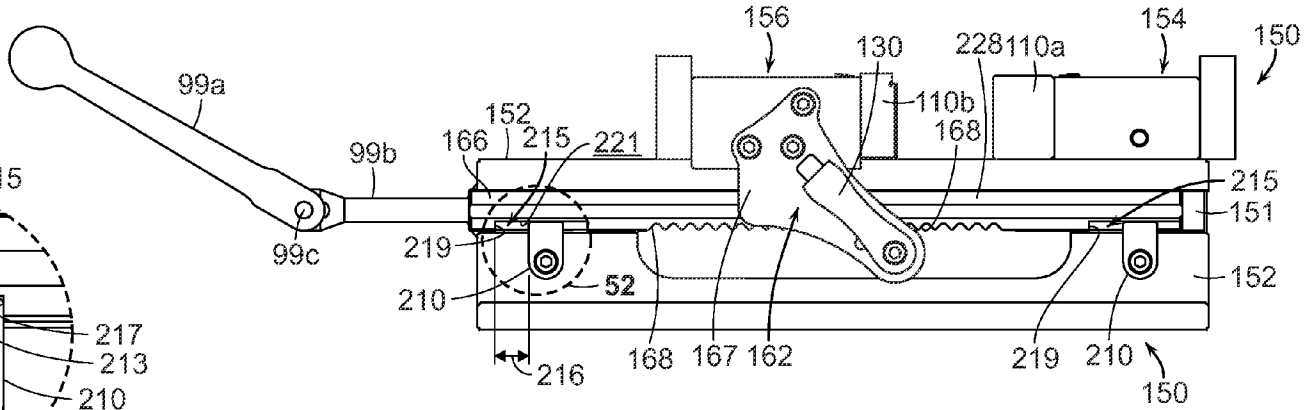
FIG. 51 is an elevational view of the workholding device of FIG. 17 illustrating the adjustment rack assembly of FIG. 49 in a first position.
Figure 52:
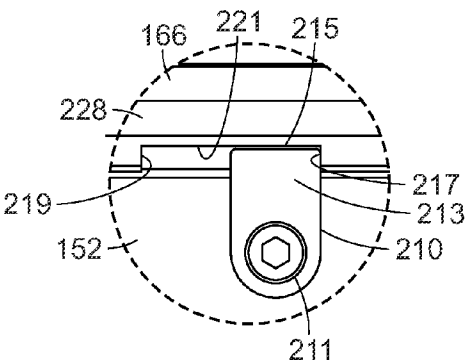
FIG. 52 is a detail view of a keeper assembly mounted to the workholding device of FIG. 17 configured to limit the movement of the adjustment rack assembly of FIG. 49.
Figure 53:
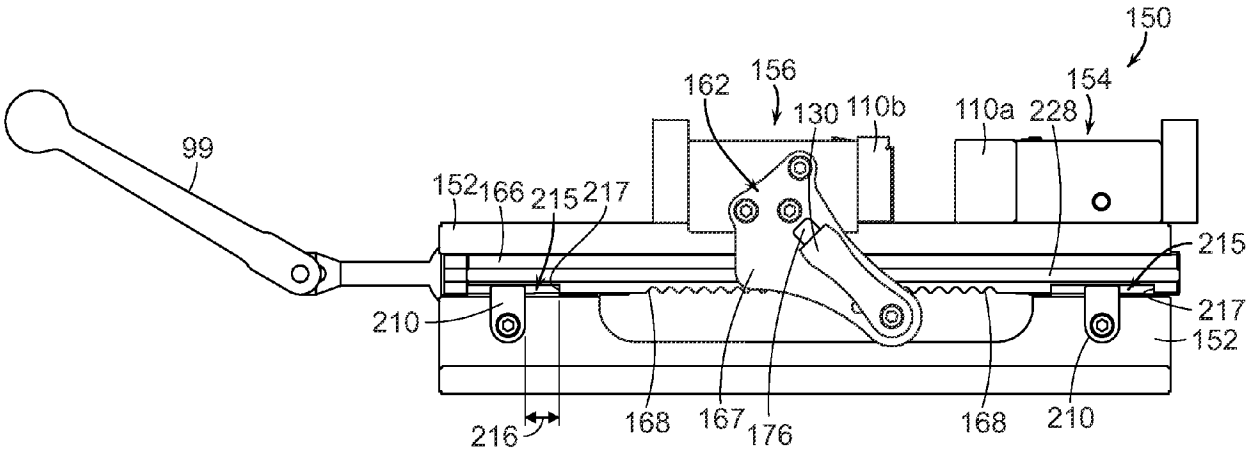
FIG. 53 is an elevational view of the workholding device of FIG. 17 illustrating the adjustment rack assembly of FIG. 49 advanced into a second position.

In various embodiments, further to the above, racks 166 can be advanced a suitable distance in order to position jaw plate 110*b*, for example, of second jaw member 156 against a workpiece. In at least one embodiment, workholding device 150 can further include travel stops which can be configured to limit the travel of racks 166. In certain embodiments, referring to FIGS. 51-53, workholding device 150 can further include one or more keepers 210 mounted to base 152, for example, wherein, in at least the illustrated embodiment, two keepers 210 can be utilized to limit each rack 166, although any suitable amount of keepers can be utilized. As illustrated in FIG. 52, each keeper 210 can be mounted to base 152 by one or more fasteners 211 inserted through apertures 212 (FIG. 54) in keeper bodies 213, wherein keepers 210 can be positioned on opposite ends of base 152. In various embodiments, referring to FIGS. 51-53, racks 166 can include channels, or cut-outs, 215 which can be configured to receive at least the upper portions of keepers 210, for example, such that the sidewalls of cut-outs 215 can abut keepers 210 when racks 166 are advanced a pre-determined distance, such as distance 216, for example. In at least one such embodiment, distance 216 can be approximately 20 mm. In use, racks 166 can be moved between a first position, as illustrated in FIGS. 51 and 52, in which first walls 217 of channels 215 can be positioned adjacent to, or against, keepers 210 and a second position as illustrated in FIG. 53. In the second position of racks 166, second walls 219 of channels 215 can be positioned adjacent to, or against, keepers 210. In various embodiments, as a result, the first and second walls 217, 219 of channels 215 can define the limits in which racks 166 can be moved relative to base 152 and/or first jaw member 154.

Figure 54:
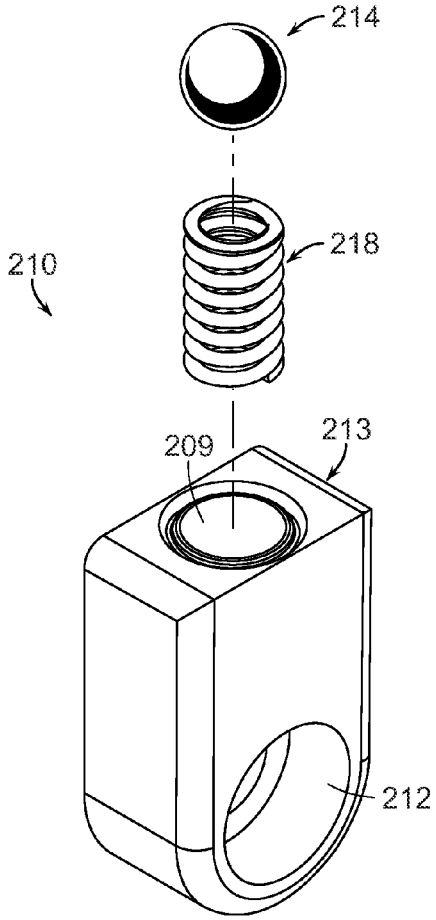
FIG. 54 is an exploded view of the keeper assembly of FIG. 52.

In various embodiments, keepers 210, for example, can be configured to bias racks 166 against the sidewall of recesses 151 in order to reduce play, or unwanted lateral movement, between racks 166 and base 152, for example. In at least one embodiment, referring to FIGS. 22 and 54, each keeper 210 can be configured to apply an upward biasing force to racks 166 in order to position racks 166 against the upper sidewall of recesses 151. In such circumstances, unwanted lateral movement in the vertical direction can be prevented, or at least reduced. Furthermore, owing to the cooperating arcuate surfaces of recesses 151 and back surfaces 153 of racks 166, the upward biasing force applied to racks 166 can bias racks 166 inwardly toward base 152 as well. In such circumstances, racks 166 can be positioned against the inner sidewalls of recesses 151 so as to prevent, or at least limit, outward lateral movement of racks 166. In various embodiments, referring to FIG. 54, each keeper 210 can include a ball-spring arrangement configured to apply the biasing force to racks 166 described above. More particularly, in at least one embodiment, each keeper 210 can include an aperture 209 configured to receive a ball 214 and a ball spring 218 configured to bias ball 214 against an upper surface 221 of a channel 215 (FIG. 52). As illustrated in FIG. 54, ball spring 218 can comprise a compression spring and ball 214 can comprise a spherical, or at least substantially spherical, element; however, other embodiments are envisioned in which the ball spring can comprise any suitable biasing element, such as a elastomeric or resilient material or member, for example, and the ball 214 can comprise any suitably shaped member which can transmit a biasing force to racks 166 and hold them in position.

In various embodiments, further to the above, side plates 167 can include one or more biasing elements configured to prevent, or at least reduce, unwanted lateral movement of racks 166. In at least one embodiment, referring primarily to FIGS. 34 and 45, each side plate 167 can include one or more apertures 225 configured to receive one or more biasing elements 226. Similar to the above, biasing elements 226 can be configured to apply a biasing force to racks 166 such that the back surfaces 153 of racks 166 can be positioned and held against the sidewalls of recesses 151. In at least one embodiment, each biasing element 226 can include a ball-spring arrangement configured to bias a ball 227 against racks 166. Biasing elements 226 can be secured within apertures 225 in any suitable manner including snap-fit and/or press-fit arrangements. In at least one embodiment, referring to FIGS. 31 and 33, biasing elements 226 can be threaded into apertures 225. In any event, referring to FIGS. 49 and 50, each rack 166 can further include one or more grooves or channels, such as grooves 228, for example, which can be configured to receive at least a portion of balls 227 therein. In at least one embodiment, grooves 228 can define an arcuate profile which can closely receive the profile of balls 227 such that the balls 227 of biasing elements 226 can bias racks 166 against the inner sidewalls of recesses 151, for example. In various embodiments, although not illustrated, each biasing element 226 can comprise any suitable biasing element, such as a elastomeric or resilient material or member, for example, and the balls 227 can comprise any suitably shaped member which can transmit a biasing force to racks 166 and hold them in position.

In various embodiments, workholding devices can include one or more features for securing the workholding devices to a table top and/or support surface of a machine. In at least one embodiment, referring to FIGS. 17-23, base 152 of workholding device 150 can include securement surfaces 155 which can be engaged by one or more clamping brackets 159*a* in order to position and secure the workholding device. In at least one such embodiment, fasteners 159*b* can be inserted through apertures in clamping brackets 159*a* in order to secure the workholding device in position and apply a clamping force thereto via the tightening of fasteners 159*b*.

Figure 55:
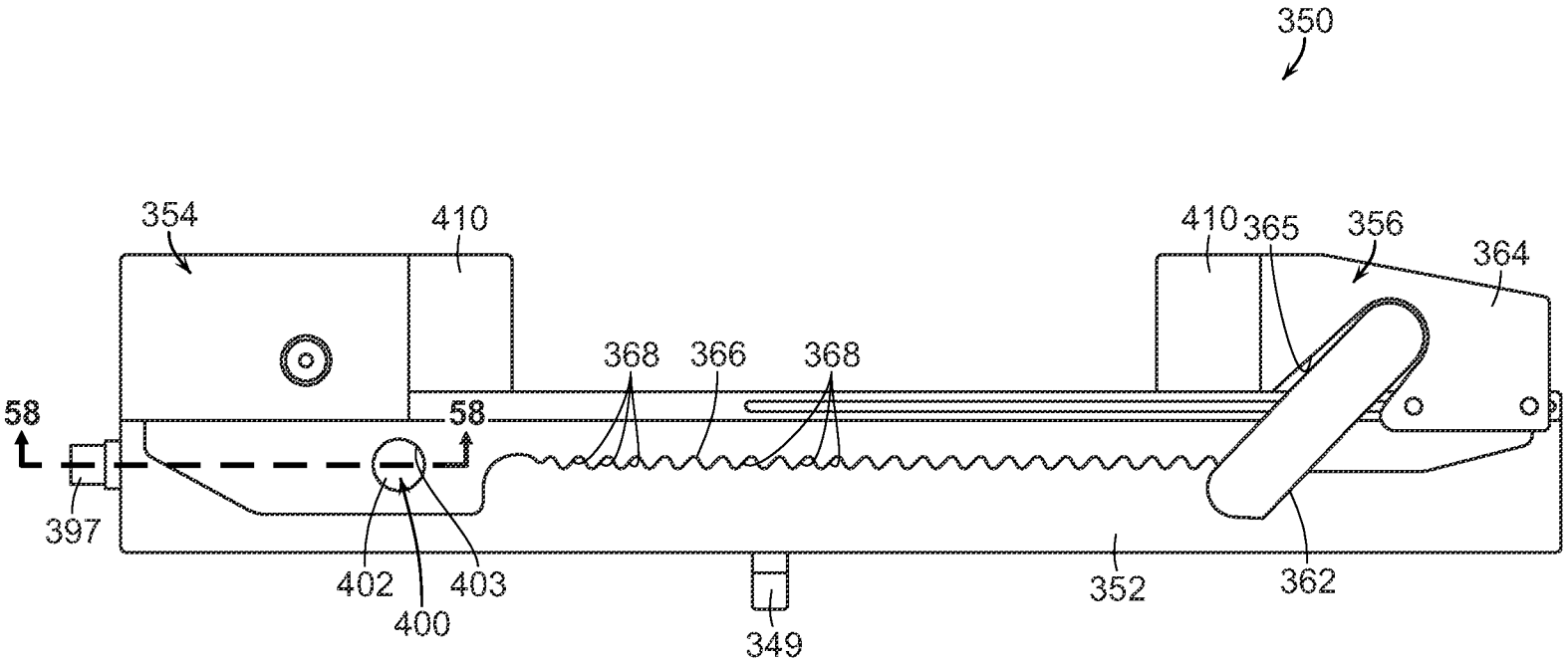
FIG. 55 is an elevational view of an exemplary workholding device in accordance with an embodiment of the present invention.
Figure 56:
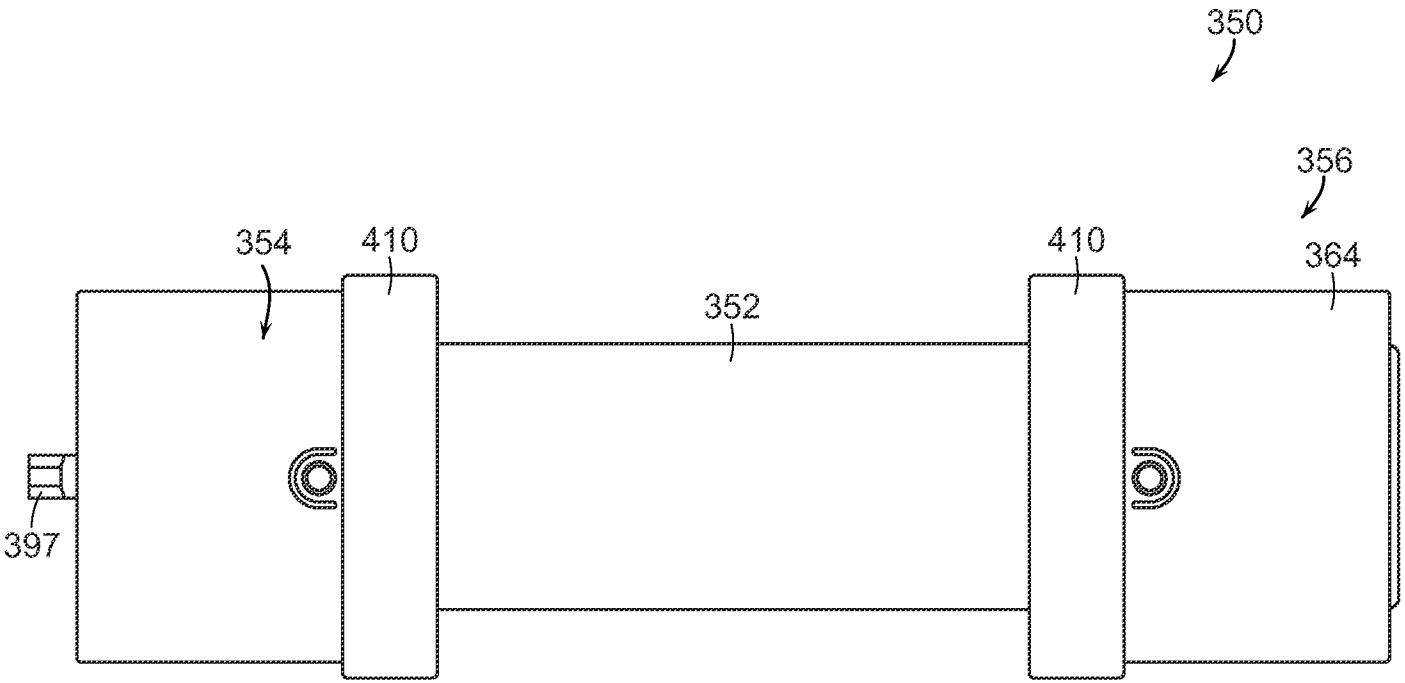
FIG. 56 is a top view of the workholding device of FIG. 55.
Figure 57:
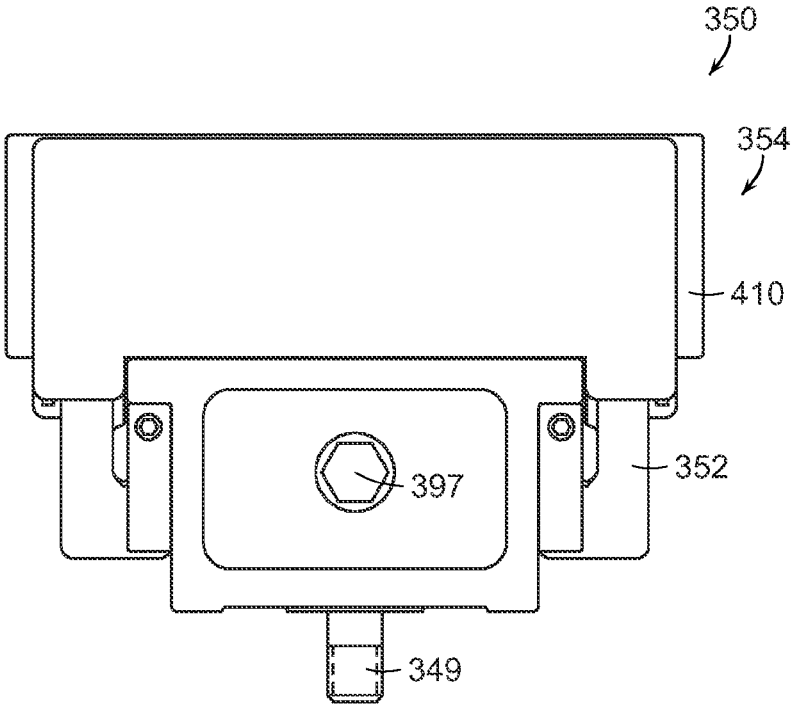
FIG. 57 is a side elevational view of the workholding device of FIG. 55.

An exemplary embodiment of a workholding device 350 is illustrated in FIGS. 55 and 56. The workholding device can include a base 352, a first jaw 354, and a second jaw 356 wherein, in at least one embodiment, the first jaw 354 and/or the second jaw 356 can include a jaw plate 410 configured to engage a workpiece positioned therebetween. In certain embodiments, referring to FIGS. 55 and 57, the base 352 can include a locating pin, such as locating pin 349, for example, which can be configured to position and/or orient the workholding device 350 within a milling machine, for example. Similar to various embodiments described herein, the second jaw 356 can be moved toward and/or away from the first jaw 354. In various embodiments, referring to FIG. 58, the second jaw 356 can be moved relative to the first jaw 354 by a drive system including a drive member 392 and a bridge, or crossbar, 400. In at least one such embodiment, the bridge 400 can comprise a threaded aperture 401 which can be configured to threadably receive a threaded portion 394 of the drive member 392. In use, a crank, for example, can be attached to a drive end 397 of the drive member 392 to rotate the drive member 392 and, at the same time, advance and/or retract the bridge 400 along a longitudinal axis, for example. More specifically, in at least one embodiment, the bridge 400 can be constrained within the base 352 such that the rotation of the bridge 400 can be prevented, or at least limited, when the drive member 392 is rotated and yet, owing to the threaded engagement between the drive member 392 and the bridge 400, the rotation of drive member 392 can translate, or displace, the bridge 400 along a defined path.

Figure 58:
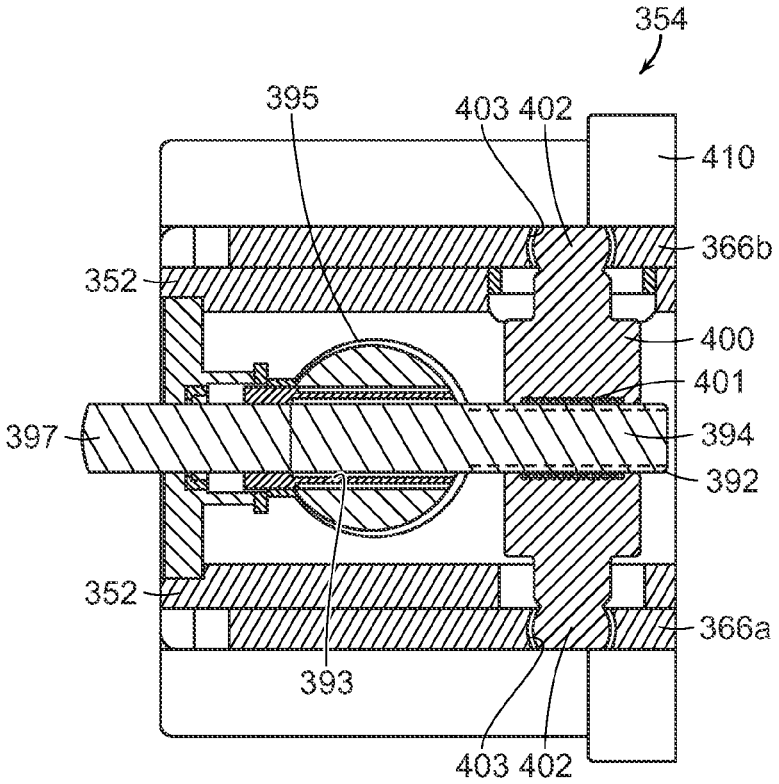
FIG. 58 is a cross-sectional view of a drive system of the workholding device of FIG. 55 taken along line 58-58 in FIG. 55.

In various embodiments, further to the above, the drive system can further comprise one or more lateral members, or racks, 366 which can be operably engaged with the bridge 400 and slidably supported by the base 352. In at least one such embodiment, the drive system can comprise a first lateral member 366*a* extending along a first lateral side of the base 352 and a second lateral member 366*b* extending along a second lateral side of the base 352. Referring primarily to FIGS. 55 and 58, each lateral member 366*a*, 366*b* can include an opening, or aperture, 403 defined therein which is configured to receive an end 402 of the bridge 400 such that, when the bridge 400 is advanced and/or retracted by the drive member 392, as described above, the racks 366*a*, 366*b* can be advanced and/or retracted, respectively, by the bridge 400. Similar to various embodiments described herein, the second jaw 356 can comprise one or more connector members, or links, 362*a* and 362*b* which can be selectively engaged with the lateral members 366*a* and 366*b*, respectively. In at least one such embodiment, each lateral member 366*a*, 366*b* can comprise an array of notches, or recesses, 368 which can be configured to receive at least a portion of a link 362*a*, 362*b* therein and, as a result, secure the second jaw 356 to the drive system. In various embodiments, each link 362*a*, 362*b* can be selectively rotated between a first position in which they are operably engaged with the lateral members 366*a*, 366*b* and a second position in which they are operably disengaged from the lateral members 366*a*, 366*b*, respectively. When one or both of the links 362*a*, 362*b* is operably engaged with the lateral members 366*a*, 366*b*, the drive system can move the second jaw 356 toward and/or away from the first jaw 354. When both of the links 362*a*, 362*b* have been operably disengaged from the lateral members 366*a*, 366*b*, the drive system may not motivate the second jaw 356 and, in such circumstances, the second jaw 356 can be moved toward and/or away from the first jaw 354 independently of the drive system.

In accordance with various embodiments described herein, the first jaw 354 can also be operably engaged with the drive member 392. In at least one embodiment, the drive system can further include a hook 395 which is operably engaged with the drive member 392 such that, when the drive member 392 is rotated to position and clamp the second jaw 356 against a workpiece, the hook 395 can apply a clamping force to the workpiece through the first jaw 354 at the same time. In at least one such embodiment, the hook 395 can include an aperture 393 defined therethrough which is configured to receive the drive member 392 in an operative engagement therebetween.

Figure 59:
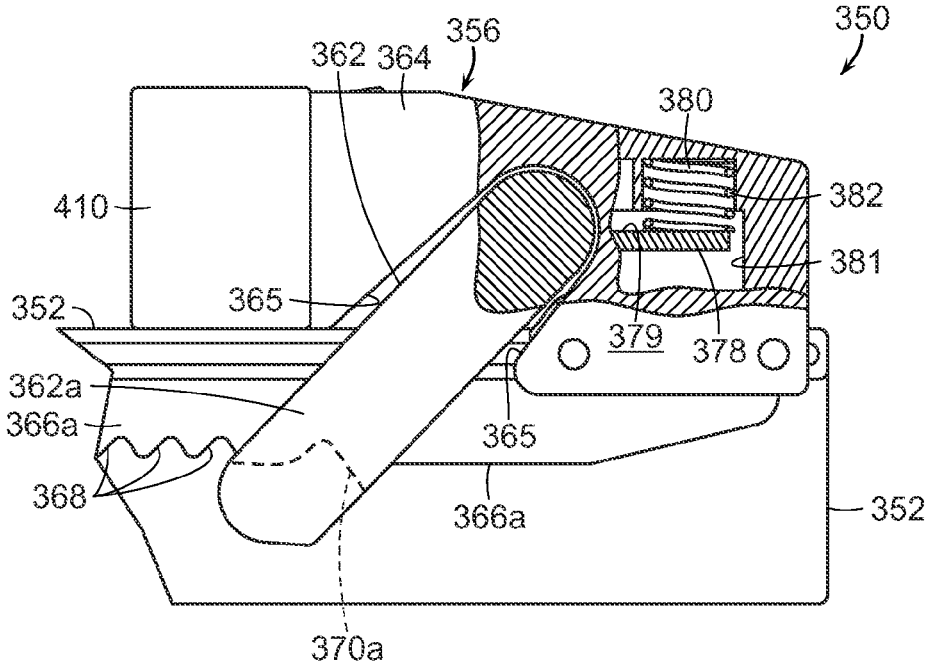
FIG. 59 is a detail view of a second jaw of the workholding device of FIG. 55 with portions removed to illustrate an internal cavity in the second jaw.

Further to the above, referring now to FIG. 59, the second jaw 356 can comprise a housing 364. In various embodiments, the links 362*a*, 362*b* can be rotatably mounted to the housing 364. In at least one such embodiment, referring to FIG. 63, the housing 364 can comprise apertures 369 defined in opposite sides of the housing 364 which can be configured to closely receive projections 373*a* and 373*b* (FIG. 61) which extend from link members 362*a* and 362*b*, respectively. The apertures 369 can be sized and configured such that the movement of the projections 373*a*, 373*b* within the apertures 369 is limited to rotation about a common axis extending between the centers of the apertures 369, for example. In certain embodiments, the projections 373*a*, 373*b* can each comprise a circular outer profile defined by a diameter which is equal to, or at least substantially equal to, a diameter which defines the perimeter of apertures 369. In various embodiments, the housing 364 can further comprise an inner cavity 381 into which the projections 373*a* and 373*b* can extend. In various embodiments, discussed in greater detail further below, each projection 373*a*, 373*b* can also comprise at least one flat, or at least substantially flat, drive surface 375 extending inwardly into the inner cavity 381.

Figure 60:
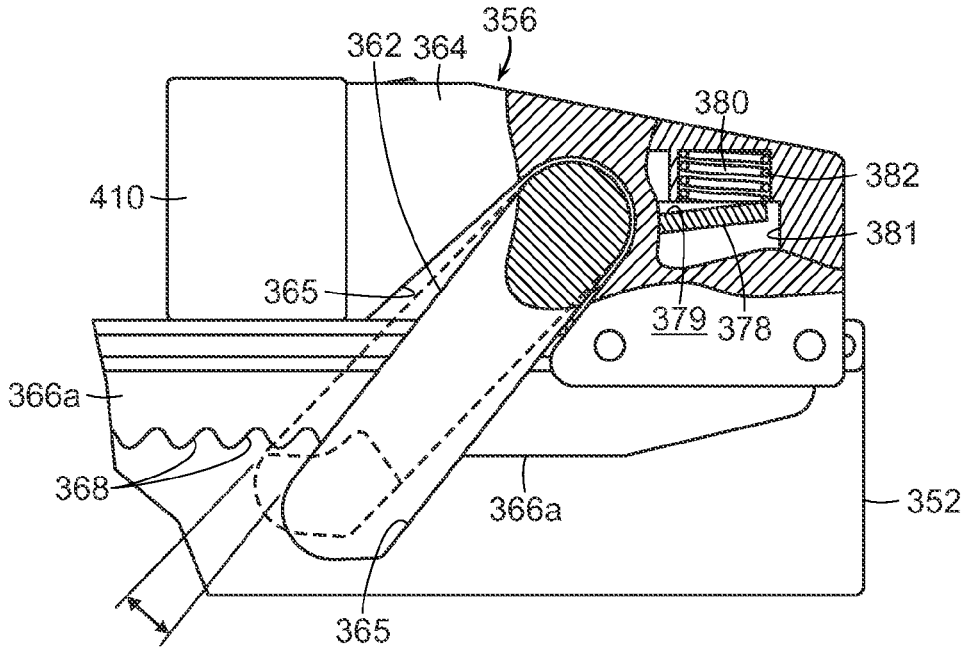
FIG. 60 is a detail view of the second jaw of FIG. 59 illustrating a link member rotated downwardly and disengaged from the drive system of FIG. 58.

As discussed above, each link 362*a*, 362*b* can be rotated between a first, engaged, position, as illustrated in FIG. 59, and a second, disengaged, position, as illustrated in FIG. 60. As the reader will understand, FIG. 60 depicts the link 362*a* in its engaged position, illustrated with phantom lines, and in its disengaged position illustrated with solid lines. In various embodiments, referring primarily to FIG. 61, each link 362*a*, 362*b* can comprise at least one lock projection, such as projections 370*a*, 370*b*, respectively, configured to engage the lateral members 366*a*, 366*b* when the links 362*a*, 362*b* are in their engaged positions. In at least one embodiment, each notch 380 defined in the lateral members 362*a*, 362*b* can be configured to receive the projections 370*a*, 370*b*. In certain embodiments, referring again to FIGS. 59 and 60, the second jaw housing 364 can further comprise a first recess 365 defined in a first lateral side thereof which can be configured to receive at least a portion of the first link 362*a*. In at least one such embodiment, a portion of the first link 362*a* can extend out of the first recess 365 and can be configured to be grasped by an operator of the workholding device. As the reader can see in FIG. 60, the first recess 365 is sized and configured to accommodate the movement of the first link 362*a* between its engaged position and its disengaged position. Similarly, the second jaw housing 364 can comprise a second recess 365 defined in a second lateral side thereof which can be configured to receive at least a portion of the second link 362*b*. In at least one such embodiment, a portion of the second link 362*b* can extend out of the second recess 365 and can be configured to be grasped by an operator of the workholding device. Similar to the above, the second recess 365 is sized and configured to accommodate the movement of the second link 362*b* between its engaged position and its disengaged position.

In some embodiments, the first link 362*a* can be moved independently of the second link 362*b*. In at least one such embodiment, for instance, the first link 362*a* can be moved between its engaged position and its disengaged position, for example, while the second link 362*b* remains in either one of its engaged or disengaged positions. Correspondingly, for instance, the second link 362*b* can be moved between its engaged position and its disengaged position while the first link 362*a* remains in either one of its engaged or disengaged positions. In various circumstances, the operator of such a workholding device may operate both the first link 362*a* and the second link 362*b* simultaneously in order to keep both of the links 362*a* and 362*b* in the same position. In certain other embodiments, the first link 362*a* and the second link 362*b* can be connected to one another. In at least one such embodiment, referring now to FIGS. 61-63, the second jaw 356 can comprise one or more connection members extending through and/or positioned within the housing 364 which can connect the first link 362*a* to the second link 362*b*. In certain embodiments, a connecting plate 378 can connect the links 362*a* and 362*b*. In various embodiments, the connecting plate 378 can be configured to transmit movement between the links 362*a* and 362*b*. In at least one embodiment, the rotation of the first link 362*a* can be transmitted to the second link 362*b* such that, when the first link 362*a* is moved from its engaged position to its disengaged position, the second link 362*b* can be rotated from its engaged position to its disengaged position as well. Correspondingly, the rotation of the second link 362*b* can be transmitted to the first link 362*a* such that, when the second link 362*b* is moved from its engaged position to its disengaged position, the first link 362*a* can be rotated from its engaged position to its disengaged position as well. In such circumstances, as a result, an operator of the workholding device may only be required to manipulate either the first link 362*a* or the second link 362*b* in order to move both of the links 362*a*, 362*b* between their engaged and disengaged positions.

Figure 61:
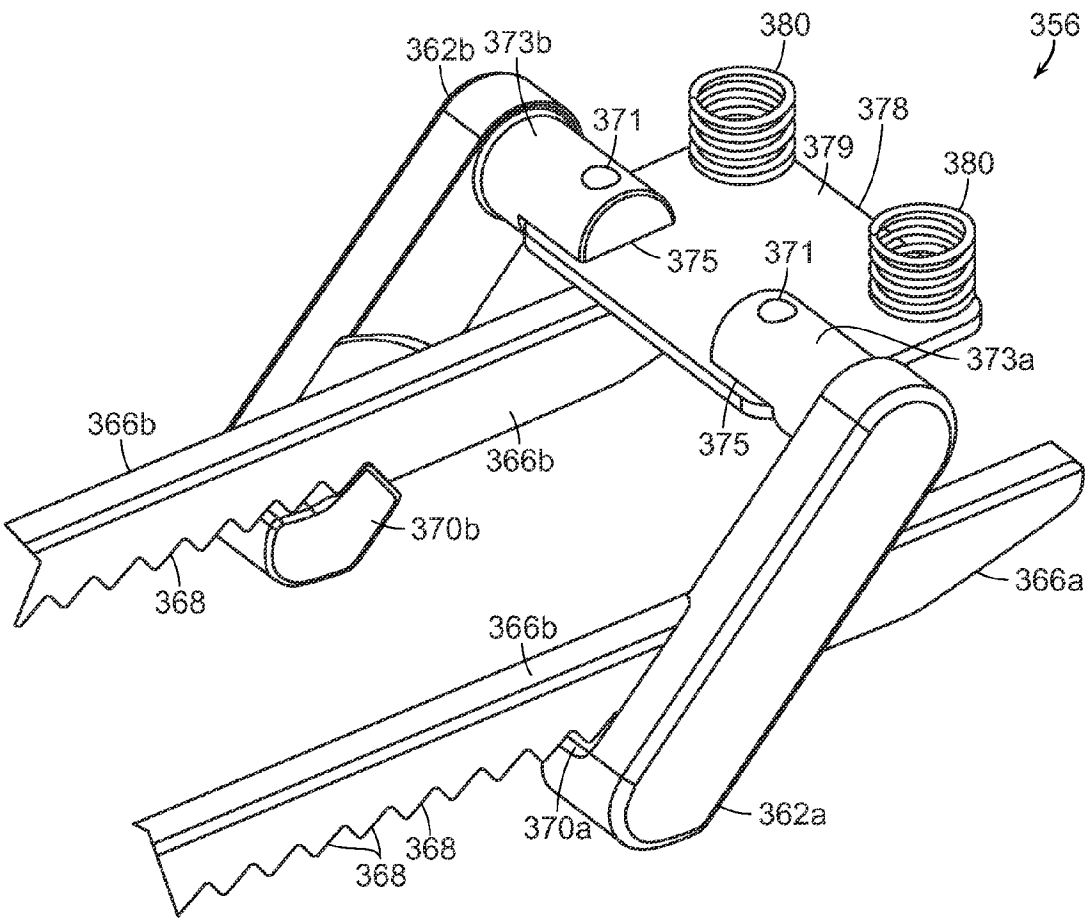
FIG. 61 is a perspective view illustrating the link member of FIG. 60 and a second link member connected to a connection plate positioned within the internal cavity of the second jaw and, in addition, a spring positioned and arranged to apply a biasing force to the connection plate.
Figure 62:
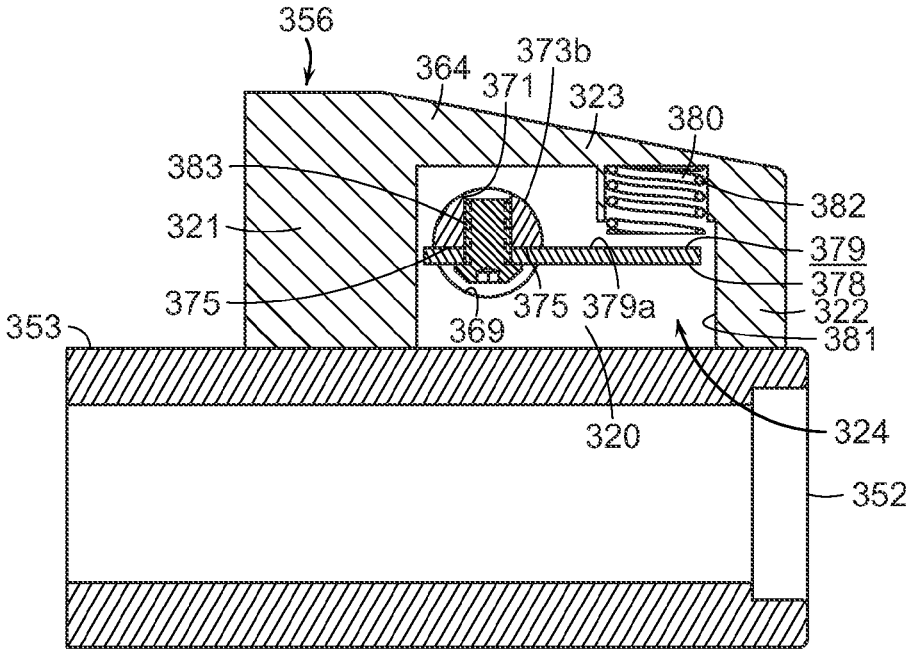
FIG. 62 is a cross-sectional view of the second jaw of the workholding device of FIG. 55 illustrating that the link members of FIG. 61 are fastened to the connection plate.
Figure 63:
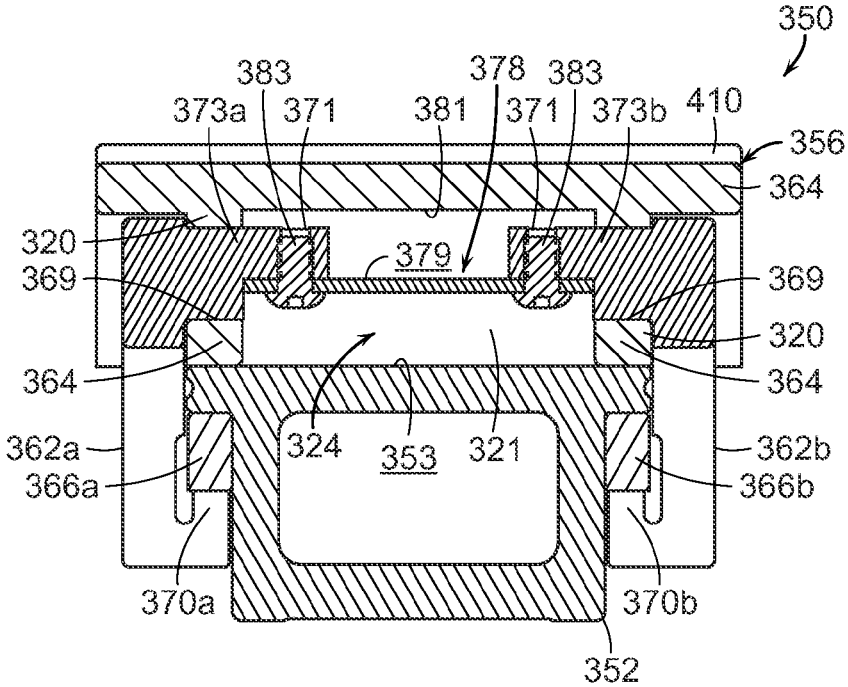
FIG. 63 is another cross-sectional view of the second jaw of FIG. 62.

In various embodiments, as illustrated in FIGS. 62 and 63, each projection 373*a*, 373*b* can comprise an aperture, or through hole, 371 extending therethrough which can each be configured to receive at least one fastener 383, such as a screw, bolt, and/or rivet, for example. In at least one such embodiment, the connecting plate 378 can also comprise one or more apertures, or through holes, extending therethrough which can be aligned with the apertures 371 defined in the projections 373*a*, 373*b*. In such embodiments, the fasteners 383 can be threaded through the apertures in the projections 373*a*, 373*b* and the connecting plate 378 to retain the connecting plate 378 to the projections 373*a*, 373*b*. In certain embodiments, the fasteners 383 can be threadably engaged with the projections 373*a*, 373*b* and the connecting plate 383. In at least one embodiment, the fasteners 383 can comprise self-drilling and/or self-tapping features, for example. In various embodiments, referring again to FIGS. 61 and 62, the connecting plate 378 can be comprised of a generally planar sheet of material and can comprise any suitable shape, such as a rectangle, for example. In at least one embodiment, the connecting plate 378 can comprise a top surface 379 which can be flat, or at least substantially flat, when the connecting plate 378 is in an unflexed configuration. In various embodiments, the top surface 379 can be positioned adjacent to and/or in abutting contact with the drive surfaces 375 defined on the projections 373*a* and 373*b*. In at least one such embodiment, the fasteners 383 can be utilized to hold the connecting plate 3783 in position relative to the drive surfaces 375 such that little, if any, relative movement exists between the connecting plate 378 and the projections 373*a*, 373*b*. Thus, referring again to FIGS. 59 and 60, when the first link 362*a*, for example, is rotated downwardly to disengage the first link 362*a* from the first lateral member 366*a*, the drive surface 375 extending from the first link 362*a* and/or the fastener 383 connecting the first link 362*a* to the connecting plate 378 can rotate, or tip, the connecting plate 378 downwardly. As the second link 362*b* is also secured to the connecting plate 378, the second link 362*b* can be rotated downwardly with the first link 362*a*. Similarly, when the second link 362*b* is rotated downwardly to disengage the second link 362*b* from the second lateral member 366*b*, the drive surface 375 extending from the second link 362*b* and/or the fastener 383 connecting the second link 362*b* to the connecting plate 378 can rotate, or tip, the connecting plate 378 downwardly. Likewise, as the first link 362*a* is also secured to the connecting plate 378, the first link 362*a* can be rotated downwardly with the second link 362*b*.

As discussed above, the operator of the workholding device 350 can move the links 362*a*, 362*b* between their engaged and disengaged positions. In various embodiments, the apertures 369 defined in the second jaw housing 364 and the projections 373*a*, 373*b* of the links 362*a*, 362*b* can be configured such that friction forces between the sidewalls of the apertures 369 and the projections 373*a*, 373*b* can resist the movement of the links 362*a*, 362*b*. In certain embodiments, such friction forces could be sufficiently low enough such that the operator can overcome these forces when using the workholding device yet sufficiently high enough such that the friction forces can hold the links 362*a*, 362*b* in position when the links 362*a*, 362*b* are not being moved by the operator. In various embodiments, the second jaw housing 364 can include bearings which can rotatably support the projections 373*a*, 373*b*. In at least one such embodiment, the bearings could be configured to apply a sufficient resistive force to the links 362*a*, 362*b* to keep the links 362*a*, 362*b* in a static position when they are not being moved by the operator. For instance, the bearings could be configured to hold the links 362*a* and 362*b* in their engaged positions until the operator elects to move the links 362*a* and 362*b* out of their engaged positions. In any event, the interface between the projections 373*a*, 373*b* and the sidewalls of the apertures 369 and/or the interface between the projections 373*a*, 373*b* and bearings mounted within the second jaw housing 364 can be configured such that little, if any, debris, fluids, or particulates, for example, can enter into such interfaces and/or into the internal cavity 381. In various embodiments, as described in greater detail below, the second jaw 356 can further comprise one or more biasing members which can be configured to bias the links 362*a*, 362*b* into their engaged positions with the lateral members 366*a*, 366*b*.

In various embodiments, referring again to FIG. 61, the second jaw 356 can comprise springs 380 which can be configured to bias the links 362*a* and 362*b* into their engaged positions. In various embodiments, the springs 380 can comprise compression springs, and/or any other suitable biasing members, for example. In at least one embodiment, the springs 380 can be configured to apply a biasing force, or forces, to the connecting plate 378 which can, in turn, transmit the biasing force, or forces, to the links 362*a*, 362*b*. In certain embodiments, referring to FIG. 59, the springs 380 can be configured to bias the connecting plate 378 into a level, or an at least substantially level, position within the internal cavity 381 which corresponds with the engaged positions of the links 362*a*, 362*b*. For the purposes of describing this embodiment, then, such a level position of the connecting plate 378 can be referred to as an engaged position.

As illustrated in FIGS. 59 and 62, further to the above, the springs 380 can be positioned intermediate the connecting plate 378 and a portion of the housing 364. As illustrated in FIG. 59, the springs 380 can be in contact with the housing 364 and the connecting plate 378 when the connecting plate 378 is in its engaged position, described above. In at least one such embodiment, the springs 380 may be in a compressed state between the connecting plate 378 and the housing 364 when the connecting plate 378 is in its engaged position while, in other embodiments, the springs 380 may be in an uncompressed state when the connecting plate 378 is in its engaged position. In either event, the rotation of the links 362*a*, 362*b* into their disengaged positions and the connecting plate 378 into its tilted position, as illustrated in FIG. 60, can cause a portion of the connecting plate 378 to move upwardly and resiliently compress the springs 380. For the purposes of describing this embodiment, then, such a tilted position of the connecting plate 378 can be referred to as a disengaged position.

Once the operator of the workholding device 350 has moved the links 362*a*, 362*b*, and the connecting plate 378, into their disengaged positions, the operator can slide the second jaw 356 relative to the base 352 and the lateral members 366*a*, 366*b*. In such circumstances, the operator may hold the links 362*a*, 362*b* in their disengaged positions in order to resist the biasing forces generated by the springs 380. When the operator is satisfied with the position of the second jaw 356, the operator can release the links 362*a*, 362*b* and allow the springs 380 to resiliently expand and, as a result, pivot the links 362*a*, 362*b* into their engaged positions and re-engage the lateral members 366*a*, 366*b*. More specifically, after the operator has let go of the links 362*a*, 362*b*, the springs 380 can push the connecting plate 378 back into its engaged, or level, position illustrated in FIG. 59 and, concurrently, rotate the links 362*a*, 362*b* upwardly into engagement with the lateral members 366*a*, 366*b*. In various embodiments, the second jaw housing 364 can comprise one or more spring chambers 382 configured to receive the springs 380 and limit the movement of the springs 380 within the internal cavity 381. In at least one such embodiment, the spring chambers 382 can confine the springs 380 such that they are compressed along a compression axis, such as a vertical axis, for example, and are not otherwise moved or deflected in a direction which is transverse to this axis.

As illustrated in FIG. 61, an internal biasing system positioned within the internal cavity 381 of the second jaw housing 364 can include two springs 380. In various other embodiments, only one spring 380 may be utilized. In certain other embodiments, more than two springs 380 could be utilized. In any event, the springs 380, and/or any other suitable biasing members, can be configured to transmit a biasing force to and through the connecting plate 378. In various embodiments, the connecting plate 378 can be sufficiently rigid such that it does not bend or deflect, or at least substantially bend or deflect, as a result of the forces transmitted therethrough. In at least one alternative embodiment, the connecting plate 378 could be configured to elastically flex such that it can comprise a biasing member capable of applying a biasing force to the links 362*a*, 362*b*.

As discussed above, referring again to FIGS. 62 and 63, the second jaw housing 364 can include a interior cavity 381. In various embodiments, the interior cavity 381 can be configured such that the ingress of debris, fluids, and/or particulates, such as chips and cutting fluids from milling operations, for example, into the cavity 381 can be prevented, or at least limited. In certain embodiments, the interior cavity 381 can be defined by first and second lateral sidewalls 320, a front wall 321, a rear wall 322, and a top wall 323, for example. In at least one such embodiment, the lateral sidewalls 320, the front wall 321, and the rear wall 322 can define an enclosed perimeter of the interior cavity 381 wherein the top of the interior cavity 381 can be enclosed by the top wall 323. Further to the above, the apertures 369, which can be defined in the housing 364 and the enclosed perimeter of the interior cavity 381, can be configured such that the projections 373*a*, 373*b* and/or the bearings positioned within the apertures 369, described above, can create a barrier and/or a seal preventing, or at least limiting, the ingress of debris, fluids, and/or particulates, for example, into the interior cavity 381. In various embodiments, the bottom of the interior cavity 381 can be enclosed by a plate, for example, while, in other embodiments, the bottom of the interior cavity 381 can comprise an opening 324 in the housing 364. In at least one embodiment, the lateral sidewalls 320, the front sidewall 321, and the rear wall 322 can be configured such that, when the second jaw housing 364 is positioned against the top surface 353 of the base 352, the walls 320, 321, and 322 extend to the top surface 353. In various embodiments, the walls 320, 321, and 322 can be configured such that few, if any, gaps are present between the enclosed perimeter of the interior cavity 381 and the top surface 353 of the base 352. As a result, a barrier and/or seal can be created between the housing 364 and the base 352 which can prevent, or at least limit, debris, fluids, and/or particulates, for example, from entering into the cavity 381.

In various embodiments, referring again to FIGS. 62 and 63, the connecting plate 378 and the springs 380 can be entirely positioned within the interior cavity 381. In such embodiments, the springs 380 and the connecting plate 378 can operate without interference from the presence of unwanted debris, fluids, or particulates, for example, within the interior cavity 381. In various embodiments utilizing alternative biasing systems for biasing the links 362*a*, 362*b* into an engaged position, such biasing systems could also be contained within the interior cavity 381. In certain embodiments, a portion of a biasing system could extend out of the interior cavity 381. Such embodiments could also include barriers and/or seals which can be configured to limit, or prevent, the ingress of debris, fluids, and/or particulates, for example, into the interior cavity 381.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A workholding apparatus, comprising:

a base comprising a workpiece support surface;

a first lateral member comprising a first bottom surface and a first array of engagement members defined in said first bottom surface;

a second lateral member comprising a second bottom surface and a second array of engagement members defined in said second bottom surface;

a drive member operably engaged with said first lateral member and said second lateral member, wherein said drive member is configured to move said first lateral member and said second lateral member simultaneously;

a first jaw member; and a second jaw member slidably engaged with and supported by said base, said second jaw member comprising:

a first lateral link movable between a disengaged position in which said first lateral link is operatively disengaged from said first lateral member and an engaged position in which said first lateral link is engaged with said first lateral member; and a second lateral link movable between a disengaged position in which said second lateral link is operatively disengaged from said second lateral member and an engaged position in which said second lateral link is engaged with said second lateral member, wherein said drive member is configured to move said second jaw member relative to said first jaw member when at least one of said first lateral link is engaged with said first lateral member and said second lateral link is engaged with said second lateral member, and wherein said second jaw member is movable relative to said first jaw member and said drive member when said first lateral link is disengaged from said first lateral member and said second lateral link is disengaged from said second lateral member.

2. The workholding apparatus of claim 1, further comprising a spring configured to bias said first lateral link into engagement with said first lateral member and said second lateral link into engagement with said second lateral member.

3. The workholding apparatus of claim 2, wherein said second jaw member further comprises a housing including an internal cavity, and wherein said spring is positioned within said internal cavity.

4. The workholding apparatus of claim 3, wherein said first lateral link is connected to said second lateral link by a connecting member, and wherein said spring is configured to transmit a biasing force to said first lateral link and said second lateral link through said connecting member in order to position said first lateral link in its said engaged position and said second lateral link in its said engaged position.

5. The workholding apparatus of claim 4, wherein said connecting member comprises a plate, wherein said spring is positioned intermediate said second jaw member housing and said plate, wherein said plate is mounted to said first lateral link and said second lateral link, wherein said spring is configured to apply said biasing force to said plate, and wherein said plate is configured to transmit said biasing force to said connection member.

6. The workholding apparatus of claim 1, wherein said first lateral link is connected to said second lateral link by a connecting member extending through said second jaw member, wherein said connecting member is rotatably supported by said second jaw member, and wherein said connecting member is configured to transmit movement between said first lateral link and said second lateral link.

7. The workholding apparatus of claim 6, wherein said first lateral link and said second lateral link are configured to pivot about a common axis.

8. The workholding apparatus of claim 1, wherein said first lateral member and said second lateral member are positioned below said workpiece support surface.

9. The workholding apparatus of claim 1, wherein said second jaw member further comprises a housing comprising:

a first lateral side;

a first lateral recess defined in said first lateral side, wherein at least a portion of said first lateral link is positioned within said first lateral recess;

a second lateral side; and a second lateral recess defined in said second lateral side, wherein at least a portion of said second lateral link is positioned within said second lateral recess.

10. The workholding apparatus of claim 1, wherein said first jaw member is engaged with said drive member.

11. A workholding apparatus, comprising:

a base comprising a workpiece support surface;

a first lateral member comprising a first bottom surface and a first array of engagement members defined in said first bottom surface;

a second lateral member comprising a second bottom surface and a second array of engagement members defined in said second bottom surface;

a drive member operably engaged with said first lateral member and said second lateral member, wherein said drive member is configured to move said first lateral member and said second lateral member simultaneously;

a first jaw member; and a second jaw member slidably engaged with and supported by said base, said second jaw member comprising:

a housing comprising a cavity;

a biasing member positioned within said cavity;

a first lateral connector movable between a disengaged position in which said first lateral connector is operatively disengaged from said first lateral member and an engaged position in which said first lateral connector is engaged with said first lateral member, wherein said first lateral connector extends into said cavity, and wherein said biasing member is configured to apply a biasing force to said first lateral connector to position said first lateral connector in said engaged position; and a second lateral connector movable between a disengaged position in which said second lateral connector is operatively disengaged from said second lateral member and an engaged position in which said second lateral connector is engaged with said second lateral member, wherein said second lateral connector extends into said cavity, wherein said biasing member is configured to apply a biasing force to said second lateral connector to position said second lateral connector in said engaged position, wherein said drive member is configured to move said second jaw member relative to said first jaw member when at least one of said first lateral connector is engaged with said first lateral member and said second lateral connector is engaged with said second lateral member, and wherein said second jaw member is movable relative to said first jaw member and said drive member when said first lateral connector is disengaged from said first lateral member and said second lateral connector is disengaged from said second lateral member.

12. The workholding apparatus of claim 11, wherein said first lateral connector is connected to said second lateral connector by a connecting member, and wherein said biasing member is configured to transmit said biasing force to said first lateral connector and said second lateral connector through said connecting member in order to position said first lateral connector in its said engaged position and said second lateral connector in its said engaged position.

13. The workholding apparatus of claim 12, wherein said connecting member comprises a plate, wherein said biasing member is positioned intermediate said housing and said plate, wherein said plate is mounted to said first lateral connector and said second lateral connector, wherein said spring is configured to apply said biasing force to said plate, and wherein said plate is configured to transmit said biasing force to said connecting member.

14. The workholding apparatus of claim 10, wherein said first lateral connector is connected to said second lateral connector by a connecting member extending through said housing, wherein said connecting member is rotatably supported by said housing, and wherein said connecting member is configured to transmit movement between said first lateral connector and said second lateral connector.

15. The workholding apparatus of claim 14, wherein said first lateral connector and said second lateral connector are configured to pivot about a common axis.

16. The workholding apparatus of claim 11, wherein said first lateral member and said second lateral member are positioned below said workpiece support surface.

17. The workholding apparatus of claim 11, wherein said housing further comprises:

a first lateral side;

a first lateral recess defined in said first lateral side, wherein at least a portion of said first lateral connector is positioned within said first lateral recess;

a second lateral side; and a second lateral recess defined in said second lateral side, wherein at least a portion of said second lateral connector is positioned within said second lateral recess.

18. The workholding apparatus of claim 11, wherein said first jaw member is engaged with said drive member.

19. A workholding apparatus, comprising:

a base comprising a workpiece support surface;

a first lateral member comprising a first bottom surface and a first array of engagement members defined in said first bottom surface;

a second lateral member comprising a second bottom surface and a second array of engagement members defined in said second bottom surface;

a drive member operably engaged with said first lateral member and said second lateral member, wherein said drive member is configured to move said first lateral member and said second lateral member simultaneously;

a first jaw member; and a second jaw member slidably engaged with and supported by said base, said second jaw member comprising:

a housing;

first selectively rotatable connection means for selectively disengaging said second jaw member from said first array of engagement members of said first lateral member; and second selectively rotatable connection means for selectively disengaging said second jaw member from said second array of engagement members of said second lateral member, wherein said first selectively rotatable connection means is configured to rotate concurrently with said second selectively rotatable connection means to operably disengage said second jaw member from said drive member.

* * * * *